US010317838B2

(12) United States Patent
Ding et al.

(10) Patent No.: US 10,317,838 B2
(45) Date of Patent: Jun. 11, 2019

(54) TONER CARTRIDGE

(71) Applicant: NINESTAR CORPORATION, Zhuhai (CN)

(72) Inventors: Geming Ding, Zhuhai (CN); Qin Luo, Zhuhai (CN); Hailong Ma, Zhuhai (CN); Qijie Liang, Zhuhai (CN)

(73) Assignee: NINESTAR CORPORATION, Zhuhai (CN)

( * ) Notice: Subject to any disclaimer, the term of this patent is extended or adjusted under 35 U.S.C. 154(b) by 0 days.

(21) Appl. No.: 16/107,292

(22) Filed: Aug. 21, 2018

(65) Prior Publication Data

US 2018/0356763 A1 Dec. 13, 2018

Related U.S. Application Data

(63) Continuation of application No. PCT/CN2017/094513, filed on Jul. 26, 2017.

(30) Foreign Application Priority Data

Sep. 21, 2016 (CN) ..... 2016 2 1073963
Sep. 28, 2016 (CN) ..... 2016 2 1093845
(Continued)

(51) Int. Cl.
*G03G 21/16* (2006.01)
*G03G 21/18* (2006.01)
*G03G 15/08* (2006.01)

(52) U.S. Cl.
CPC ..... *G03G 21/1647* (2013.01); *G03G 15/0865* (2013.01); *G03G 21/1676* (2013.01); *G03G 21/1842* (2013.01); *G03G 21/1853* (2013.01)

(58) Field of Classification Search
CPC ..... G03G 15/0865; G03G 21/1647; G03G 21/1676; G03G 21/1842; G03G 21/1853
See application file for complete search history.

(56) References Cited

U.S. PATENT DOCUMENTS 5,073,799 A * 12/1991 Watanabe ..... G03G 15/205 219/216
5,365,315 A * 11/1994 Baker ..... G03G 21/1832 399/111
(Continued)

FOREIGN PATENT DOCUMENTS

CN 1383039 A 12/2002
CN 1831679 A 9/2006
(Continued)

OTHER PUBLICATIONS

The World Intellectual Property Organization (WIPO) International Search Report for PCT/CN2017/094513 dated Nov. 1, 2017 6 Pages.

*Primary Examiner* — Francis C Gray
(74) *Attorney, Agent, or Firm* — Anova Law Group, PLLC

(57) ABSTRACT

The present disclosure provides a toner cartridge. The toner cartridge can be removably mounted in an electronic imaging device via a rotatable toner cartridge guide rail configured in the electronic imaging device. The toner cartridge includes a locating column, disposed and movable at one side of the toner cartridge. The locating column is supported by the toner cartridge guide rail and rotates the toner cartridge guide rail when the locating column is moved by an external force. The toner cartridge also includes an inspection device, having a trigger switch and disposed in the electronic imaging device. When the toner cartridge guide rail is rotated in response to the external force on the locating column, the toner cartridge guide rail touches the trigger switch and turns on the trigger switch.

16 Claims, 48 Drawing Sheets

(30) Foreign Application Priority Data

| | | |
|---|---|---|
| Sep. 30, 2016 | (CN) | 2016 2 1106874 |
| Sep. 30, 2016 | (CN) | 2016 2 1107854 |
| Oct. 12, 2016 | (CN) | 2016 2 1118266 |
| Oct. 18, 2016 | (CN) | 2016 2 1135967 |
| Oct. 27, 2016 | (CN) | 2016 2 1194630 |
| Nov. 11, 2016 | (CN) | 2016 2 1262010 |
| Dec. 13, 2016 | (CN) | 2016 1 1146239 |

(56) References Cited

U.S. PATENT DOCUMENTS

| | | | | |
|---|---|---|---|---|
| 5,436,704 | A * | 7/1995 | Moon | G03G 15/0822 399/256 |
| 7,092,657 | B2 | 8/2006 | Nakashima et al. | |
| 7,133,626 | B2 * | 11/2006 | Kaiga | G03G 7/00 399/110 |
| 8,731,435 | B2 * | 5/2014 | Xu | G03G 21/185 399/111 |
| 9,411,303 | B1 | 8/2016 | Boettcher | |
| 2002/0181969 | A1 * | 12/2002 | Terada | G03G 21/1853 399/111 |
| 2003/0113144 | A1 * | 6/2003 | Kanazawa | G03G 15/6588 399/343 |
| 2012/0275824 | A1 * | 11/2012 | Gu | G03G 21/186 399/111 |
| 2013/0051851 | A1 | 2/2013 | Fukamachi | |

FOREIGN PATENT DOCUMENTS

| | | | |
|---|---|---|---|
| CN | 101226359 | A | 7/2008 |
| CN | 201527543 | U | 7/2010 |
| CN | 102193374 | A | 9/2011 |
| CN | 205301817 | U | 6/2016 |
| CN | 105807595 | A | 7/2016 |
| CN | 105824222 | A | 8/2016 |
| CN | 106597825 | A | 4/2017 |
| CN | 206573863 | U | 10/2017 |
| JP | 2004038194 | A | 2/2004 |

* cited by examiner

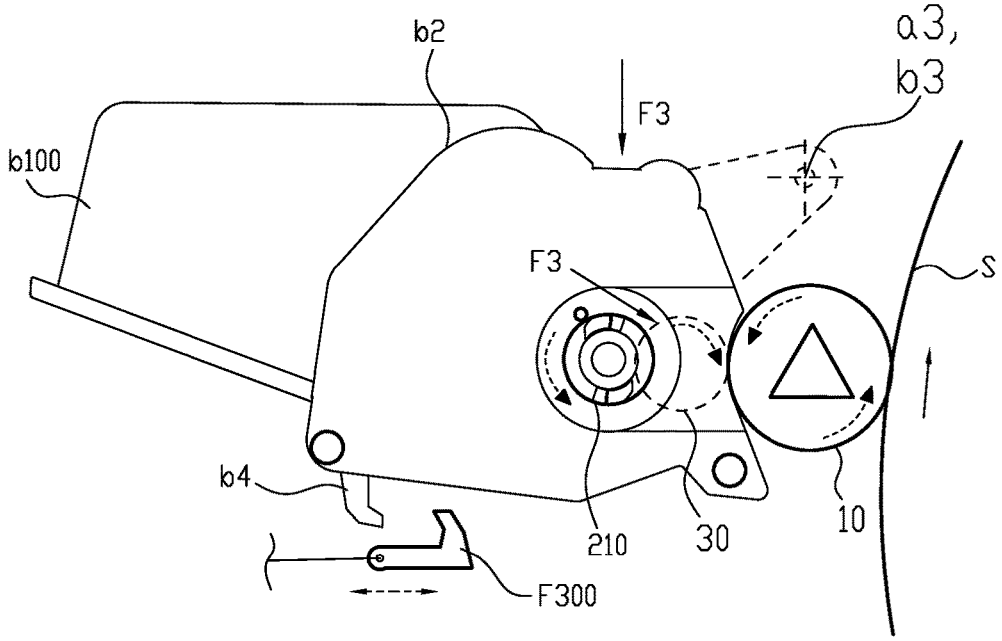
FIG. 70
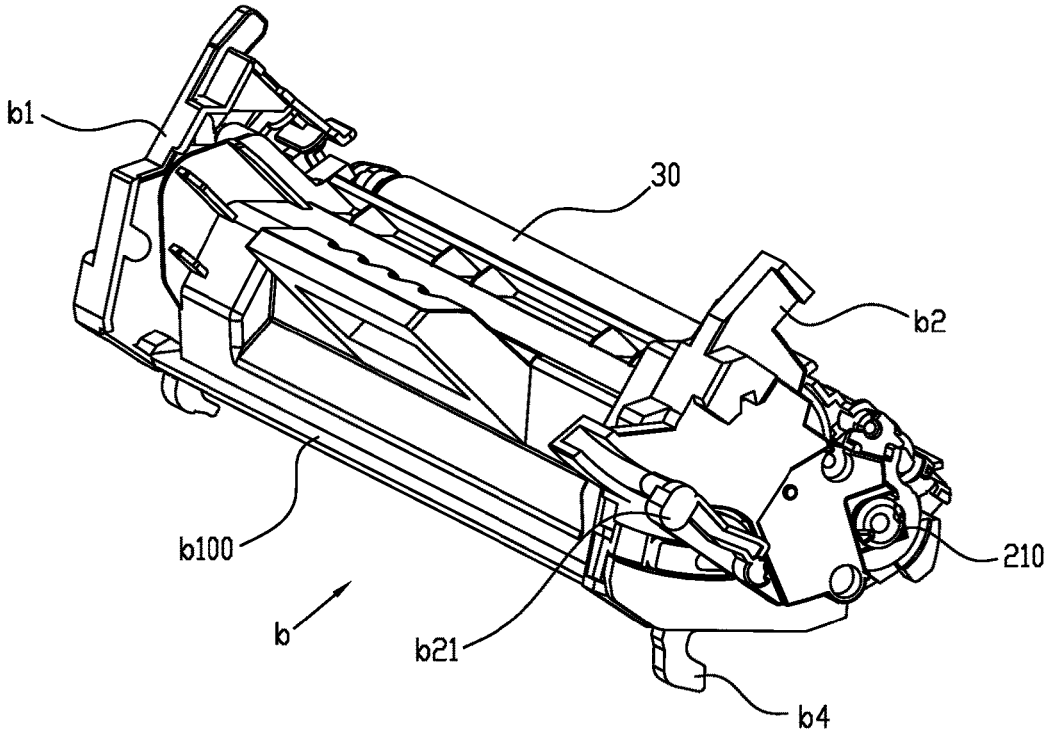
FIG. 70a1

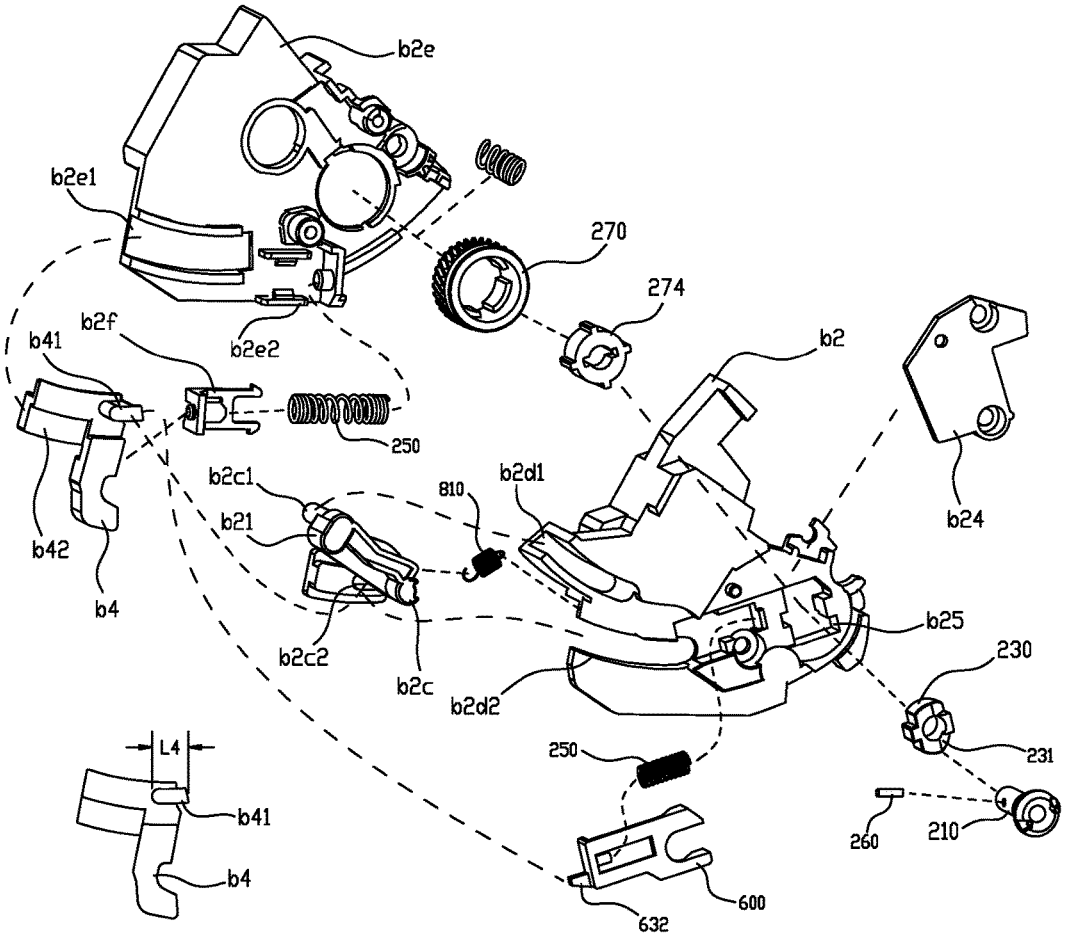
FIG. 70a2
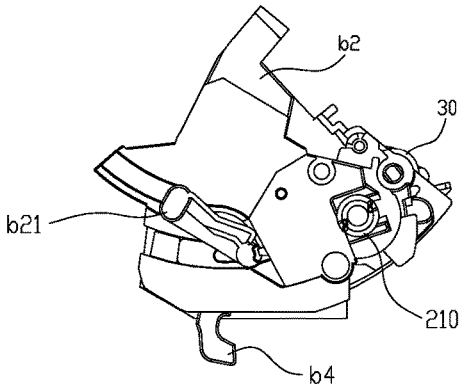
FIG. 70a3

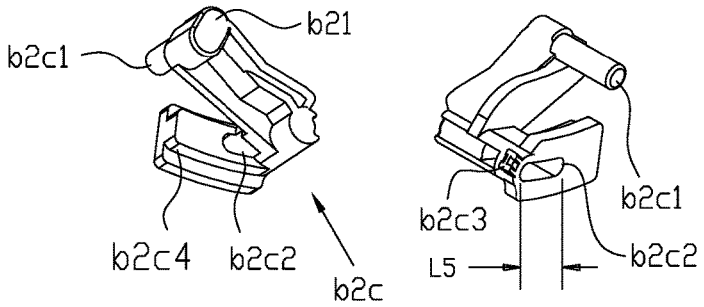
FIG. 70b
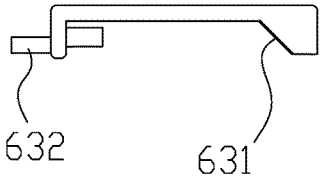
FIG. 70c
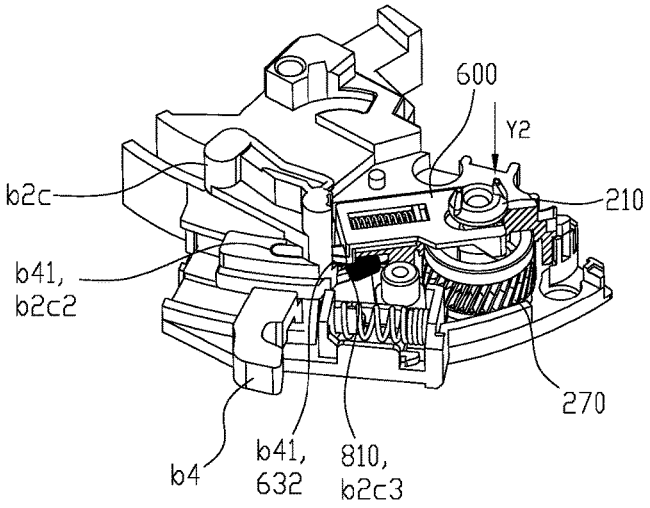
FIG. 70d1

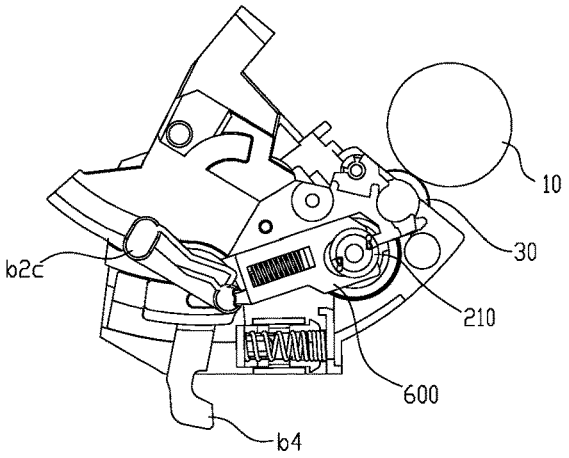
FIG. 70d2
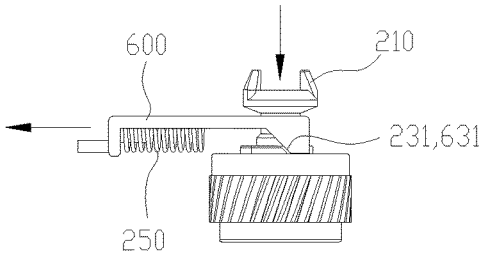
FIG. 70d3
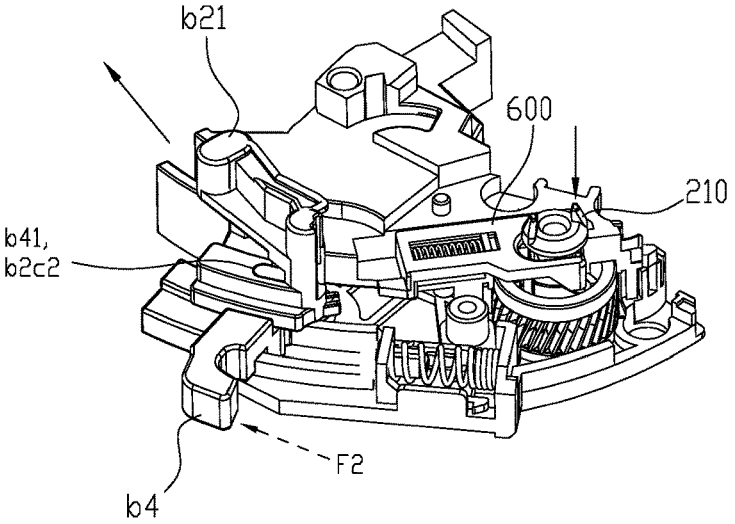
FIG. 70e1

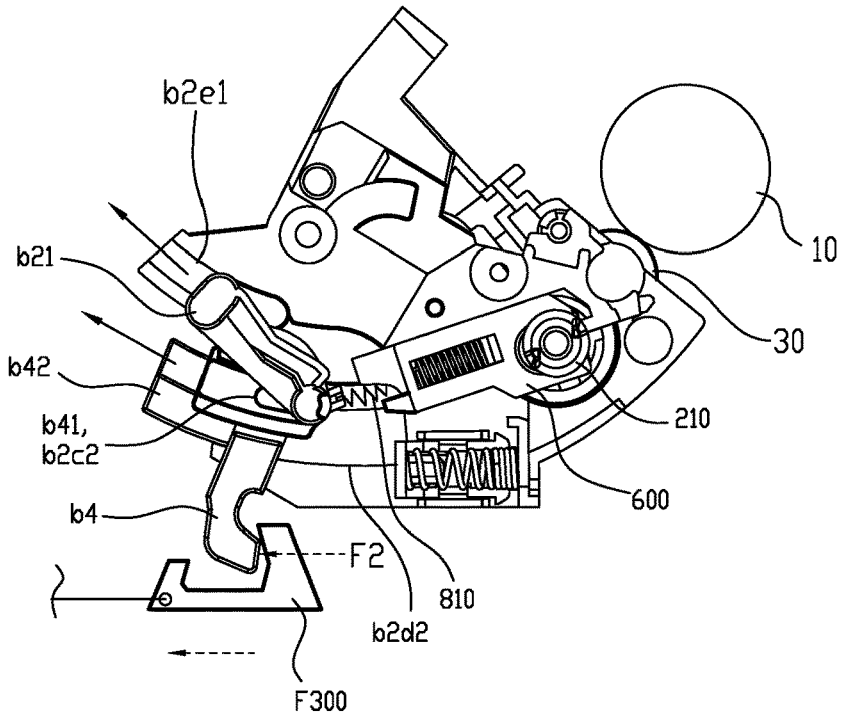
FIG. 70e2
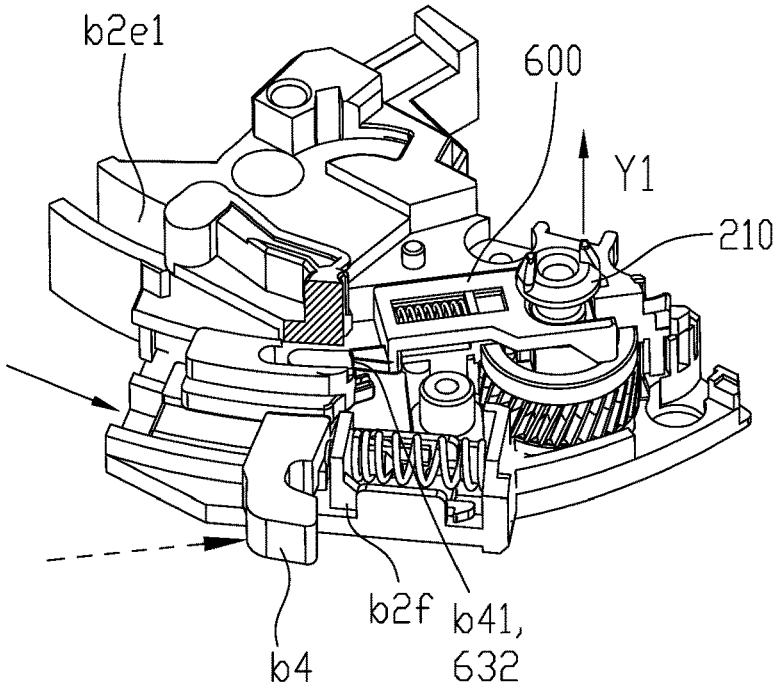
FIG. 70f1

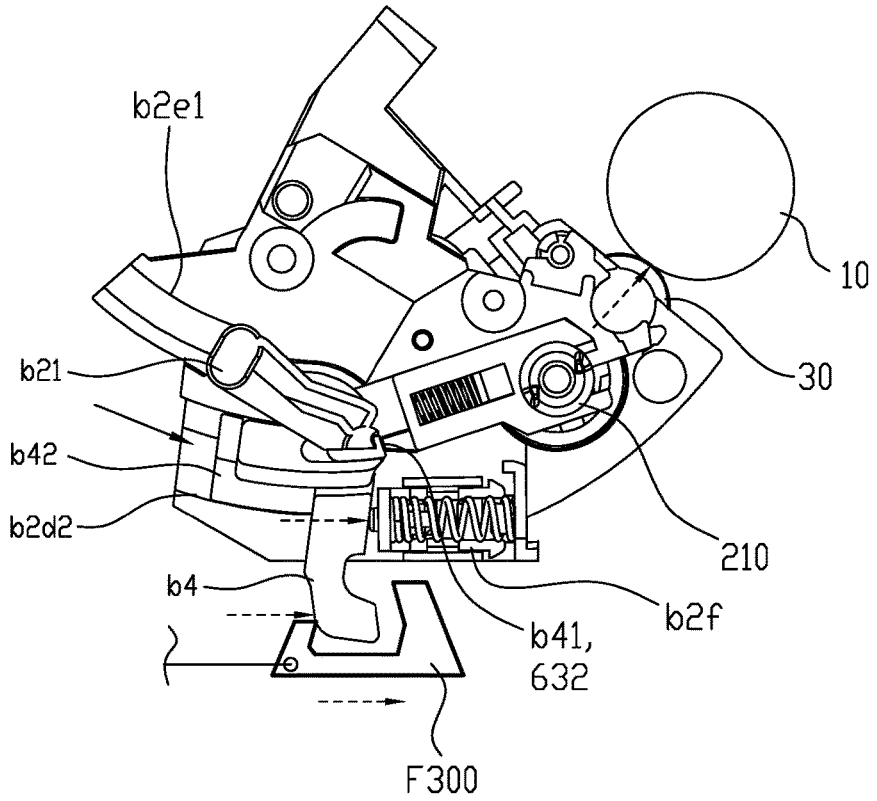
FIG. 70f2
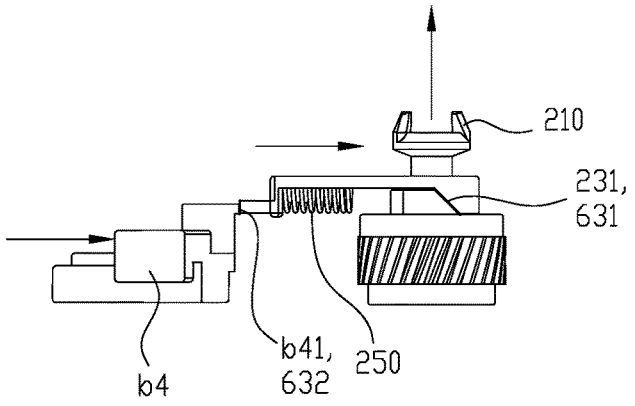
FIG. 70f3
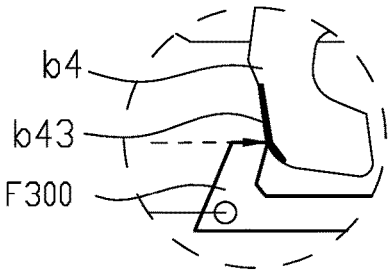
FIG. 70f4

TONER CARTRIDGE

CROSS-REFERENCE TO RELATED APPLICATIONS

This application is a continuation application of International Application No. PCT/CN2017/094513, filed on Jul. 26, 2017, which claims priority to Chinese Patent Applications No. 201621073963.5, filed on Sep. 21, 2016; Chinese Patent No. 201611146239.5, filed on Dec. 13, 2016; Chinese Patent No. 201621093845.0, filed on Sep. 28, 2016; Chinese Patent No. 201621106874.6, filed on Sep. 30, 2016; Chinese Patent No. 201621107854.0, filed on Sep. 30, 2016; Chinese Patent No. 201621118266.7, filed on Oct. 12, 2016; Chinese Patent No. 201621135967.1, filed on Oct. 18, 2016; Chinese Patent No. 201621194630.8, filed on Oct. 27, 2016; and Chinese Patent No. 201621262010.3, filed on Nov. 11, 2016. The above enumerated patent applications are incorporated herein by reference in their entirety.

TECHNICAL FIELD

The present disclosure relates to the field of electronic imaging technology, and in particular to a toner cartridge.

BACKGROUND

A toner cartridge is often removably mounted in an electronic imaging device. The electronic imaging device may include a drive unit to output a rotation driving force. The toner cartridge may usually include a drive assembly for receiving a rotation-force, a developing unit, a toner, a toner control unit and a frame that contains these units. In addition, based on different types of toner cartridge structures, the toner cartridge may also include a photosensitive unit, a charging unit, a cleaning unit and a stirring unit, etc. The drive assembly of the toner cartridge may be disposed at one side of the toner cartridge along an axial direction of the developing unit or the photosensitive unit. Through the drive assembly, the toner cartridge can be engaged with the drive unit of the electronic imaging device to transmit the rotation driving force into the toner cartridge. A rotation unit (including the developing unit, the photosensitive unit, and the stirring unit, etc.) of the toner cartridge is driven to rotate and the developing operation of the electronic imaging device can be executed.

Before the electronic image device can execute the developing operation (i.e., generally called "printing"), a user needs to mount the toner cartridge into the electronic imaging device. The drive assembly of the toner cartridge can be in contact and engaged with the drive unit of the electronic imaging device.

As shown in FIG. 1, a toner cartridge C may be mounted in an electronic imaging device (not shown) along X1 direction (the X1 direction is approximately perpendicular to the axial direction of the developing unit). Guide rails (F11, F21) on left and right inner side panels of the electronic imaging device may be configured to support and guide the toner cartridge C to enter the electronic imaging device. When the toner cartridge C is mounted along the guide rails (F11, F21) into the electronic imaging device, as shown in FIG. 2, a drive assembly 100 disposed at one side of the toner cartridge C can also be moved along the X1 direction to be in contact and engaged with a drive unit 900 of the electronic imaging device. The drive unit 900 is relatively fixed in the electronic imaging device and is only rotatable along the axis of the drive unit 900. As the drive assembly

100 moves along the X1 direction to engage with the drive unit 900, it may be possible that the rotation-driving-force receiving assembly 110 of the drive assembly 100 structurally interferes with the drive unit 900.

Therefore, in current technologies, when the rotation-driving-force receiving assembly 110 is structurally interfering with the drive unit 900, with pressure from the drive unit 900, the rotation-driving-force receiving assembly 110 can be contracted inward in the axial direction of the rotation-driving-force receiving assembly 110, so that the structural interference may be avoided. When the rotation-driving-force receiving assembly 110 is further moved till approximately coaxial with the drive unit 900, the structural interference between the rotation-driving-force receiving member 110 and the drive unit 900 may be avoided. Because of an elastic force of a spring disposed in the drive assembly 100, the rotation-driving-force receiving assembly 110 can protrude to be in contact and engaged with the drive unit 900.

After the toner cartridge is mounted in the electronic imaging device (not shown), to ensure the electronic imaging device can function well, it is usually necessary to trigger an inspection device to inspect whether the toner cartridge C is mounted correctly. However, there is no simple and effective approach to trigger the inspection device.

SUMMARY

The present disclosure provides a toner cartridge and an electronic imaging device to solve technical problems of inspecting whether a matching toner cartridge is correctly mounted into an electronic imaging device, when the toner cartridge is mounted into the electronic imaging device.

A technical solution according to the present disclosure is to provide a toner cartridge. The toner cartridge can be removably mounted in an electronic imaging device. The electronic imaging device may include a rotatable toner cartridge guide rail, and the toner cartridge can be mounted at the toner cartridge guide rail. A locating column may be disposed at one side of the toner cartridge, and the locating column can be supported by the toner cartridge guide rail. The locating column can be moved by an external force to rotate the toner cartridge guide rail. The electronic imaging device may also include an inspection device, which includes a trigger switch. When the toner cartridge is rotated because of the external force exerting on the locating column, the toner cartridge guide rail may touch the trigger switch and turn on the trigger switch.

In some embodiments, a side panel may be disposed at one side of the toner cartridge, and the locating column can be slid relative to the side panel.

In some embodiments, a slider may be disposed on the side panel, and the locating column may be disposed on the slider. Under the external force, the slider can drive the locating column to slide relative to the side panel.

In some embodiments, the slider may include a protrusion, and a chute may be disposed on the side panel. Through the protrusion, the slider can be slid on the chute of the side panel.

In some embodiments, the toner cartridge may further include a developing unit. Compared to the location of a slider slid by the external force, the slider may be located closer to the developing unit before the external force is applied for sliding the slider.

In some embodiments, an elastic resetting part may be further disposed between the slider and the side panel. The resetting part is configured to reset the slider when no external force exerting on the slider.

In some embodiments, the slider may further include a cartridge action part. The cartridge action part can be moved by an external force to cause the slider to drive the locating column to move. The cartridge action part may be disposed on the slider and protrude downward.

In some embodiments, the cartridge action part may have a protruding rod-shaped or hook-shaped structure.

In some embodiments, the cartridge action part and the slider may be integrally or separately configured.

In some embodiments, the electronic imaging device may include a pulling part, and the pulling part may be configured to drag the cartridge action part to move.

In some embodiments, a driving-force receiving member may be disposed at one side of the toner cartridge and configured to receive a rotation driving force from the drive unit of the electronic imaging device. The driving-force receiving unit and the locating column may be disposed at the same side of the toner cartridge.

In some embodiments, the toner cartridge may further include a flange. The flange may be configured receive the rotation driving force from the driving-force receiving member, and the driving-force receiving member can be extended and contracted relative to the flange.

In some embodiments, a claw may be disposed at an upper end of the driving-force receiving member, and the claw may be tilted or swung relative to the driving-force receiving member.

In some embodiments, the toner cartridge may further include a control mechanism, and the control mechanism may be configured to control the driving-force receiving member to extend and contract.

In some embodiments, when subjected to a force, the cartridge action part may be configured to push the control mechanism, so that the control mechanism can control the driving-force receiving member to extend and contract.

In some embodiments, the toner cartridge may include a developing chamber, and the side panel is fixed to one side of the developing chamber. The developing chamber and the side panel may not be rotatable along with a rotation of the toner cartridge guide rails.

The technical solutions provided by the embodiments of the present application can achieve a beneficial effect: using the above technical solutions, whether the toner cartridge is correctly mounted can be determined by a conduction state of the inspection device.

Other aspects or embodiments of the present disclosure can be understood by those skilled in the art in light of the description, the claims, and the drawings of the present disclosure.

DESCRIPTION OF THE DRAWINGS

The accompany drawings are provided to further understand the technical solutions of the present disclosure, and are a part of the specification. The drawings are merely examples for illustrative purposes according to various disclosed embodiments and are not intended to limit the scope of the present disclosure.

FIG. 41 and FIG. 42 are schematic diagrams of a photosensitive unit separating from a developing unit according to a first exemplary embodiment of the present disclosure.

FIG. 69 and FIG. 70 are schematic diagrams of operations of a toner cartridge and a photosensitive assembly according to a sixth exemplary embodiment of the present disclosure.

FIG. 70*a*1, FIG. 70*a*2, and FIG. 70*a*3 are schematic structural diagrams of a toner cartridge according to a seventh exemplary embodiment of the present disclosure.

FIG. 70*b* is a schematic structural diagram of a slider of a toner cartridge according to a seventh exemplary embodiment of the present disclosure.

FIG. 70*c* is a schematic structural diagram of a control mechanism of a toner cartridge according to a seventh exemplary embodiment of the present disclosure.

FIG. 70*d*1, FIG. 70*d*2 and FIG. 70*d*3 are schematic diagrams of a first position of a toner cartridge according to a seventh exemplary embodiment of the present disclosure.

FIG. 70*e*1 and FIG. 70*e*2 are schematic diagrams of a second position of a toner cartridge according to a seventh exemplary embodiment of the present disclosure.

FIG. 70*f*1, FIG. 70*f*2, FIG. 70*f*3 and FIG. 70*f*4 are schematic diagrams of a third position of a toner cartridge according to a seventh exemplary embodiment of the present disclosure.

DETAILED DESCRIPTION

Figure 1:
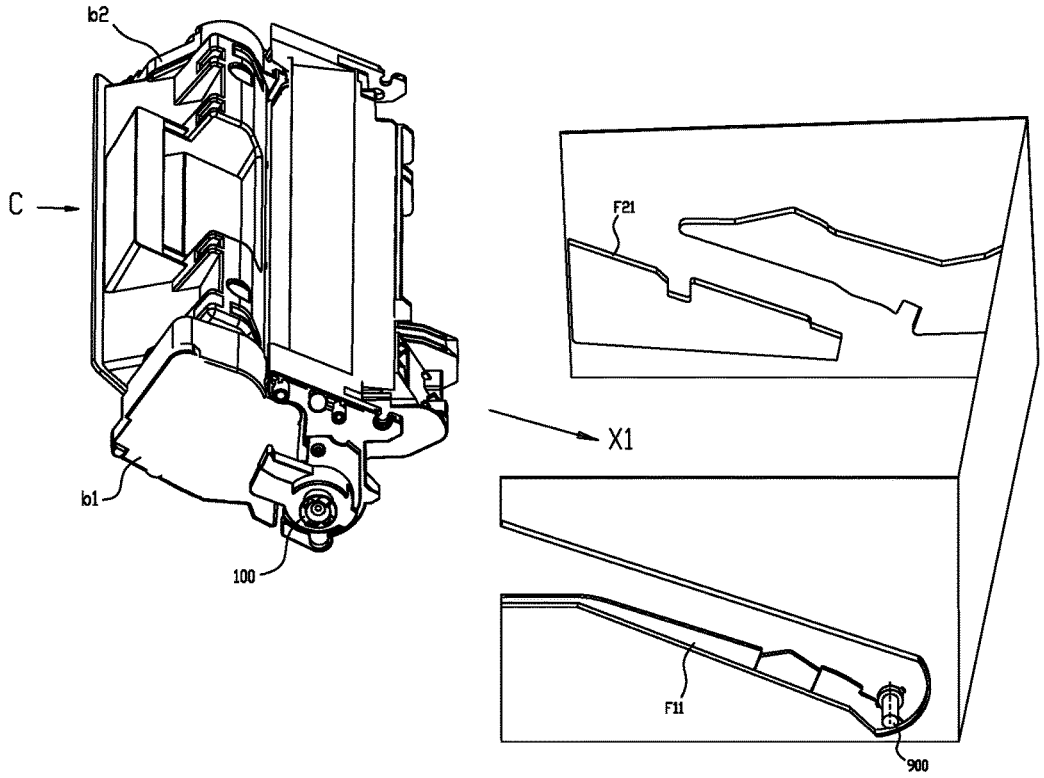
FIG. 1 is a schematic diagram of a toner cartridge mounted in an electronic imaging device.

The embodiments of the present invention will be described in detail with reference to the accompanying drawings and the exemplary embodiments. How to solve the technical problems by applying the corresponding technical means, and how to implement the process to realize the corresponding technical effect can be fully understood and implemented accordingly. The embodiments of the present disclosure and the features in the embodiments of the present disclosure can be combined with each other on the premise of no conflict, and the formed technical scheme is within the protection scope of the invention.

The present disclosure relates to the field of electronic imaging technology, and more particularly, to a toner cartridge. The toner cartridge can be removably mounted in an electronic imaging device via a rotatable toner cartridge guide rail configured in the electronic imaging device. A locating column may be disposed at one side of the toner cartridge. The locating column can be supported by the toner cartridge guide rail and rotate the toner cartridge guide rail when the locating column is moved by an external force. The toner cartridge may also include an inspection device, which may have a trigger switch and be disposed in the electronic imaging device. When the toner cartridge guide rail is rotated in response to the external force on the locating column, the toner cartridge guide rail may touch the trigger switch and turn on the trigger switch. By using the above technical solutions, whether the toner cartridge is correctly mounted can be determined by a conduction state of the inspection device.

In the present disclosure, as shown in the drawings, an axial direction of a toner cartridge b may be the same as an axial direction of a developing unit 30 or a photosensitive unit 10 of the photosensitive assembly a.

In the present disclosure, as shown in the drawings, a mounting direction of the toner cartridge b in an electronic imaging device may be substantially perpendicular to an axial direction of the toner cartridge b.

In the present disclosure, as shown in the drawings, an unmounting (or removal or taking out) direction of the toner cartridge b from the electronic imaging device may be opposite to the mounting direction of the toner cartridge b.

Exemplary Embodiment I

Figure 3:
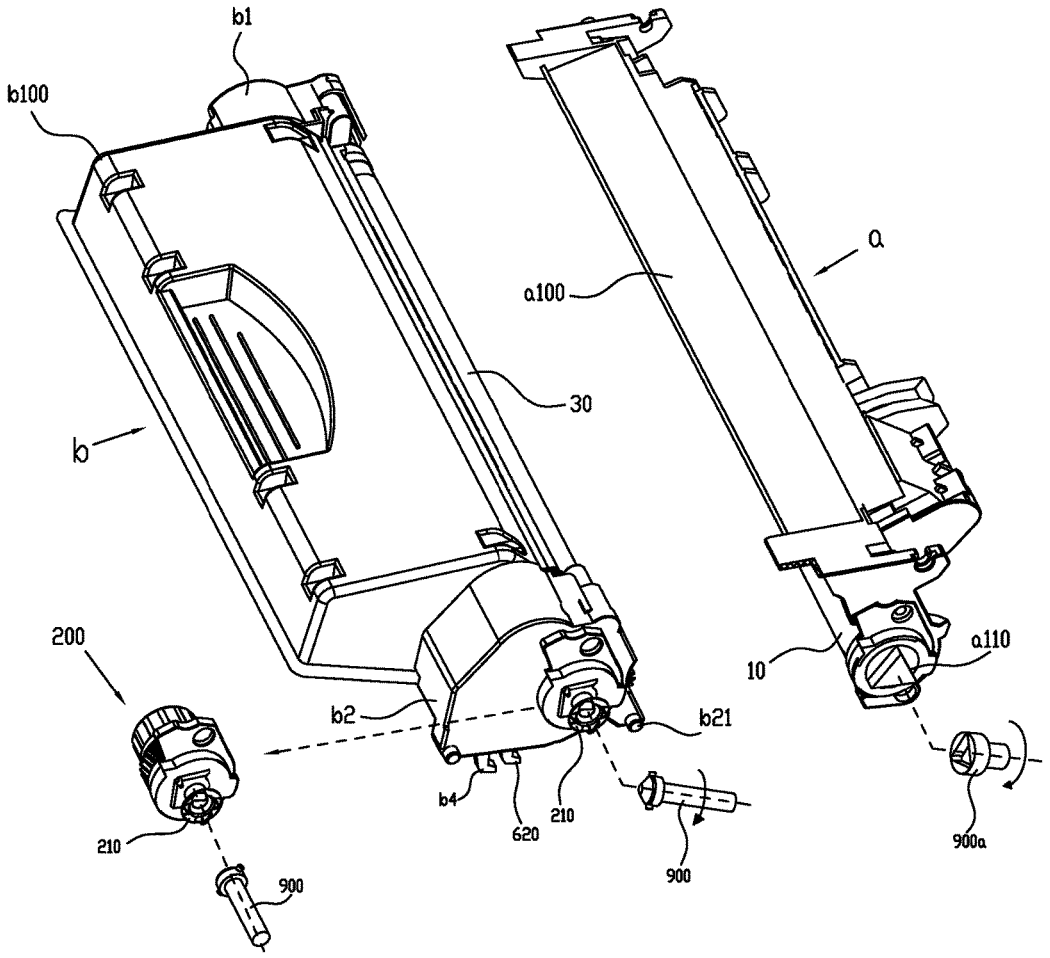
FIG. 3 is a schematic structural diagram of an toner cartridge and drive assembly according to a first exemplary embodiment of the present disclosure.

FIG. 3 is a schematic structural diagram of a toner cartridge b. The toner cartridge b may include a developing chamber b100 and side panels b1 and b2 disposed at both sides of the developing chamber b100. The developing chamber b100 may accommodate a drive assembly 200, which may be configured to be engaged with the drive unit 900 of the electronic imaging device and receive the rotation driving force. The drive assembly 200 may be mounted on the side panel b2. In addition, a photosensitive assembly a may be configured to cooperate with the toner cartridge b to execute a developing operation. The photosensitive assembly a may include a photosensitive chamber a100 and a driving element a110 that is disposed at a side of the photosensitive chamber a100. The driving element a100 may be engaged with another drive unit 900*a* of the electronic imaging device, receive the rotation driving force and send the rotation driving force to a photosensitive unit 10 of the photosensitive chamber a100. In some embodiments, the driving element a110 may be in an outward convex triangular structure.

Drive Assembly

Figure 7A:
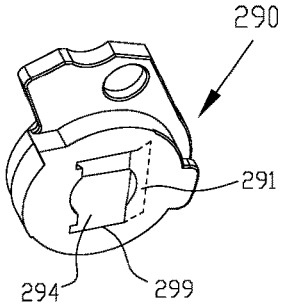
FIG. 7*a* and FIG. 7*b* illustrate a schematic structural diagram of an end cap of a toner cartridge according to a first exemplary embodiment of the present disclosure.
Figure 7B:
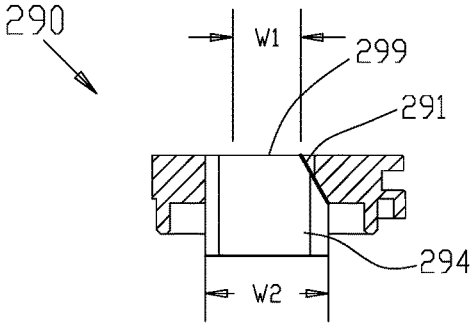
Figure 8:
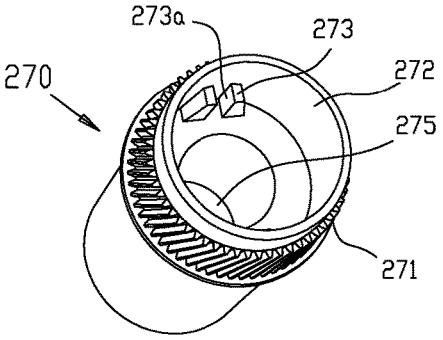
FIG. 8 is a schematic structural diagram of a flange of a drive assembly according to a first exemplary embodiment of the present disclosure.

As shown in FIG. 4 to FIG. 8, the drive assembly 200 may be disposed in the side panel b2 of the developing chamber b100. The drive assembly 200 may include a driving-force receiving member 210, a flange 270, a pressing element 220, a slider 230, an elastic element 250, and a connecting part 260. The driving-force receiving member 210 may include a connecting member 216, a claw 211, and a notch 215. A slot and a limiting surface may be disposed at the center of the connecting member 216. The claw 211 may be disposed at one side of the connecting member 216 and configured to abut against and engage with a drive column 910 of the drive unit 900. The notch 215 may be disposed at the other side of the connecting member 216. The pressing element may have a hollow frame structure. A sliding surface 224 may be disposed at a side surface of the pressing element 220, and a pressure receiving element 221 may be disposed at an upper end of the pressing element 220 and the pressure receiving element 221 may include a curved or an inclined surface. The pressing element 220 may also include a pair of sliding blocks 223. The slider 230 may have a trapezoidal structure with a narrower upper width. The upper surface of the slider 230 may abut against the limiting surface of the driving-force receiving member 210. Inclined sliding surfaces 231 may be disposed on side surfaces of the slider 230 and chutes 232 may be disposed on the two opposite side surfaces of the slider 230. The slider 230 may also include a through hole 236. A through port 299 may be disposed at the center of an end cap 290. An inclined sliding surface 291 and a vertical sliding surface 294 may be disposed inward around the port 299. Because of the inclined configuration of the inclined sliding surface 29, the through port 299 of the end cap 290 may have a structure with a smaller outer width (i.e., an inner width W2 may be larger than an outer width W1, as shown in FIG. 7). The flange 270 may be a cylindrical structure and include a cavity 272. A gear surface 271 may be disposed on the surface of the flange 270 and configured to transmit the driving force. A bottom surface 275 may be disposed at the bottom of the cavity 272, and the cavity 272 may also include a pair of limiting chutes 273. Each of the limiting chutes 273 may be constructed by two protrusions and include a chute 273*a*. The connecting part 260 may have a centrally projecting crank-shaped structure.

Figure 4:
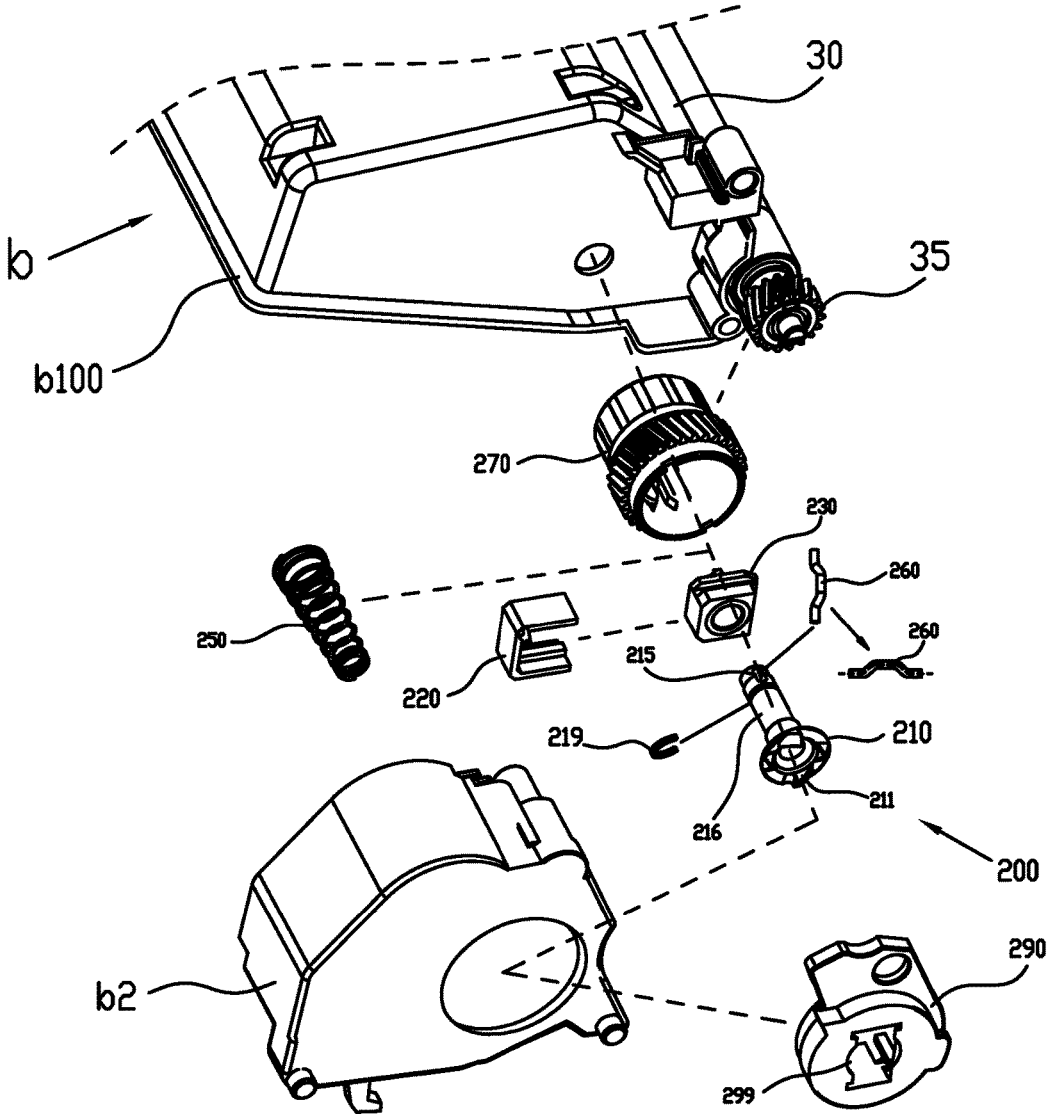
FIG. 4 is a schematic structural diagram of another toner cartridge and drive assembly according to a first exemplary embodiment of the present disclosure.
Figure 5:
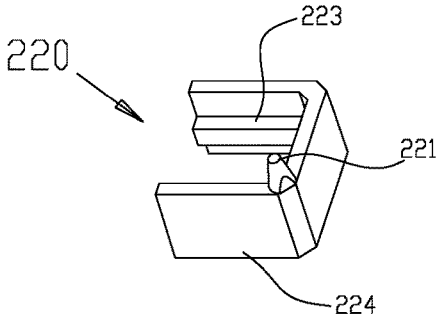
FIG. 5 is a schematic structural diagram of a pressing element of a drive assembly according to a first exemplary embodiment of the present disclosure.
Figure 6:
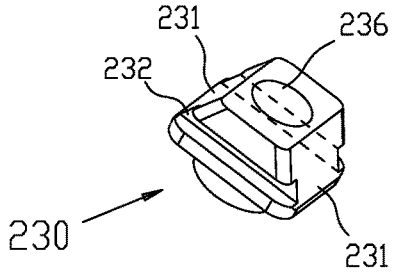
FIG. 6 is a schematic structural diagram of a slider of the drive assembly according to a first exemplary embodiment of the present disclosure.

As shown in FIG. 4, assembly relationships between the above-described parts/components may be as following. Through the inner sliding blocks 223, the pressing element 220 can be translationally sliding matched with the chute 232 that may be disposed on two side surfaces of the slider 230. Through the connecting member 216, the driving-force receiving member 210 can pass the through hole 236 of the slider 230 and the pressing element 220, and the limiting surface of the driving-force receiving member 210 can abut against the top surface of the slider 230. A buckle 219 can be engaged with the slot of the driving-force receiving member 210 that protrudes form the slider 230, so that the driving-force receiving member 210 can be axially fixed on the slider 230. The connecting part 260 can pass the notch 215 that is disposed at one side of the connecting member 216, and the middle protrusion of the connecting part 260 can be placed (or in some cases inserted) in the notch 215. The elastic element 250 can be placed in the cavity 272 of the flange 270. Two ends of the connecting part 260 can be placed in the limiting chute 273 that is included by the flange 270. One end of the elastic element 250 can abut against the bottom surface 275 of the cavity 272, and the other end can abut against two ends of the connecting part 260. The above parts/components can be assembled and integrally mounted on the side panel b2 of the toner cartridge b. The flange 270 can transmit the driving force to a gear 35 and drive the developing unit 30 to operation. The end cap 290 can cover on the slider 230, and the driving-force receiving member 210 can protrude outward from a through port 299 of the end cap 290. The inclined sliding surface 231 of the slider 230 can abut against the inclined sliding surface 291 that is included in the end cap 290. The sliding surface 224 of the pressing element 220 can be vertically sliding matched with the sliding surface 294 of the end cap 290. To prevent the drive assembly 200 from detaching from the toner cartridge b, the end cap 290 can be mounted on the side panel b2 of the toner cartridge b by threading, glutting or wielding, etc.

According to the above description, one end of the elastic element 250 may abut against the connecting part 260 and two ends of the connecting part 260 can be placed (in some cases inserted) in the limiting chute 273, so that the connecting part 260 can be elastically movable along the limiting chute 273, and the driving-force receiving member 210 that is connected to the connecting part 260 may also be extended and contracted elastically relative to the flange 270. Similarly, the slider 230 may be connected to the driving-force receiving member 210, and the pressing element 220 may be connected to the slider 230, therefore, the slider 230 and the pressing element 220 can also be moved along with the movement of the driving-force receiving member 210. When the end cap 290 is covering at the slider 230, because of the elastic force of the elastic element 250, the inclined sliding surface 231 of the slider 230 may abut against the inclined sliding surface 291 to limit the amount that the driving-force receiving member 210 can protrude in the drive assembly 200. Therefore, the driving-force receiving member 210 can be axially extended and contracted by the elastic force along a direction Y (the direction Y may be approximately coaxial or coincident with the axial direction of the developing unit 30 or the photosensitive unit 10, and approximately perpendicular to the direction X).

Figure 9:
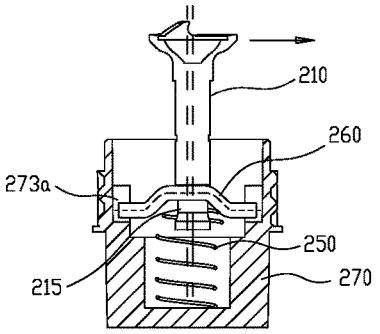
FIG. 9, FIG. 10 and FIG. 11 are schematic diagrams of a displacement operation of a driving-force receiving member according to a first exemplary embodiment of the present disclosure.
Figure 10:
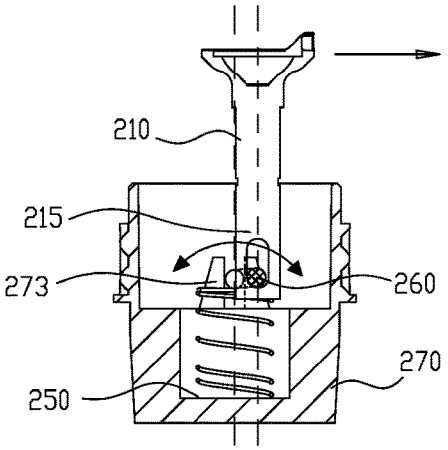
Figure 11:
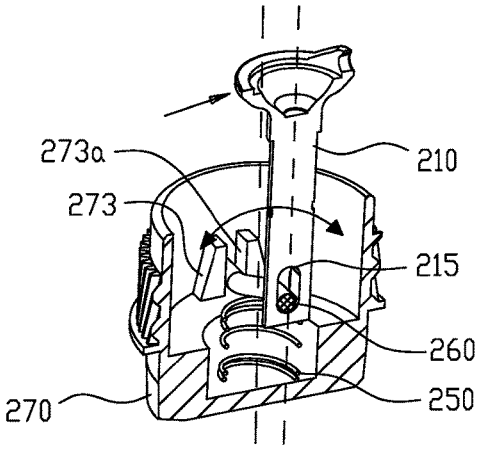

As shown in FIG. 9 to FIG. 11, the driving-force receiving member 210 disposed in the drive assembly 200 can implement the following operation process (to facilitate understanding the operation process of the driving-force receiving member 210 in the flange 270, some parts of the drive assembly 200 are not shown). (1) Under the elastic force of the elastic element 250, the driving-force receiving member 210 can be axially extended and contracted along the direction Y. (2) As shown in FIG. 9, which is viewed from a lengthwise direction of the connecting part 260, the driving-force receiving member 210 can be assembled and matched with the connecting part 260 through the notch 215. Therefore, the driving-force receiving member 210 can be slidable along the lengthwise direction of the connecting part 260, i.e., in the flange 270, the driving-force receiving member 210 can achieve a parallel displacement of certain distance relative to the rotation axis of the flange 270. (3) As shown in FIG. 10 and FIG. 11, which are viewed from the direction of an end face of the connecting part 260, the connecting part 260 has a centrally protruding crank-shaped structure, and two ends of the connecting part 260 can be placed (in some cases inserted) in the chute 273. Therefore, the driving-force receiving member 210 can be engaged with the connecting part 260 through the notch 215 and swing left and right through the centrally protruding crank-shaped structure of the connecting part 260, i.e., in the flange 270, the driving-force receiving member 210 can achieve a parallel displacement of certain distance relative to the rotation axis of the flange 270.

Figure 12:
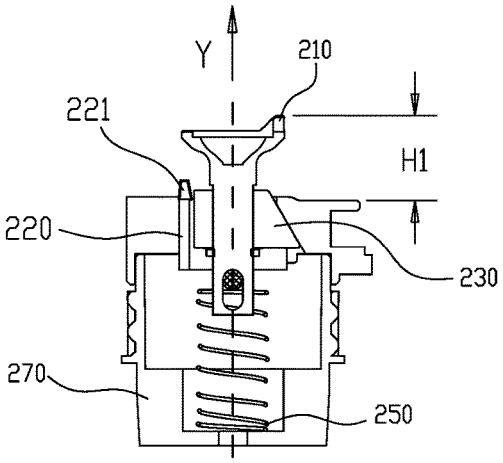
FIG. 12 and FIG. 13 are schematic diagrams of extending and contracting operations of a driving-force receiving member according to a first exemplary embodiment of the present disclosure.
Figure 13:
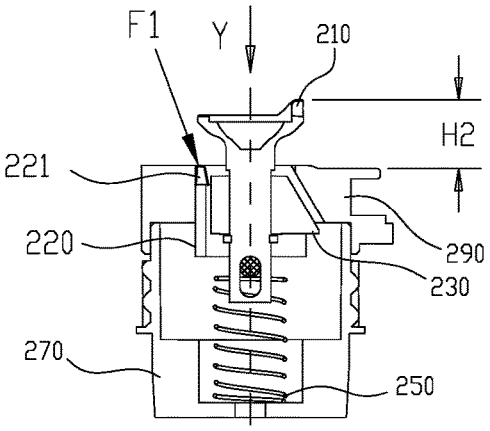
Figure 13A:
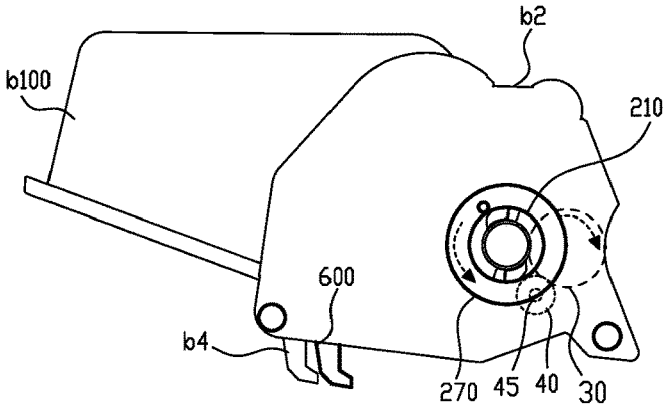
FIG. 13*a* is a schematic side view of a toner cartridge according to a first exemplary embodiment of the present disclosure.

As shown in FIG. 12 and FIG. 13, after the drive assembly 200 is assembled, when no external force is exerting on the drive assembly 200, the driving-force receiving member 210 can be kept protruding outward by the elastic force of the elastic element 250, and the pressure receiving element 221 of the pressing element 220 can also protrude outward relative to the outer surface of the end cap 290. At this time, the driving-force receiving member 210 is in an initial position. When the pressure receiving element 221 is pressed by an external force F1, the pressing element 220 can be pressed to move downward to drive the slider 230. The slider 230 can drive the driving-force receiving member 210 to move downward along the direction Y and compress the elastic element 250. At this time, the driving-force receiving member 210 is in a contracting position. A height H1 from the top of the driving-force receiving member 210 in the initial position to the outer surface of the end cap 290 is greater than a height H2 from the top of the driving-force receiving member 210 in the contracting position to the outer surface of the end cap 290.

FIG. 13 shows a side view of the toner cartridge b. A rotation axis of a toner feed unit 40 may be disposed within the contour projection range of the flange 270, or the metal shaft 45 of the toner feed unit 40 maybe at least partially overlap with the flange 270.

Control Member

A control member of the drive unit 200 may include a set of parts that enable the driving-force receiving member 210 to extend and contract relative to the flange 270. The control member of the drive unit 200 or the set of parts may include the pressing element 220, the slider 230, and the elastic element 250.

Cartridge Action Part

Figure 14:
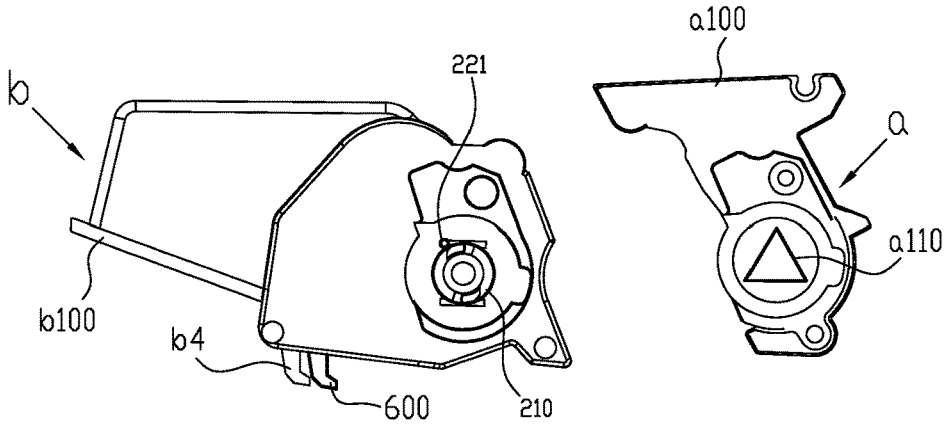
FIG. 14 is a schematic structural diagram of a toner cartridge and a photosensitive assembly according to a first exemplary embodiment of the present disclosure.

FIG. 14 shows a side view of the toner cartridge b. A cartridge action part b4 may be disposed at the bottom of the developing chamber b100 of the toner cartridge b. The cartridge action part b4 may have a rod-shaped or a hook-shaped structure projecting downward and outward. The cartridge action part b4 can be connected to the developing chamber b100, or the side panel (b1 or b2) of the developing chamber b100. When the external force is exerting on the cartridge action part b4, through the cartridge action part b4, the external force can also exert on the toner cartridge b.

Control Mode 1 of Control Mechanism

Figure 15:
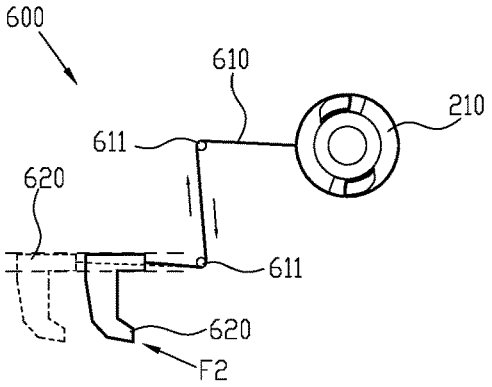
FIG. 15, FIG. 16 and FIG. 17 are schematic diagrams of structure and operation process of a control mechanism using Control Mode 1 according to a first exemplary embodiment of the present disclosure.
Figure 16:
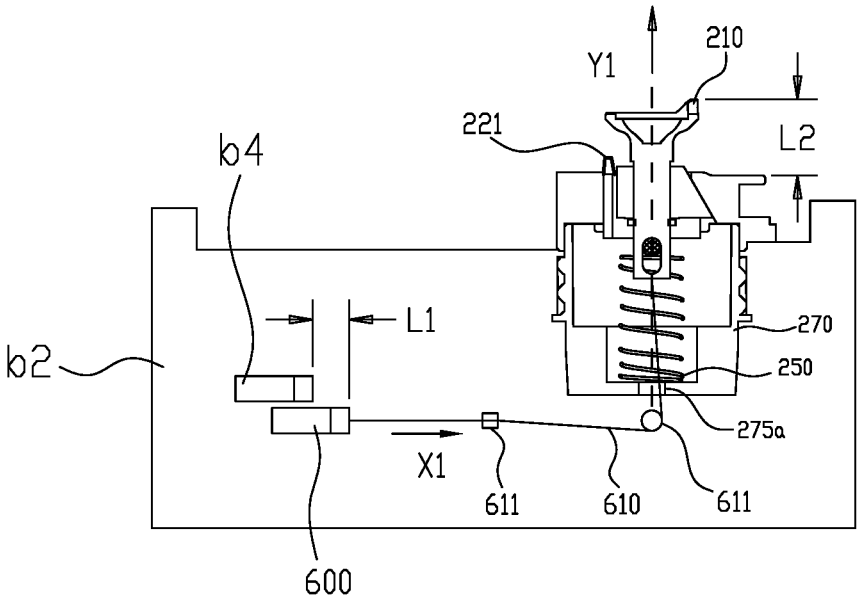
Figure 17:
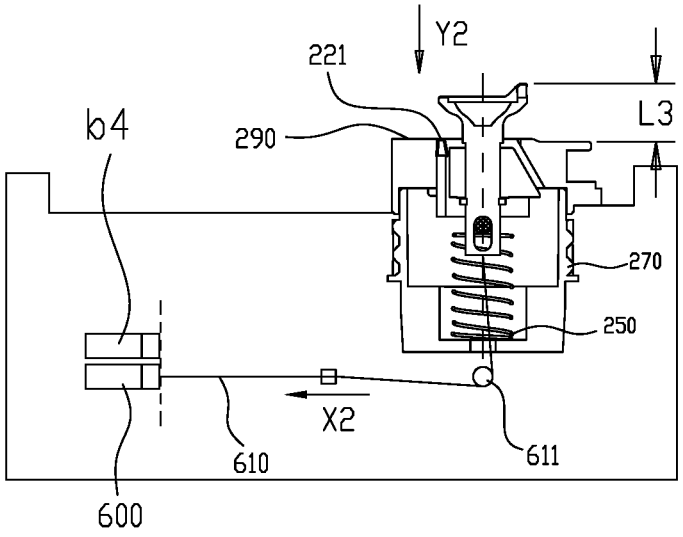
Figure 18:
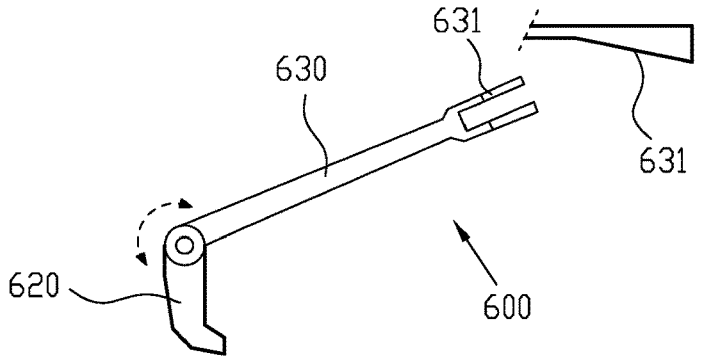
FIG. 18, FIG. 19, FIG. 20 and FIG. 21 are schematic diagrams of structure and operation process of a control mechanism using Control Mode 2 according to a first exemplary embodiment of the present disclosure.
Figure 19:
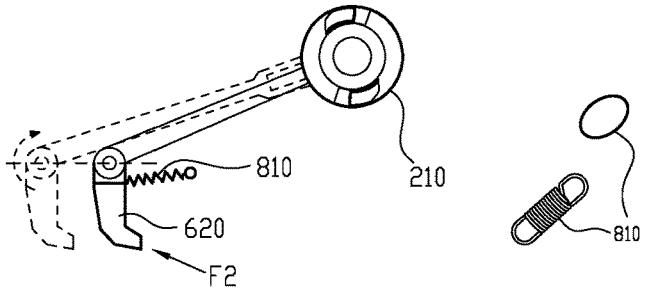
Figure 20:
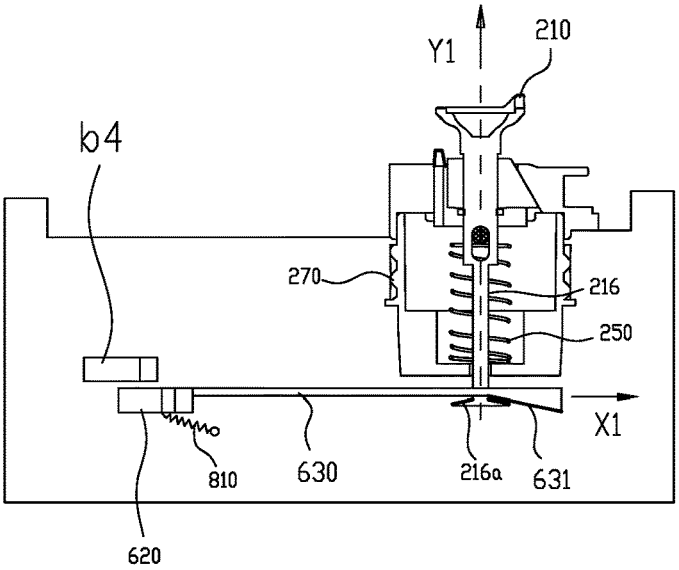
Figure 21:
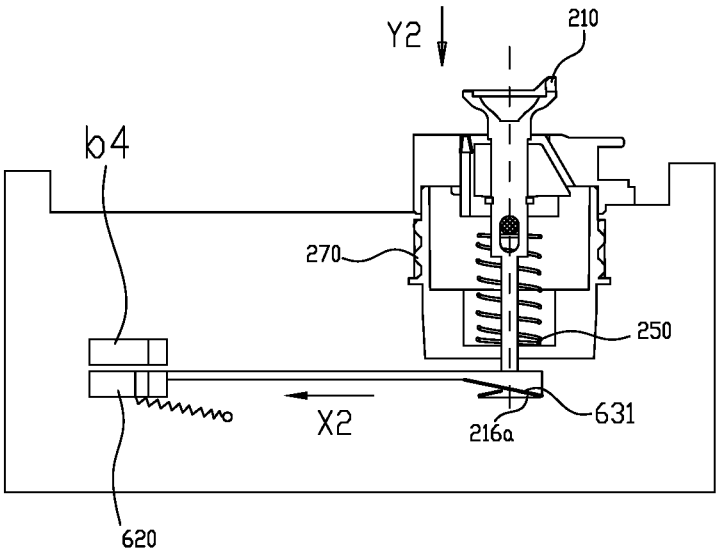
Figure 22:
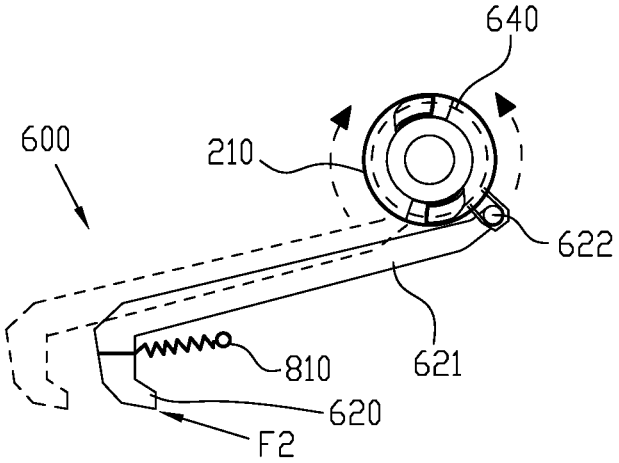
FIG. 22, FIG. 23, FIG. 24, FIG. 25 and FIG. 26 are schematic diagrams of structure and operation process of a control mechanism using Control Mode 3 according to a first exemplary embodiment of the present disclosure.
Figure 23:
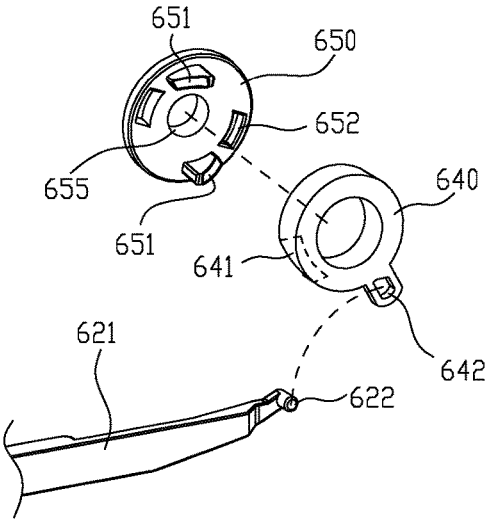
Figure 24:
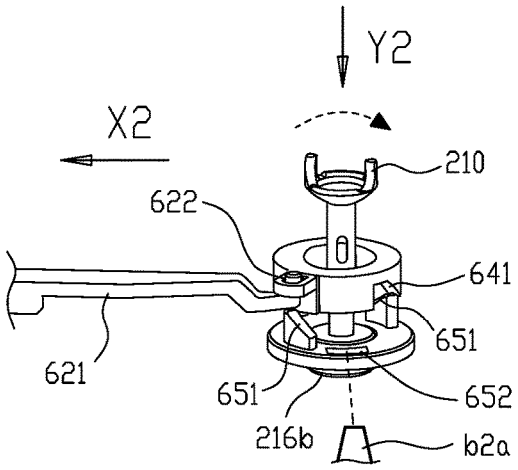
Figure 25:
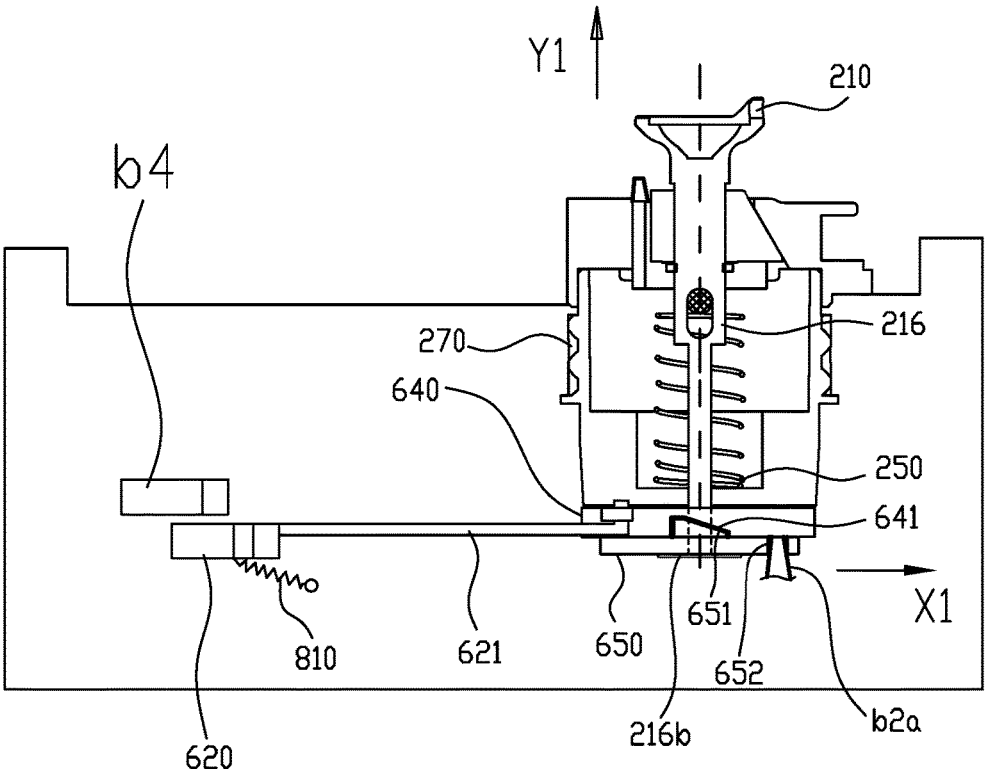
Figure 26:
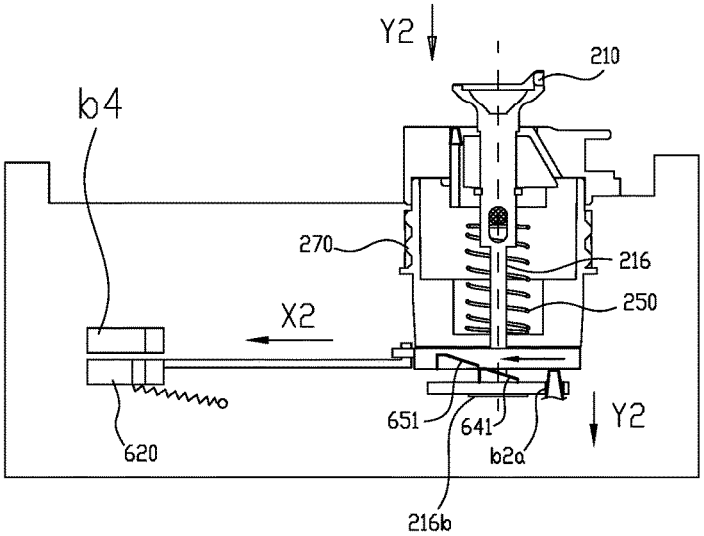

As shown in FIG. 15 to FIG. 17, a control mechanism 600 can be disposed in the side panel b2 of the toner cartridge b, and the control mechanism 600 may include a traction element 610 and a control action part 620. The traction element 610 may be a traction cord. Similar to the cartridge action part b4, the control action part 620 may have a rod-shaped or a hook-shaped structure protruding downward and outward. One end of the traction element 610 can pass through a bottom hole 275*a* of the flange 270 and be connected to the bottom of the driving-force receiving member 210. The other end of the traction element 610 can be connected to the control action part 620. As viewed from a side of the drive assembly 200, when an external force F2 is not exerting on the control action part 620, through the traction element 610, the control action part 620 can be displaced by the driving-force receiving member 210 further than the cartridge action part b4 in a X1 direction. The distance between the front end of the control action part 620 and the front end of the cartridge action part b4 may be L1. When the control action part 620 is pushed by the external force F2 (the direction of F2 may be approximately opposite to the X1 direction). The control action part can be moved by the external force F2 in a X2 direction (opposite to the X1 direction), and through the traction 610, drag the driving-force receiving member 210 to contract inward relative to the flange 270. When the control action part 620 is moved by the external force to be flush with the cartridge action part b4, the pressure receiving element 221 of the pressing element 220 may not protrude out of the outer surface of the end cap 290. Once the external force does not exert on the control action part 620, the elastic force provided by the compressed elastic element 250 can cause the driving-force receiving member 210 to protrude outward, and through the traction element 610, drag the control action part 620 to the position before the external force is applied on the control action part. That is, the distance between the front end of the control action part 620 and the front end of the cartridge action part b4 may be L1. When the external force F2 is not exerting on the control action part 620, the function of the control mechanism 600 can cause the driving-force receiving member 210 to be in an initial position. When the external force F2 is exerting on the control action part 620, the driving-force receiving member 210 may be in a contracting position. A distance L2 from the top of the claws 211 of a driving-force receiving member 210 in the initial position to the surface of the end cap 290 may be greater than a distance L3 from the top of the claw 211 of a driving-force receiving member 210 in the contracting position to the surface of the end cap 290. The control mechanism 600 may also include a revolving flange 611 that can make the traction element 610 to change direction.

Control Mode 2 of Control Mechanism

In addition, an optional configuration of the control mechanism is shown in FIG. 18 to FIG. 21. The control mechanism 600 may include a control action part 620 and a connecting member 630. The control action part 620 and the connecting member 630 may be rotatably connected. The connecting member 630 may have an elongated rod-shaped structure. The front end of the connecting member 630 may have a fork-shaped structure and include an inclined surface 631. The control mechanism 600 may further include a resetting part 810 (a rubber band or a tension spring). One end of the resetting part 810 may be connected to the control action part 620, and the other end of the resetting part 810 may be connected to the side panel b2 or the developing chamber b100. To cooperate with the control mechanism 600, the connecting member 216 of the driving-force receiving member 210 may further include an elongated rod passing through the flange 270. A distal end of the elongate rod may include a disc, and an inclined surface 216*a* may be disposed on the disc. Similar to the control mechanism described above, when the external force F2 is not applied, the control action part 620 and the connecting member 630 can be moved forward in the X1 direction by the elastic traction action of the resetting part 810, and the inclined surface 631 of the connecting member 630 may not abut against the inclined surface 216*a* at the distal end of the driving-force receiving member 210. When the external force F2 is exerting on the control action part 620 to drive the connecting part 630 to move forward in the X2 direction, the inclined surface 631 of the connecting part 630 may abut against the inclined surface 216*a* and press the driving-force receiving member 210 downward. Therefore, the driving-force receiving member 210 can be contracted inward relative to the flange 270. Basically, the same functions and effects of Control Mode 1 of the control mechanism 600 can be achieved by Control Mode 2.

Control Mode 3 of Control Mechanism

In addition, another optional configuration of the control mechanism is shown in FIG. 22 to FIG. 26. The control mechanism 600 may include a control action part 620, a connecting member 621, a positioning ring 640, and a guide sleeve 650. The front end of the connecting member 621 may include a connecting column 622. The outer annular surface of the positioning ring 640 may include a matching hole 642 and the bottom of the positioning ring 640 may include an inclined surface 641. The guide sleeve 650 may include an inclined surface 651, a limiting hole 652 and a through hole 655 may be disposed at the center of the guide sleeve 650. The control mechanism 600 and the driving-force receiving member 210 may be connected in the following manner. The positioning ring 640 can be placed on the guide sleeve 650; the inclined surface 641 may abut against and be matched with the inclined surface 651; an extended elongated rod body of the connecting member 216 can pass through the positioning ring 640 and the through hole 655 of the guide sleeve 650; a protrusion 216*b* disposed at a distal end of elongated rod body can abut against the bottom of the guide sleeve 650; the connecting column 622 at the front end of the connecting member 621 can be rotatably connected to and matched with the matching hole 642 of the positioning ring 640; and the control mechanism may also include a resetting part 810. Referring to Control Mode 1 and 2, when the external force F2 is not exerting on the control action part 620, the control action part 620 and the connecting member 621 can be moved forward in the X1 direction by the elastic traction of the resetting part 810; the inclined panel of the positioning ring 640 may not abut against the inclined surface 651 of the guide sleeve 650; and the positioning ring 640 may be matching attached to the guide sleeve 650. At this time, the driving-force receiving member 210 is in the initial position. When the external force F2 is exerting on the control action part 620, the connecting column 622 at the front end of the connecting member 621 can drag the matching hole 642 to rotate the positioning ring 640. As the positioning ring 640 is rotated, the inclined surface 641 may abut against the inclined surface 651, so that the guide sleeve 650 may be moved downward and separated from the positioning ring 640. Because the limiting hole 652 of the guide sleeve 650 is relatively positioned by the side panel b2 or a protrusion b2*a* of the developing chamber b100, the guide sleeve 650 can be moved only along the axial direction but cannot be rotated relative to the axial direction. While being moved downward, the guide sleeve 650 can push the protrusion 216*b* disposed at the distal end of the driving-force receiving member 210, so that the driving-force receiving member 210 may be contracted inward relative to the flange 270 along the rotation axial of the flange 270. Basically, the same functions and effects of Control Mode 1/Control Mode 2 of the control mechanism 600 can be achieved by Control Mode 3.

Referring to FIG. 14, the cartridge action part b4 and the control mechanism 600 are viewed from one side of the toner cartridge b or in the axial direction of the driving-force receiving member 210. At the bottom of the toner cartridge b, the cartridge action part b4 and the control mechanism 600 may be disposed as one in front of another. Compared to the cartridge action part b4, the control mechanism 600 may be closer to the driving-force receiving member 210, while compared to the control mechanism, the cartridge action part b4 may be closer to the rear end of the developing chamber b100.

Electronic Imaging Device

Figure 27:
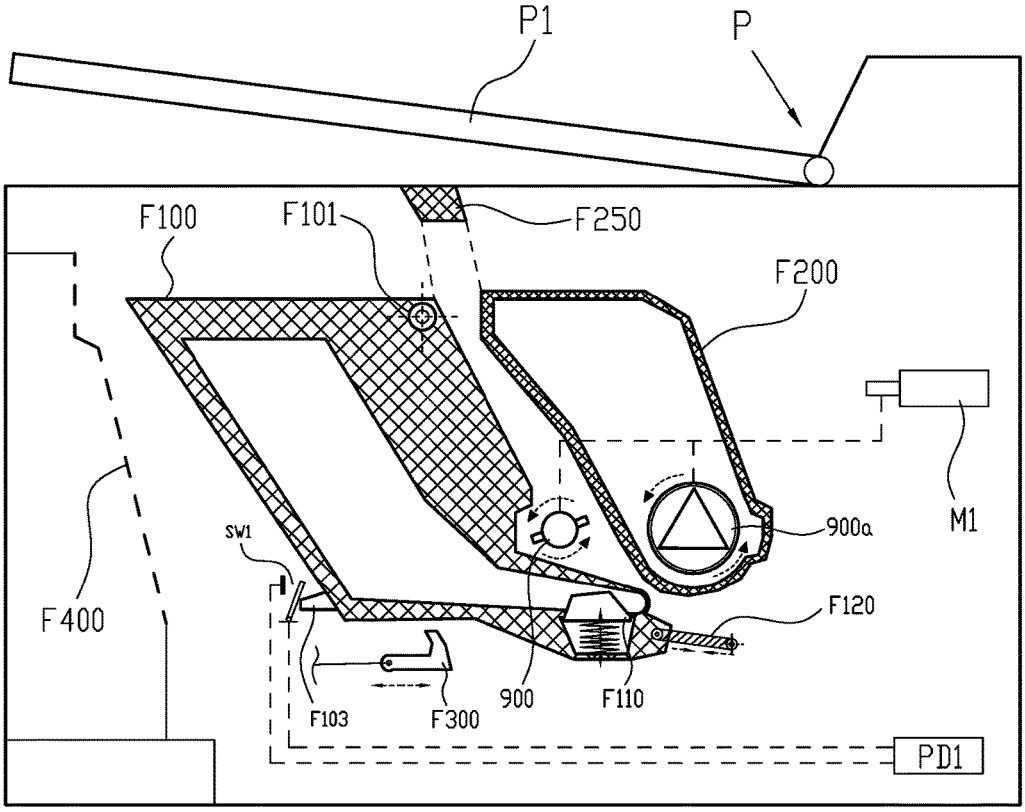
FIG. 27 is a schematic diagram of an internal structure of an electronic imaging device according to a first exemplary embodiment of the present disclosure.

As shown in FIG. 27, an electronic imaging device P may include a cover P1, a driving motor M1, a toner cartridge guide rail F100, a photosensitive assembly guide rail F200, a drive unit 900, a drive unit 900*a*, a pulling part F300, and a traction element F120 (a rubber band or a tension spring). The drive unit 900 and the drive unit 900*a* can be driven to rotate by the driving motor M1. The toner cartridge guide rail F100 can be rotated around a rotation point F101 relative to the photosensitive assembly guide rail F200. One end of the traction element F120 may be connected to the front end of the toner cartridge guide rail F100, and the other end of the traction element F120 may be fixedly connected in the electronic imaging device P. The front end of the toner cartridge guide rail F100 may also include an elastically extendable stopper F110. The pulling part F300, which may be disposed below the cartridge guide rail F100, can be driven to move certain front-and-rear displacement or certain rotation displacement by the driving motor M1 or other driving mechanisms. The pulling part F300 may have a hook-shaped structure.

Figure 28:
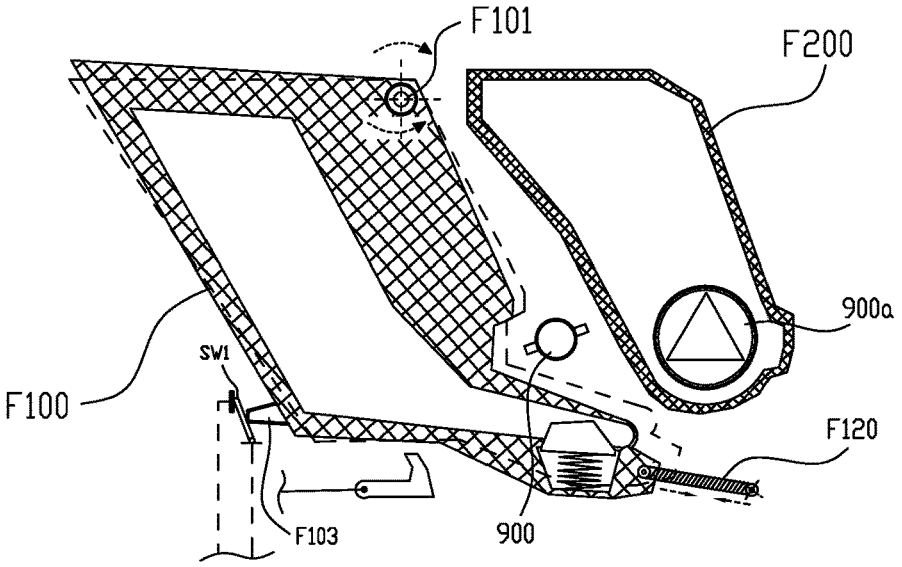
FIG. 28 is a schematic diagram of a displacement operation of a toner cartridge guide rail of an electronic imaging device according to a first exemplary embodiment of the present disclosure.

As shown in FIG. 28, when a force is exerting on the toner cartridge guide rail 100, the toner cartridge guide rail F100 can achieve certain amount of rotation relative to the rotation point F101 and may be in a displacement position. Once the force is removed from the toner cartridge guide rail F100, the toner cartridge guide rail F100 can be dragged by the pulling part F120 to return to the initial position before the rotation.

In addition, the electronic imaging device P may also include a front frame F400 with an inclined surface. When viewed from a side of the electronic imaging device P, the front frame F400 may be disposed at one side of the toner cartridge guide rail F100, and the photosensitive assembly F200 may be disposed at the other side of the toner cartridge guide rail F100.

Inspection Mechanism of the Electronic Imaging Device

As shown in FIG. 27 and FIG. 28, the electronic imaging device P may further include an inspection device PD1 and a trigger switch SW1 for enabling the inspection device PD1 to perform an inspection operation. The toner cartridge guide rail F100 may include a pushing block F103, and optionally, the pushing block F103 can be disposed at a side where the driving assembly of the electronic imaging device P is located (e.g. the side of the guide rail F11 close to the drive unit 900, referring to the structure of the guide rail shown in FIG. 1). When the toner cartridge guide F100 is pushed by a force to rotate in a clockwise direction around the rotation point F101 relative to the photosensitive assembly guide rail F200, the pushing block F103 of the toner cartridge guide rail F100 can be rotated along with the rotation of the toner cartridge guide F100 to touch the trigger switch SW1. So as that the inspection device PD1 may start inspecting and generate a signal that the trigger switch SW1 is turned on. When the toner cartridge guide rail F100 is dragged by the traction element F120 to rotate counterclockwise around the rotation point F101 relative to the photosensitive assembly guide rail F200 and return to the initial position before rotation, the pushing block F103 may no longer touch the trigger switch SW1. So as that the SW1 may be turned off, and the inspection device PD1 may generate a signal that the trigger switch SW1 is turned off.

Thus, through the signal obtained from the inspection device PD1, the electronic imaging device P can determine whether a toner cartridge mounted by a user matches the electronic imaging device P. For example, if the toner cartridge mounted by the user matches the electronic imaging device P, the generated inspection signal can be "ON-OFF" or "ON-OFF-ON-OFF". If the toner cartridge mounted by the user and the electronic imaging device P can complete an inspection process to generate the above inspection signal, the electronic imaging device P can automatically determine that a matching toner cartridge is mounted by the user, and the electronic imaging device P may display that the inspection process is completed so that the user can perform normal developing operation (printing). If the inspection process cannot be completed, for example, only "ON" or "OFF" signal is generated, the electronic imaging device P may display that the inspection process is not completed, and the normal developing operation (printing) cannot be performed.

Pulling Part of the Electronic Imaging Device

When the pulling part F300 of the electronic imaging device P acts on the cartridge action part b4, the pulling part F300 may need to be moved forward to the front of the cartridge action part b4 and moved backward to act on the cartridge action part b4. Therefore, there may be several displacement modes of the pulling piece F300 as following.

Figure 29:
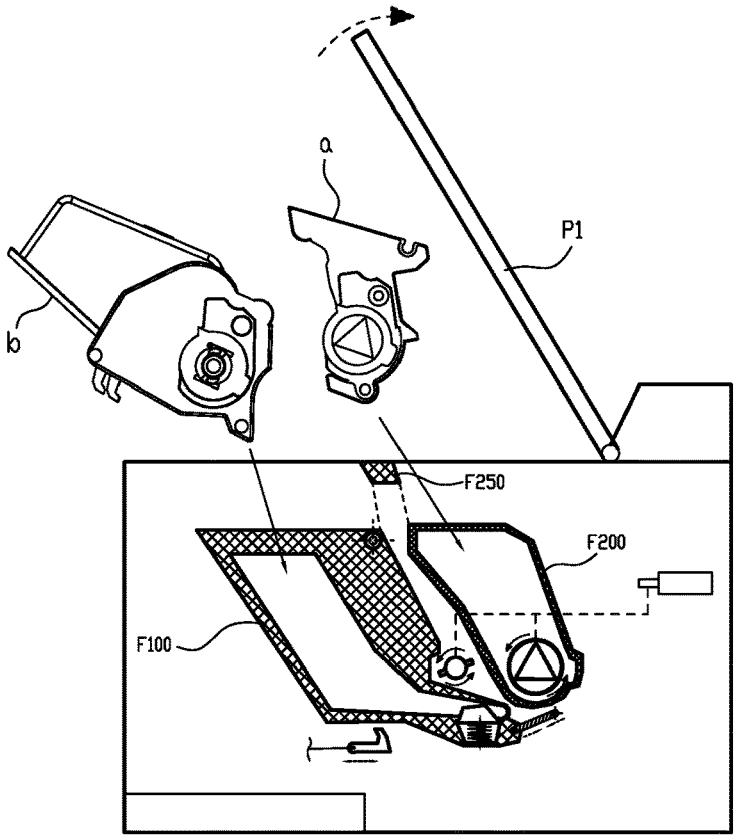
FIG. 29 and FIG. 30 are schematic diagrams of a toner cartridge and a photosensitive assembly that are mounted in an electronic imaging device according to a first exemplary embodiment of the present disclosure.
Figure 30:
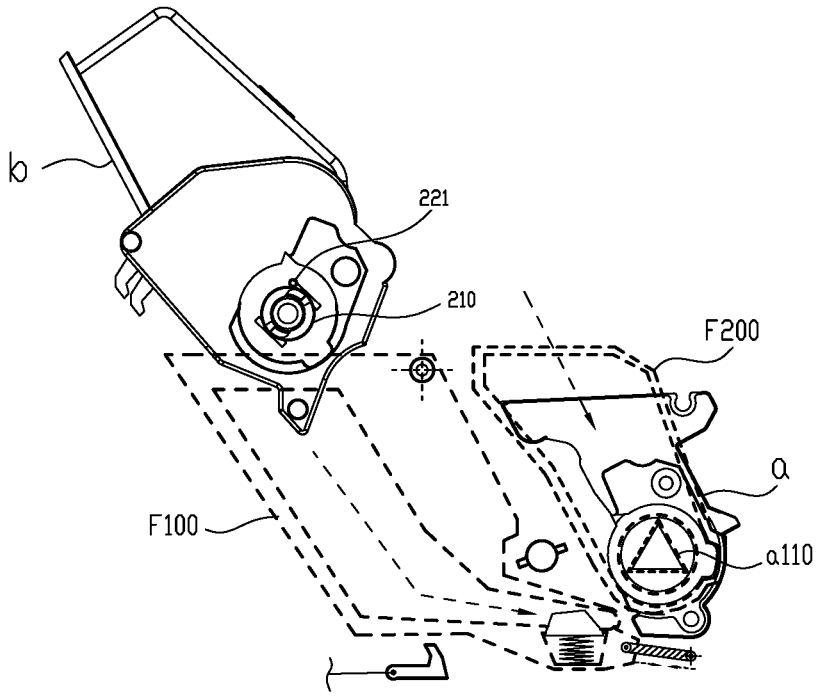
Figure 31:
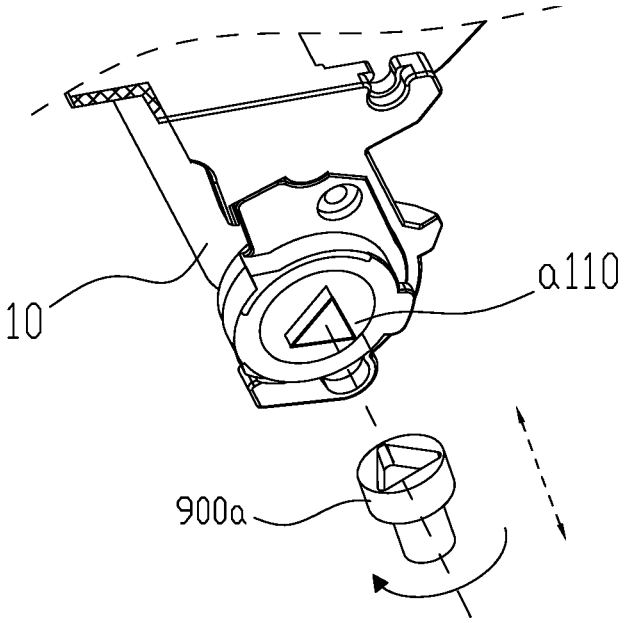
FIG. 31 is a schematic diagram of extending and contracting operations of a drive unit of an electronic imaging device according to a first exemplary embodiment of the present disclosure.

Displacement Mode of the Pulling Part: Mounting of the Toner Cartridge and the Photosensitive Assembly As shown in FIG. 29 to FIG. 31, with the cover P1 opened, the photosensitive assembly a and the toner cartridge b can be mounted in the electronic imaging device P. Referring to FIG. 31, when the cover P1 is open, the drive unit 900*a* may be contracted inward along the rotation axis of the drive unit 900*a*. Therefore, during the mounting processing of the photosensitive assembly a into the electronic imaging device P along the photosensitive assembly guide rail F200, the driving element a110 of the photosensitive assembly a may not structurally interfere with the drive unit 900*a*.

The drive unit 900, which is engaged with the driving-force receiving member 210, can only be rotated along the rotation axis of the electronic imaging device P in the electronic imaging device P, but cannot be contracted and extended axially as the drive unit 900*a*. Therefore, when the toner cartridge b is mounted into the electronic imaging device P, it may be necessary to prevent the driving-force receiving member 210 from structurally interfering with the drive unit 900.

Figure 32:
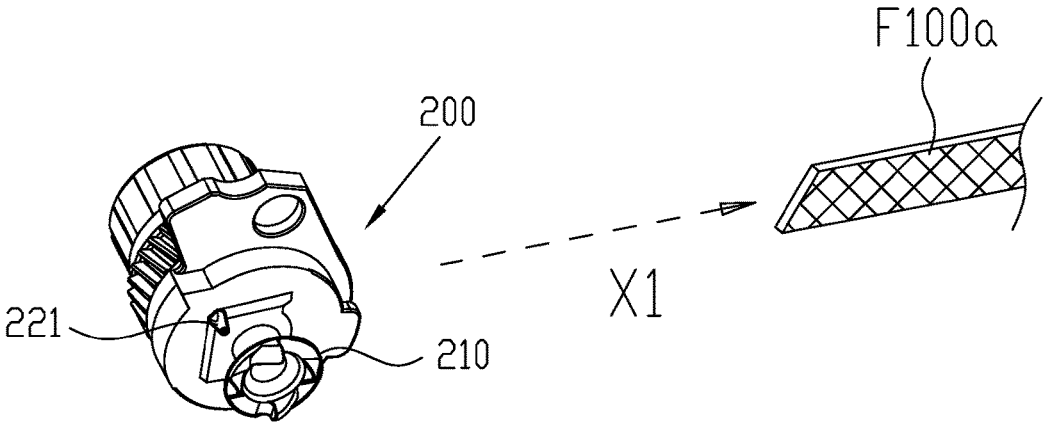
FIG. 32 and FIG. 33 are schematic structural diagrams of front ends of a drive assembly and a toner cartridge guide rail according to a first exemplary embodiment of the present disclosure.
Figure 33:
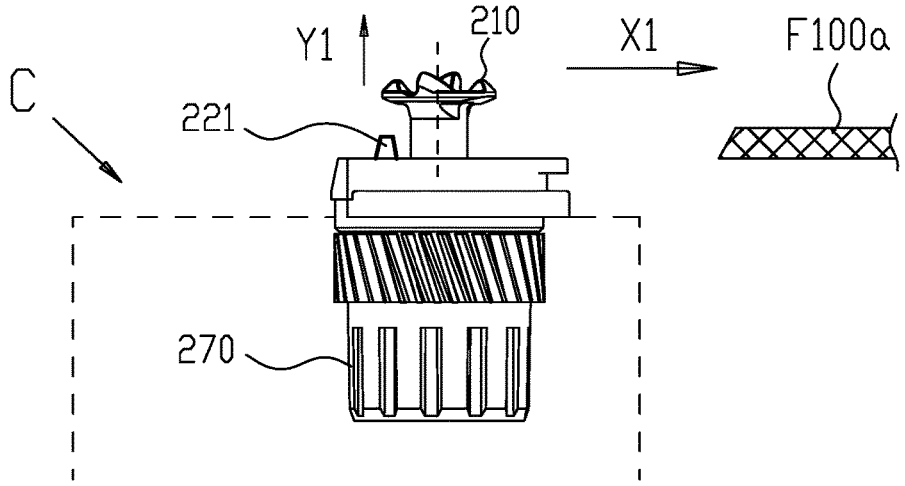
Figure 34:
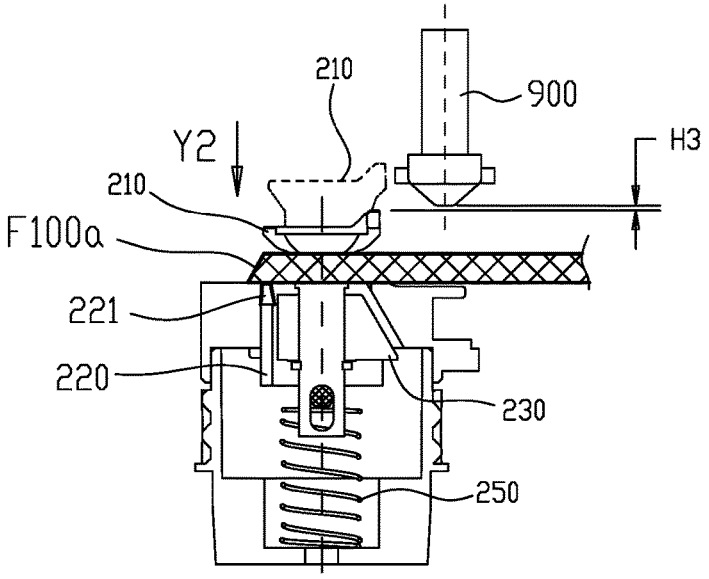
FIG. 34 is a schematic diagram of a driving-force receiving member being pressed to contract inward according to a first exemplary embodiment of the present disclosure.
Figure 35:
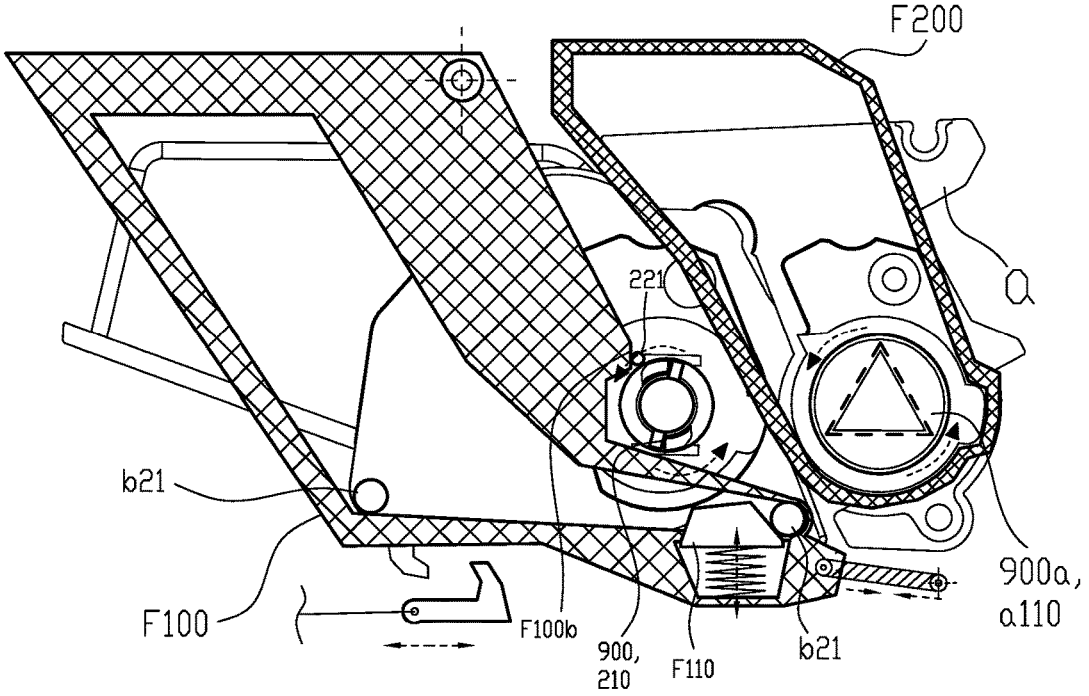
FIG. 35 is a schematic diagram of a toner cartridge and a photosensitive assembly in an electronic imaging device according to a first exemplary embodiment of the present disclosure.
Figure 36:
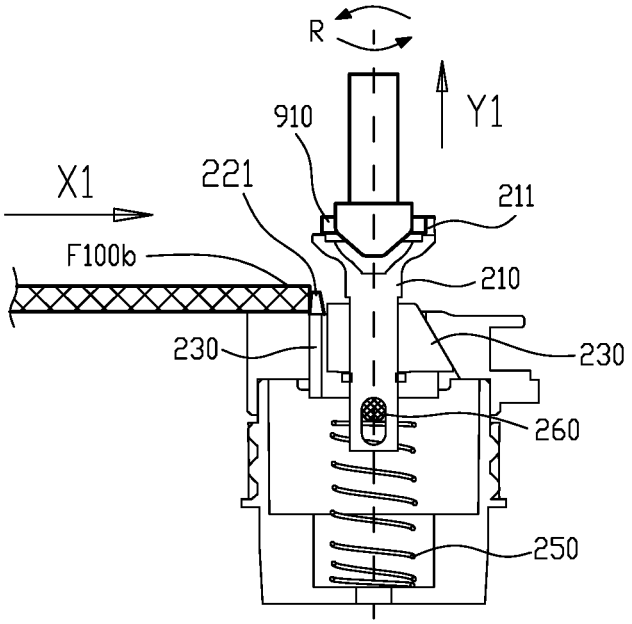
FIG. 36 is a schematic diagram of a driving-force receiving member being in contact and engaged with a drive unit according to a first exemplary embodiment of the present disclosure.

As shown in FIG. 32 to FIG. 34, the toner cartridge b can be mounted into the electronic imaging device P along the toner cartridge guide rail F100 in the mounting direction, i.e., the X1 direction. During the mounting process of the toner cartridge, the pressing element member 221 of the drive assembly 200 may abut against and press the front end of the toner cartridge guide rail F100, so that the whole pressing element 220 can be moved downward relative to the end cap 290. The pressing element 220 moving downward can push the slider 230 to move downward, and the slider 230 moving downward can push the driving-force receiving member 210 to contract inward relative to the flange 270. Therefore, when the driving-force receiving member 210 is in the contraction position, during the mounting process of the toner cartridge b, the driving-force receiving member 210 may not structurally interfere with the drive unit 900, and there may be a gap H3 between the top of the driving-force receiving member 210 and the bottom of the drive unit 900. When the toner cartridge b is correctly mounted into the electronic imaging device P along the toner cartridge guide rail F100, the driving-force receiving member 210 may be approximately coaxial with the drive unit 900. As the toner cartridge b is mounted, the pressure receiving element 221 may be moved to the rear end F100*b* of the toner cartridge guide rail F100 and no longer under pressure. As shown in FIG. 35 and FIG. 36, the connecting part 260 may be pushed by the elastic force released from the elastic element 250, and the driving-force receiving member 210 may be pushed by the connecting part 260 to protrude outward to engage with the drive unit 900. As the driving-force receiving member 210 protrudes outward, the slider 230 and pressing element 220 that are engaged with the driving-force receiving member 210 may also be slid outward to the position before the slider 230 and the pressing element 220 are pressed.

When the cove P1 is closed after the toner cartridge b and the photosensitive assembly a are correctly mounted into the electronic imaging device P, the drive unit 900*a* may protrude out along the rotation axis of the drive unit 900*a* and may be in contact and engaged with the driving element a110 of the photosensitive assembly a. Simultaneously, the driving motor M1 can drive the drive unit 900 and the drive unit 900*a* to rotate. The driving-force receiving member 210 can receive the rotation driving force from the drive unit 900 and transmit the rotation driving force to the flange 270. The flange 270 can transmit the driving force to the gear 35 for driving the operation of developing unit 30. The drive unit 900*a* may drive the driving element a110 to rotate for driving the photosensitive unit 10 to operate.

In addition, after the toner cartridge b and the photosensitive assembly a are mounted in the electronic imaging device P, the toner cartridge b and the photosensitive assembly a can be supported and positioned by the toner cartridge guide rail F100 and the photosensitive assembly guide rail F200, respectively. In the mounting process of the toner cartridge b, a locating column b21 disposed at the front end of the side panel b2 first may abut against the stopper F110 and press down on the stopper F110, so that the mounting process of the toner cartridge b along the toner cartridge guide rail F100 can be continued. After the toner cartridge b is correctly mounted, the locating column b21 may be moved to the front end of the toner cartridge guide rail F100 and no longer press the stopper F110. The stopper F110 may be moved upward by the elastic force and retuned to a position where the stopper F110 is not pressed, as shown in FIG. 35. Thus, the stopper may have certain elastic force to prevent the backward movement of the locating column b21, so that the entire toner cartridge b can be positioned on the toner cartridge guide rail F100 to prevent the developing quality being affected by the shaking of the toner cartridge b during the developing operation.

Displacement Mode of the Pulling Part: Separation Process of the Photosensitive Unit 10 and the Developing Unit 30

Figure 37:
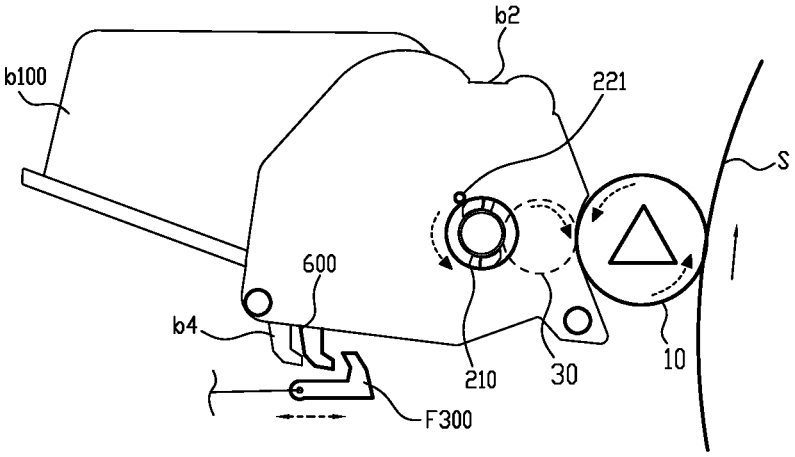
FIG. 37 is a schematic diagram of a toner cartridge cooperated with a photosensitive assembly during the developing operation process according to a first exemplary embodiment of the present disclosure.

As viewed from a side of the toner cartridge b or from axial direction of the driving-force receiving member 210, FIG. 37 schematically shows the photosensitive unit 10 is rotated and engaged with the developing unit 30 to perform developing operation, i.e., the toner being transmitted from the developing chamber b100 and printed on a paper S through the photosensitive unit 10 and the developing unit 30. In the electronic imaging device P, the driving motor M1 may simultaneously drive both of the drive unit 900 and driving nit 900*a* to rotate. Thus, when the developing operation is not running or the self-inspection of the electronic imaging device P is executing, the photosensitive unit 10 may need to be separated from the developing unit 30 by a certain distance, preventing the toner from being transmitted to the photosensitive unit 10 when the developing operation is not performed, therefor, the toner can be prevented from being wasted.

Figure 38:
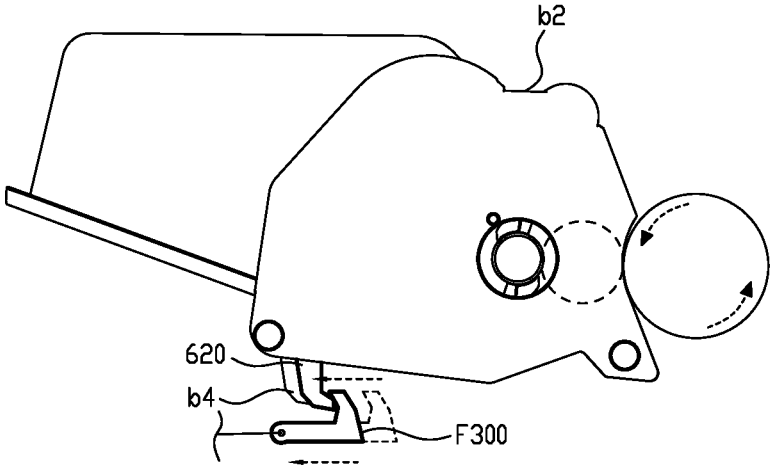
FIG. 38 and FIG. 39 are schematic diagrams of a pulling part dragging a control action part to cause a driving-force receiving member to contract inward according to a first exemplary embodiment of the present disclosure.
Figure 39:
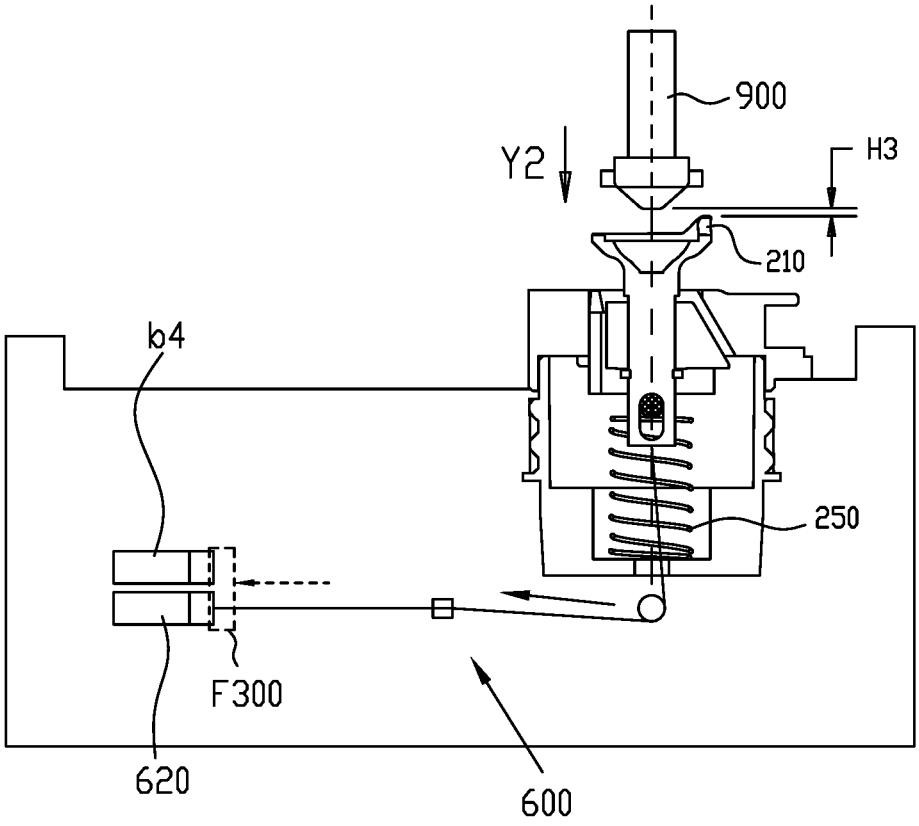

During the developing operation, the locations of the drive unit 900 and the drive unit 900*a* of the electronic imaging device P may be relatively fixed (i.e., a planar movement cannot be performed). Therefore, to separate the photosensitive unit 10 from the developing unit 30, it may be necessary to at least separate drive unit 900 from the driving-force receiving member 210 that is engaged with the drive unit 900. As shown in FIG. 38 and FIG. 39, when the electronic imaging device P is not executing the developing operation or the self-inspection operation, the pulling part F300 that is disposed below the toner cartridge guide rail F100 can be triggered to be moved. At the bottom of the toner cartridge b, the cartridge action part b4 may be disposed in front of the control mechanism 600. Therefore, when the pulling part F300 is moved backward (i.e., moved toward the rear end of the developing chamber b100 of the toner cartridge b), the pulling part F300 with a hook-shaped structure may act on the control mechanism 600. The pulling part F300 may drag control action part 620 of the control mechanism 600, so that the driving-force receiving member 210 may be contracted inward relative to the flange 270 to be separated from the drive unit 900. (The process of the driving-force receiving member 210 being controlled by the control mechanism 600 to contract, can refer to the structure and process of the Control Mode 1/Control Mode 2/Control Mode 3 of the control mechanism 600, and is not elaborated herein.)

Figure 40A:
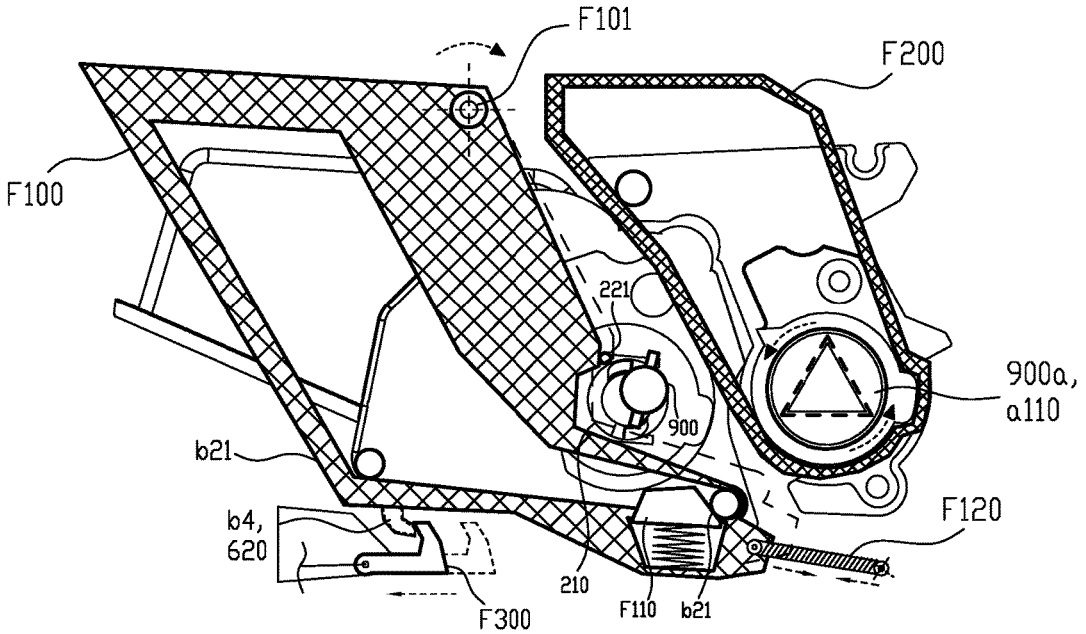
FIG. 40*a* and FIG. 40*b* are schematic diagrams of a pulling part dragging a powder acting member to make a toner cartridge move according to a first exemplary embodiment of the present disclosure.
Figure 40B:
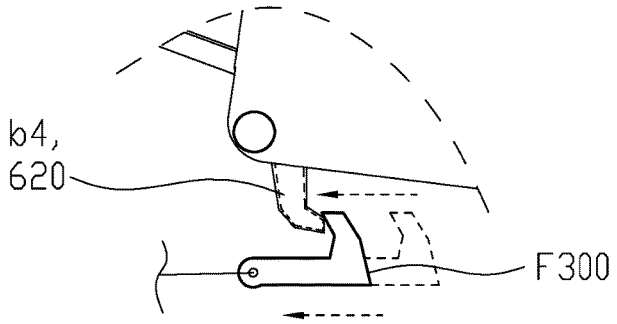

As described above, only the separation of driving-force receiving member 210 of the drive unit 900 is achieved, but the separation of photosensitive unit 10 and the developing unit 30 is not completed. Therefore, the pulling part F300 which is dragging (hooked on) the control action part 620 may still need to be further moved backward to act on the cartridge action part b4. As shown in FIG. 40*a* and FIG. 40*b*, when the pulling part F300 is acting on the cartridge action part b4, the pulling part F300 can also simultaneously drag (hook on) the cartridge action part b4 and the control mechanism 600. The toner cartridge b is relatively positioned on the toner cartridge guide rail F100. For example, as the pulling part F300 continuously moves, the pulling part F300 drags the cartridge action part b4 to move the toner cartridge b because the toner cartridge b has been relatively positioned on the toner cartridge guide rail F100. Therefore, when the toner cartridge b is dragged, the toner cartridge b can be rotated along with the toner cartridge guide rail F100 around the rotation point F101 of the toner cartridge guide rail F100. In this case, the driving-force receiving member 210 and the drive unit 900 can be separated. Therefore, during the rotation process of the toner cartridge b and the toner cartridge guide rail F100, the driving-force receiving member 210 may not structurally interfere with the relatively fixed drive unit 900. The locating column b21 of the toner cartridge b can also be stopped by the elastic stopper F110, so that the entire toner cartridge b can be positioned on the toner cartridge guide rail F100. Therefore, during the rotation process of the toner cartridge b and the toner cartridge guide rail F100, the toner cartridge b is not easily to be shaken due to being detached from the toner cartridge guide rail F100 under an action of a pulling force.

Figure 41:
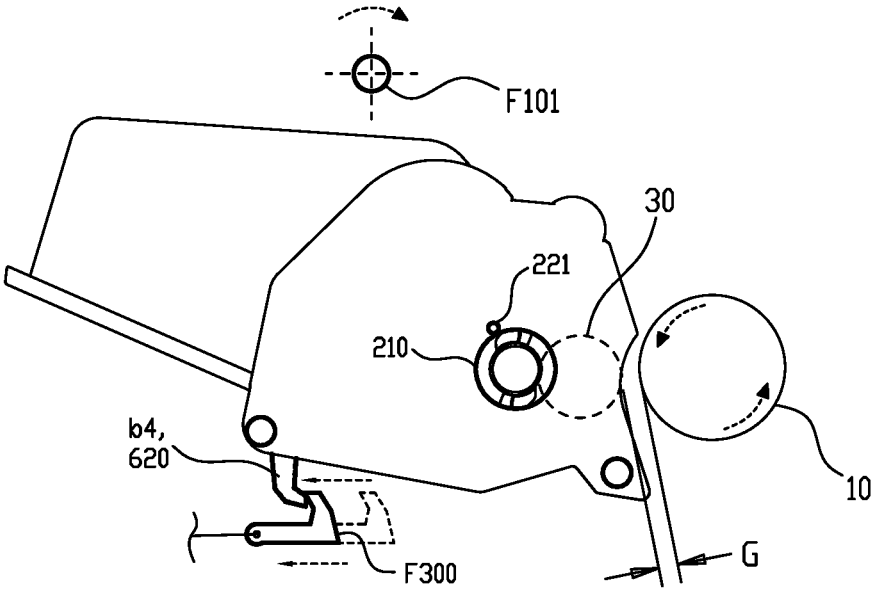
FIG. 41 is a schematic diagram of a photosensitive unit separating from a developing unit according to a first exemplary embodiment of the present disclosure.

FIG. 41 schematically shows the photosensitive unit 10 being separated from the developing unit 30 with a gap G between each other, after the cartridge action part b4 and the control mechanism 600 are dragged by the pulling part F300. After the developing operation or the system self-inspection of the electronic imaging device P is completed, the driving motor M1 may continue to drive the drive unit 900 and the drive unit 900*a* to rotate for a certain time, and the drive unit 900*a* may continue to drive the driving element a110 to rotate, while the drive unit 900 may be disengaged with the driving-force receiving member 210. Therefore, the driving-force receiving member 210 may not drive the developing unit to operate, so that when the developing operation is not performed, the toner can be prevented from wasting. Further, the separation of the photosensitive unit 10 from the developing unit 30 can prevent the contact abrasion that occurs when the developing operation is not performed.

In addition, driven by the pulling part F300, the toner cartridge b can be rotated, so that the toner cartridge guide rail F100 can be rotated clockwise relative to the photosensitive assembly guide rail F200, and the signal that the trigger switch SW1 is turned on can be generated.

Displacement Mode of the Pulling Part: Contacting Process of the Photosensitive Unit 10 and the Developing Unit 30

Figure 42:
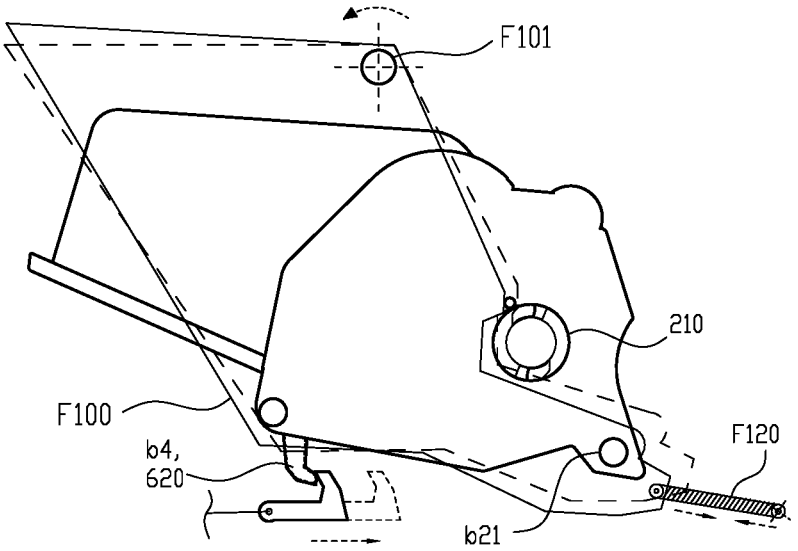

When the cartridge action part b4 and the control mechanism 600 are not dragged by the pulling part F300 to return to the position before the displacement, the pulling part F300 may need to be moved in the opposite direction to return to the position before displacement. That is, the pulling part F300 may need to be moved away from the rear end of the developing chamber b100, and at this time, and the pulling part F300 may not act on the cartridge action part b4. As shown in FIG. 42, the traction element F120 at the front end of the toner cartridge guide rail F100 may generate a traction force to drag the toner cartridge guide rail F100 to move toward the photosensitive assembly guide rail F200 and return to the initial position before rotation. The toner cartridge b that is supported and positioned by the toner cartridge guide rail F100 may also be moved toward the photosensitive assembly a that is supported and positioned by the photosensitive assembly guide rail F200, and the photosensitive unit 10 may be reconnected to the developing unit 30. When the pulling part F300 is further moved in the opposite direction till the pulling part F300 does not act on the control mechanism action part 620 of the control mechanism 600, the elastic force released by the elastic element 250 of the flange 270 can cause the driving-force receiving member 210 to protrude outward and engage with the drive unit 900 again. When the above operation procedures are completed, each part may return to the position before the pulling part F300 is triggered to act, and the developing operation in the electronic imaging device P can be resumed.

During the process that the photosensitive unit 10 is connected to and separated from the developing unit 30, as shown in FIG. 40*a*, the toner cartridge guide rail F100 and the toner cartridge b may be rotated together as a whole. Therefore, when the pulling part F300 is acting on the toner cartridge b, the toner cartridge b may not move relative to the toner cartridge guide rail F100, and the pressure receiving element 221 may not be abutted against and pressed downward by the rear end F100*b* of the toner cartridge guide rail F100. During the process that the photosensitive unit 10 is connected to and separated from the developing unit 30, the axial contraction of the driving-force receiving member 210 may be controlled by the control mechanism 600 under the action of the pulling part F300. The contraction movement of the driving-force receiving member 210 may not be affected due to the pressure receiving element 221 being abutted against and pressed by the rear end F100*b* of the toner cartridge guide rail F100. Therefore, it may not be affected that the driving-force receiving member 210 engaging with and disengaging from the drive unit 900.

In addition, by retracting the action of the pulling part F300, the toner cartridge guide rail F100 may be rotated counterclockwise relative to the photosensitive assembly guide rail F200 by the traction element F120, and the signal that the trigger switch is turned off may be generated.

Figure 43:
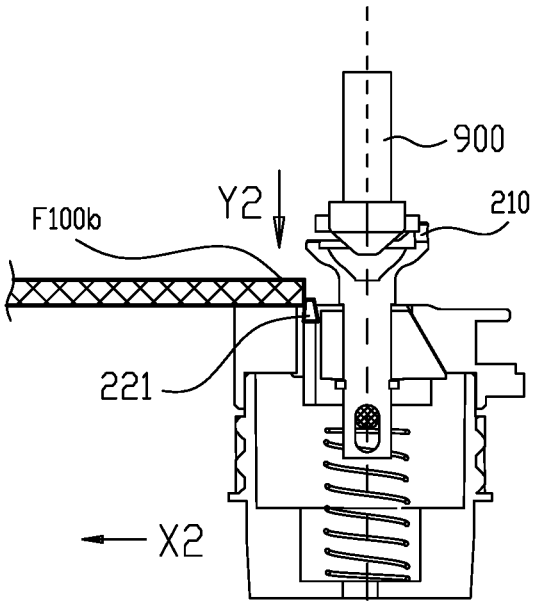
FIG. 43 and FIG. 44 are schematic diagrams of a driving-force receiving member contracting inward because of a rear end of the toner cartridge guide rail according to a first exemplary embodiment of the present disclosure.

Displacement Mode of the Pulling Part: Unmounting/Removal of the Toner Cartridge and the Photosensitive Assembly As shown in FIG. 43, the process of removing the toner cartridge b from the electronic imaging device P can refer to the process of mounting the toner cartridge b into the electronic imaging device P, and can be an opposite operation of mounting the toner cartridge b into the electronic imaging device P. The toner cartridge b can be removed from the electronic imaging device P along the toner cartridge guide rail F100 in the X2 direction that is opposite to mounting direction. The pressure receiving element 221 of the drive assembly 200 may abut against the rear end F100*b* of the toner cartridge guide rail F100, as the toner cartridge b is moved along the unmounting direction. The rear end F100*b* may press the pressure receiving element 221 to move downward in the Y2 direction and drive the driving-force receiving member 210 to contract inward, so that the driving-force receiving member 210 can be disengaged with the drive unit 900. Therefore, when the toner cartridge b is removed from the electronic imaging device P, a structural interference due to the driving-force receiving member 210 tightly engaged with the drive unit 900 may not occur, so that it is not difficult to unmount the toner cartridge b. When the toner cartridge b is completely removed from the electronic imaging device P, the front end F100*a* of the toner cartridge guide rail F100 may not press the pressure receiving element 221 of the drive assembly 200. Therefore, because of the elastic force of the elastic element 250, the pressure receiving element 221 and the driving-force receiving member 210 can protrude outward and return to the initial position before being pressed.

Figure 44:
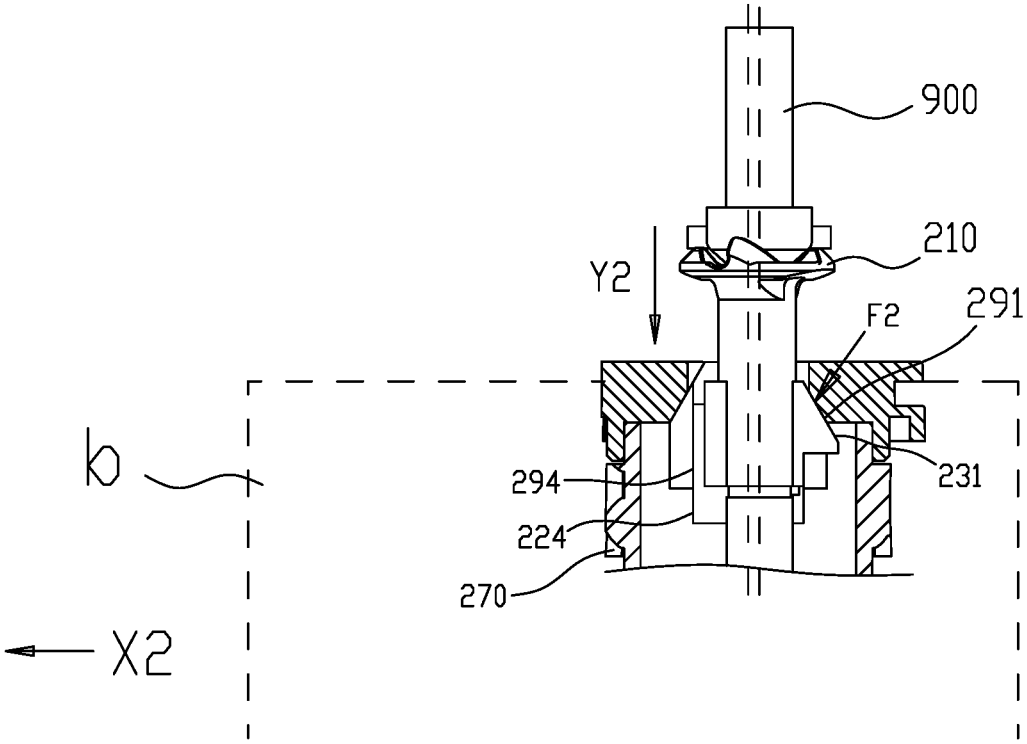

In addition, to make the removal of the toner cartridge b from the electronic imaging device P more smoothly and effortlessly, the driving-force receiving member 210 can be contracted inward because of the rear end of the toner cartridge guide rail according to Exemplary Embodiment I of the present disclosure. For example, as shown in FIG. 44, when the toner cartridge b is removed from the electronic imaging device P along the X2 direction (the unmounting direction) after the developing operation is completed, the drive unit 900 may still be tightly engaged with the driving-force receiving member 210. Therefore, the driving-force receiving member 210 may be difficult to be moved along the unmounting direction, while the flange 270 and the end cap 290 can be moved relative to the driving-force receiving member 210. When the driving-force receiving member 210 is relatively fixed in the unmounting direction due to the tight engagement, because of the movement of the driving-force receiving member 210 along the unmounting direction, the inclined sliding surface 291 of the driving-force receiving member 210 can generate the compression force F2 and press on the inclined sliding surface 231 of the slider 230 to drive the slider 230 to contract inward. The driving-force receiving member 210 that is fixed relative to the slider 230 can also be moved downward as the slider 230 is contracted. In addition, during the contraction of the slider 230, the pressing element 220 may also be pressed by the slider 230 to contract inward. Because of the sliding surface 294 of the end cap 290, the sliding surface 224 of the pressing element 220 can be slid inward and kept vertical. Through the cooperation of the pressing element 220 and the slider 230, the slider 230 and the driving-force receiving member 210 can be fixed and cooperate to keep the driving-force receiving member 210 vertical when the driving-force receiving member 210 is contracted inward. While moved, the rotation axis of driving-force receiving member 210 may be approximately coaxial or parallel to the rotation axis of the flange 270. Thus, through the inclined sliding surface 291 of the end cap 290 compressing on the inclined sliding surface 231 of the slider 230, the driving-force receiving member 210 can contract inward relative to the end cap 290 and disengage with the drive unit 900

When the toner cartridge b is removed from the electronic imaging device P, the pressing element 221 of drive assembly 220 may be pressed by the rear end F100*b* of the toner cartridge guide rail F100 so that the driving-force receiving member 210 can be contracted inward axially. The inclined sliding surface 291 of the end cap 290 may press on the inclined sliding surface 231 of slider 230, so that the driving-force receiving member 210 can be contracted inward axially. Because of the above two contraction movement, it may be easier for the driving-force receiving member 210 to achieve axially disengagement after the driving-force receiving member 210 is tightly engaged with the drive unit 900, which can prevent the structurally interference when the driving-force receiving member 210 is disengaged from the drive unit 900.

Similarly, when the cover P1 is reopen, the drive unit 900 may be contracted inward along the rotation axial direction thereof to be disengaged from the drive unit 900*a* of the photosensitive unit a, so that the photosensitive assembly a can be easily removed from the photosensitive assembly guide rail F200.

The cartridge action part b4 of the toner cartridge b and the control mechanism 600 may be disposed as one in front of another, therefore, during the photosensitive unit 10 being separated from the developing unit 30, the pulling part F300 may first act on the control mechanism 600, so that the driving-force receiving member 210 can be contracted inward and separated from the drive unit 900. Then the pulling part F300 may act on the cartridge action part b4, so that the toner cartridge b can be rotationally separated from the photosensitive assembly a. There may be a certain timing difference between the pulling part F300 acting on the control mechanism and the pulling part F300 acting on the cartridge action part b4. When the pulling part F300 stops acting and returns to the initial position, the pulling part F300 may first stop acting on the cartridge action part b4 and then stop acting on the control mechanism 600.

Exemplary Embodiment II

Figure 45:
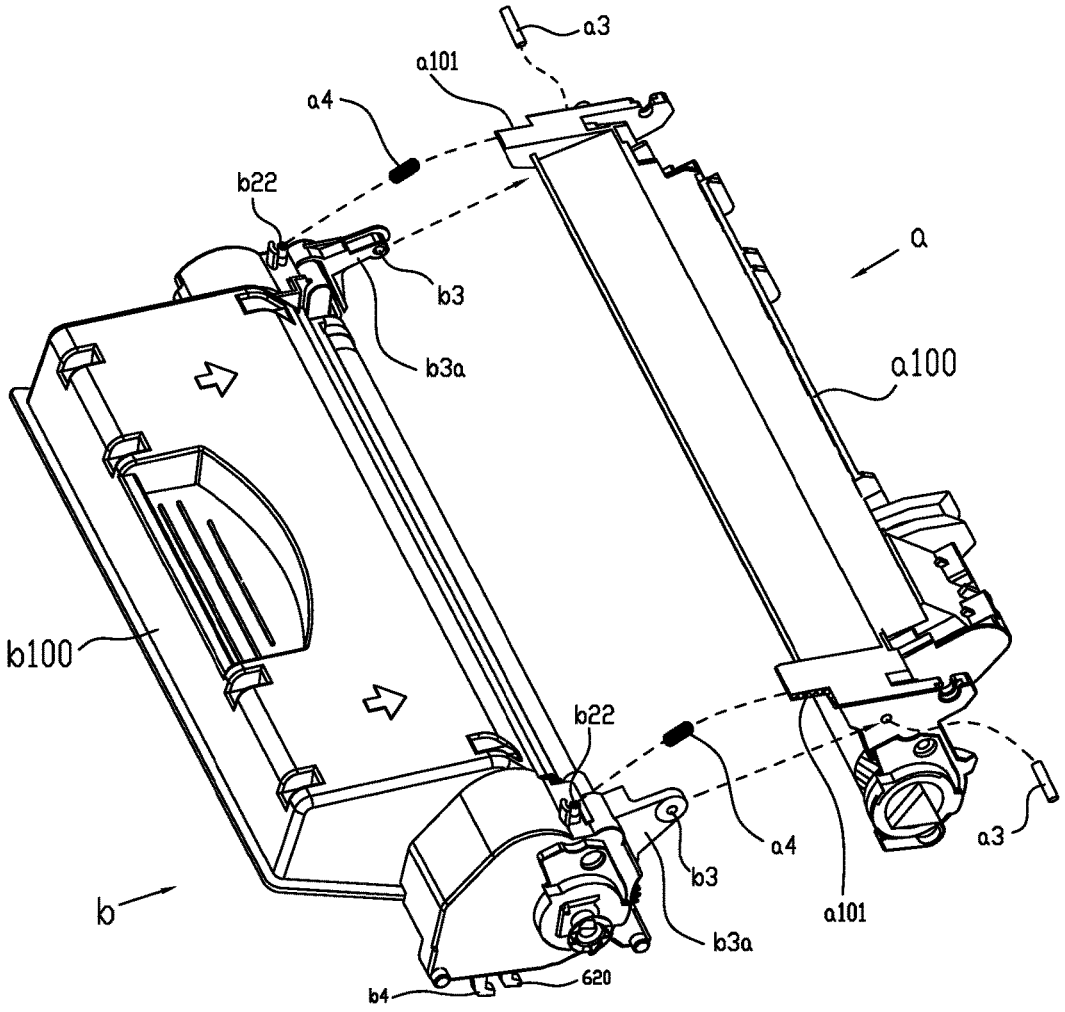
FIG. 45 is a schematic structural diagram of a toner cartridge and a photosensitive assembly according to a second exemplary embodiment of the present disclosure.

The toner cartridge b and the photosensitive assembly a described in exemplary Embodiment I are mutually independent, whereas, the toner cartridge b can also be connected to the photosensitive assembly a. As shown in FIG. 45, a connecting arm b3*a* with a hole b3 may be disposed on each of the side panel b1 and b2 of two sides of the toner cartridge b. The connecting arm b3*a* may include a locating column b22. The connecting arm b3*a* on the side panels b1 and b2 can extend into the two side ends of photosensitive chamber a100 of the photosensitive assembly a. The top end of the elastic element a4 may abut against the inner wall of photosensitive chamber a100 and the bottom end of the elastic element a4 may be inserted on the locating column b22. Through a pair of the connecting part a3 passing through positioning holes at two sides of the photosensitive chamber a100 and the hole b3 of the developing chamber b100, the toner cartridge b can be connected to the photosensitive assembly a. In addition, because of the elastic force of the elastic element a4, the toner cartridge b can achieve a certain amount of swinging relative to the photosensitive assembly a.

Figure 46:
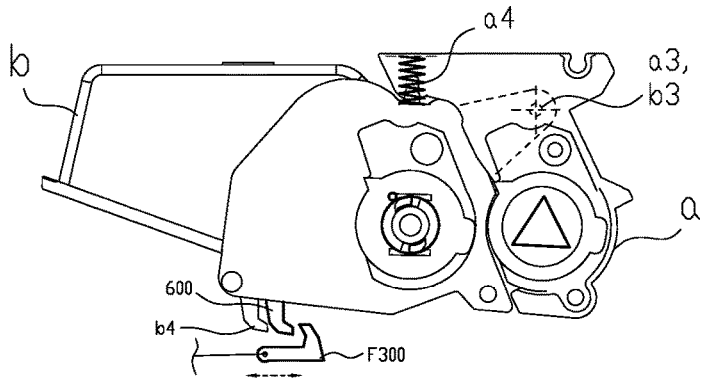
FIG. 46 and FIG. 47 are schematic diagrams of a toner cartridge separating from a photosensitive assembly according to a second exemplary embodiment of the present disclosure.
Figure 47:
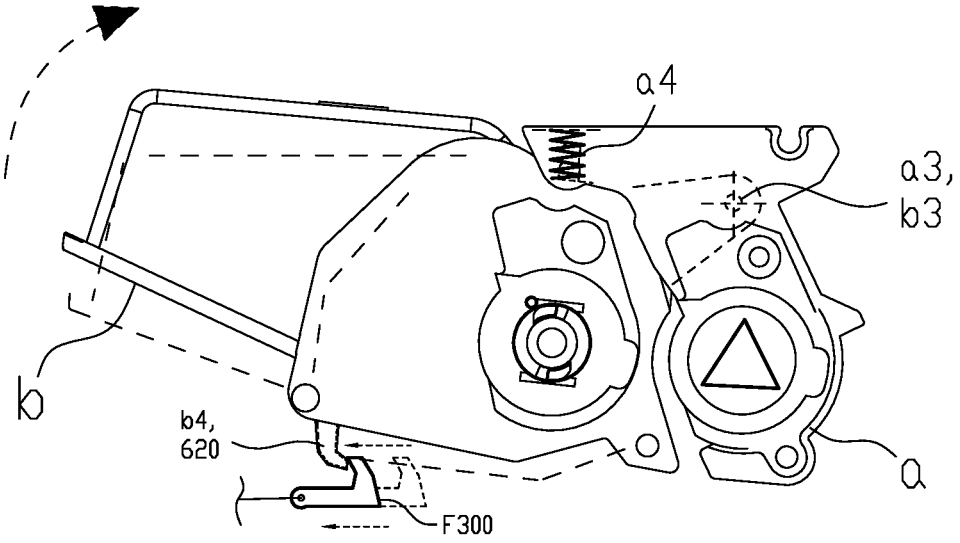

As shown in FIG. 46 and FIG. 47, the process of the photosensitive unit 10 being separated from and in contact with the developing unit 30 is similar to that described in Exemplary Embodiment I. When the toner cartridge b and the photosensitive assembly a are mounted into the electronic imaging device P, under the action of the pulling part F300 on the control mechanism 600 and the cartridge action part p4, the toner cartridge b can be rotated around the rotation point (the position of hole b3/connecting part a3*b*22) relative to the photosensitive assembly, so that the photosensitive unit 10 can be separated from the developing unit 30. When the pulling part F300 stops acting on the control mechanism 600 and the cartridge action part b4, the toner cartridge b can be rotated by the elastic force released from the elastic element a4, and the photosensitive unit 10 can be in contact with the developing unit 30 again.

Therefore, the connecting structure of the toner cartridge b and the photosensitive assembly a according to Exemplary Embodiment II can be used as an alternative to the structure of the rotatable toner cartridge guide rail F100 of the electronic imaging device P described in Exemplary Embodiment I. The structure of some parts not shown according to Exemplary Embodiment II can refer to structure of the parts according to Exemplary Embodiment I and is not elaborated here.

Exemplary Embodiment III

Due to a matching mechanism (the pressing element 220 and the slider 230) of the drive assembly 200 according to the Exemplary Embodiment I/Exemplary Embodiment II, the driving-force receiving member 210 can be extended and contracted along the rotation axis thereof relative to the flange 270 or the end cap 290 to be engaged with and disengaged from the drive unit 900. The matching mechanism can also be substituted by the following structure of the driving-force receiving member 210 to achieve a similar function and application.

Figure 48:
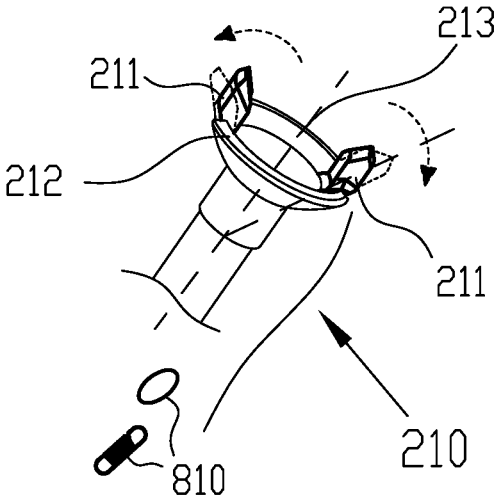
FIG. 48 is a schematic structural diagram of a driving-force receiving member according to a third exemplary embodiment of the present disclosure.

As shown in FIG. 48, the claw 211 disposed at the upper end of the driving-force receiving member 210 can be tilted or swung relative to the driving-force receiving member 210, i.e., the center line of the claw 211 may be tilted to a certain angle relative to the rotation axis of the driving-force receiving member 210. In some embodiments, the tilted angle can be between 5° and 65°. The outer surface of the claw 211 may include a smooth curved transition. The claw 211 may also include an elastic member 810 (a rubber band or a tension spring). One end of the elastic element 810 may be connected to the claw 211, and the other end may be connected to the driving-force receiving member 210. When the claw 211 is not pressed by an external force, the claw 211 can be kept vertical. The claw 211 can be pressed downward by the external force to tilt. Around the pair of the claw 211 at the upper end of the driving-force receiving member 210, an outward inclined surface 212 may be disposed outward, and an inward inclined surface 213 may be disposed inward. The outward inclined surface 212 and the inward inclined surface 213 can be constructed by a certain curved surface and an arc surface.

Figure 49:
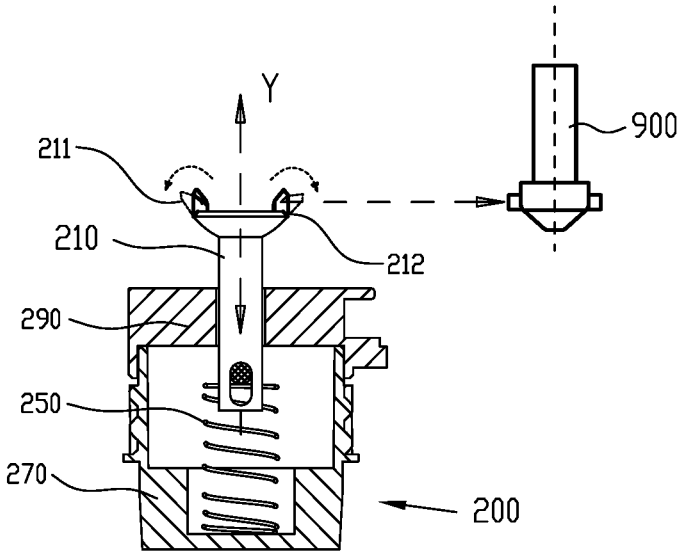
FIG. 49 is a schematic diagram of a driving-force receiving member being in contact and engaged with a drive unit according to a third exemplary embodiment of the present disclosure.
Figure 50:
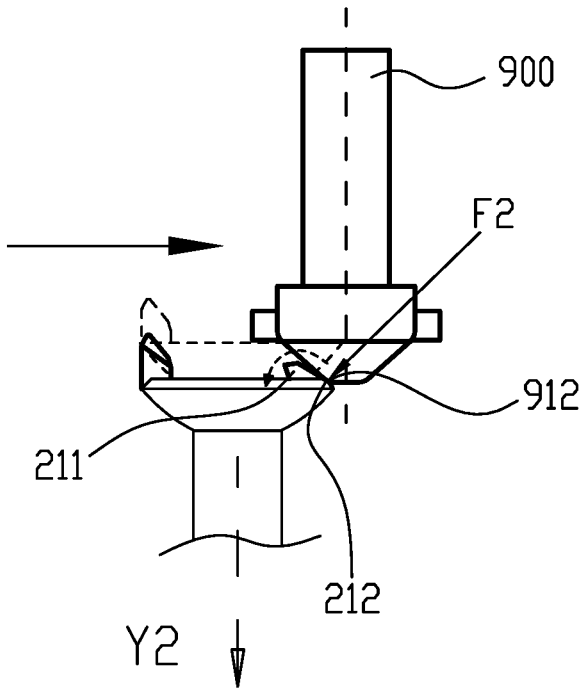
FIG. 50 is a schematic diagram of a claw of a driving-force receiving member being pressed to swing according to a third exemplary embodiment of the present disclosure.
Figure 51:
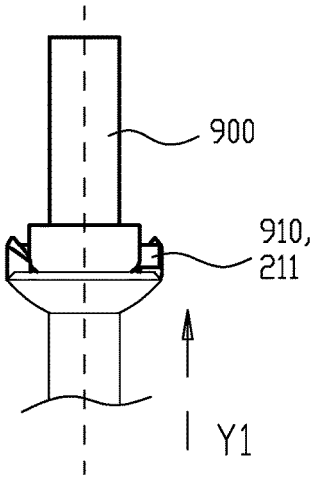
FIG. 51 is a schematic diagram of a driving-force receiving member being engaged with a drive unit to receive driving force according to a third exemplary embodiment of the present disclosure.

FIG. 49 and FIG. 50 schematically show a contacting engagement of the drive assembly 200 of the toner cartridge b with the drive unit 900. Because of configuration of the outward inclined surface 212, when the driving receiving member 210 abut against the drive unit 900, the semicircular structure of a bottom 912 of the drive unit 900 can directly press on the swingable claw 211 or the outward inclined surface 212, and the claw 211 can incline inward and/or generate a downward compression force F2 to drive the driving-force receiving member 210 to contract inward along the Y2 direction, avoiding rigid structural interference with the drive unit 900. When the drive assembly 200 is continuously moved till the driving-force receiving member 210 is coaxial with the drive unit 900, as shown in FIG. 51, the bottom end 912 of the drive unit 900 may not abut against the claw 211 or the outward inclined surface 212. The elastic force released by the elastic element 250 can push the driving receiving force 210 to protrude outward along the Y1 direction, and to be in contact and engaged with the drive unit 900 to receive the driving force. During the process of the driving receiving member 210 protruding outward, there may be certain possibility that the claw 211 can abut against a drive column 910, which may cause that the driving-force receiving member 210 is not completed engaging with the drive unit 900. However, as the drive unit 900 is driven by the driving motor M1 to rotate, the drive column 910 may be rotated to avoid the claw 211. Therefore, when the interference disappears, the driving-force receiving member 210 can continue to protrude outward to complete engagement with the drive unit 900.

Figure 52:
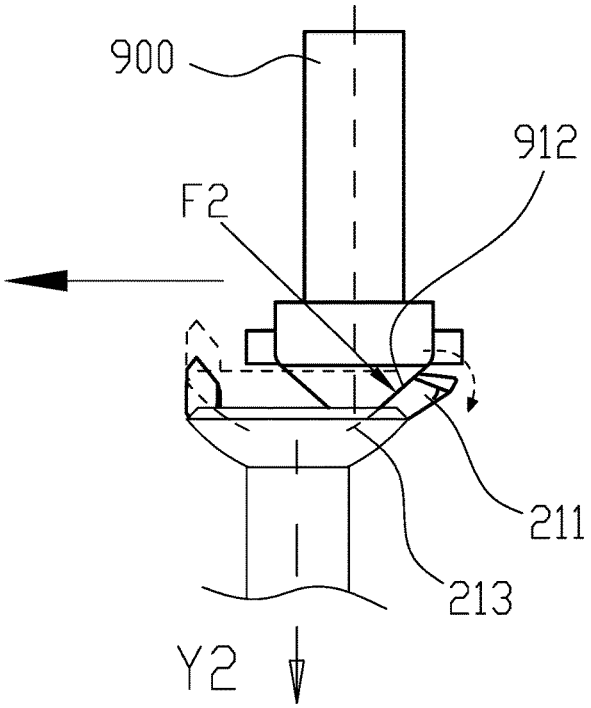
FIG. 52 is a schematic diagram of a claw of a driving-force receiving member being pressed to swing according to a third exemplary embodiment of the present disclosure.

During the process that the photosensitive unit 10 is separated from the developing unit 30 or the toner cartridge b is removed or unmounted from the electronic imaging device P according to Exemplary Embodiment I/Exemplary Embodiment II, as shown in FIG. 52, when the driving-force receiving member 210 is disengaged from the drive unit 900, the drive unit 900 may be relatively stationary. During the disengaging movement of the driving-force receiving member 210, the claw 211 and the inward inclined surface 213 may be abutted against and pressed by a semicircular structure at the bottom of the drive unit 900, so that the claw 211 can inward tilted and/or generate downward compression force F2, causing the entire driving-force receiving member 210 to contract inward along the Y2 direction to avoid the rigid structural interference with the drive unit 900. When the driving-force receiving member 210 is completely disengaged from the drive unit 900, the driving-force receiving member 210 may be returned to the initial position by the elastic force of the elastic element 250 and the claw 211 may be returned to an upright state before the compression by the elastic force of the elastic element 810.

According to Exemplary Embodiment III, because of the extension-contraction function of the entire driving-force receiving member 210 and the relatively swingable claw 211, as well as the cooperation of the outward inclined surface 212 with the inward inclined surface 213, the toner cartridge b can be mounted into and removed from the electronic imaging device P. The photosensitive unit 10 can be disengaged from and engaged with the developing unit 30 of the toner cartridge b in the electronic imaging device P. The driving-force receiving member 210 can realize the operation of engagement with and disengagement form the drive unit 900. According to Exemplary Embodiment III, it may not be necessary to add the control mechanism 600 or drive assembly 200 described in the Exemplary Embodiment I/Exemplary Embodiment II to the toner cartridge b.

Exemplary Embodiment IV

Figure 53:
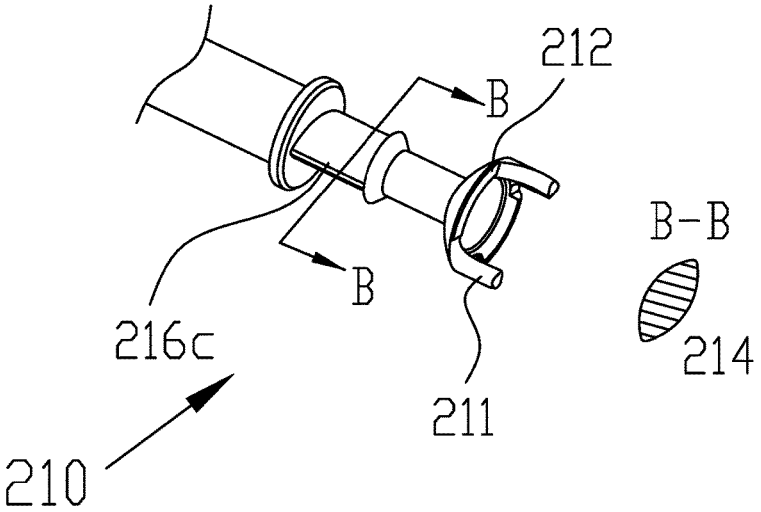
FIG. 53 is a schematic structural diagram of a resetting part of a driving-force receiving member according to a forth exemplary embodiment of the present disclosure.
Figure 54A:
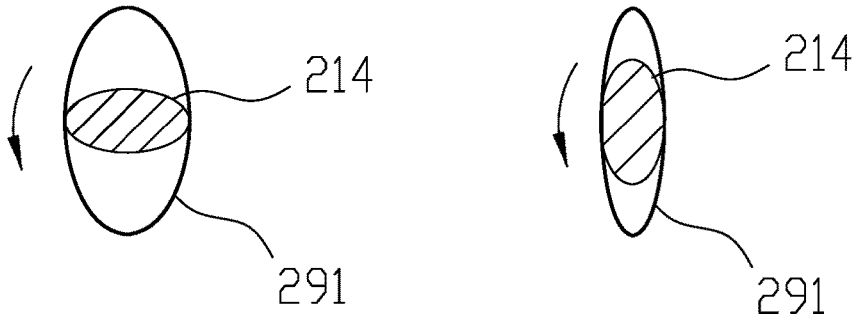
FIG. 54*a* and FIG. 54*b* are schematic structural diagrams of a resetting part according to a forth exemplary embodiment of the present disclosure.
Figure 54B:
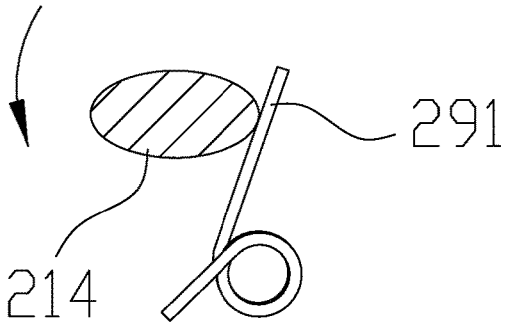

As shown in FIG. 53, the connecting member 216 of the driving-force receiving member 210 may further include a resetting part 216*c*. The resetting member 216*c* may include an elliptical structure or a non-circular cross-section (shown as cross-section B-B). In addition, the end cap 290 or the side panel b2 may include a resetting part 291, and the resetting part 291 may be an elastic metal ring, a rubber band, a torsion spring and a magnet, as shown in FIG. 54*a* and FIG. 54*b*.

Figure 55:
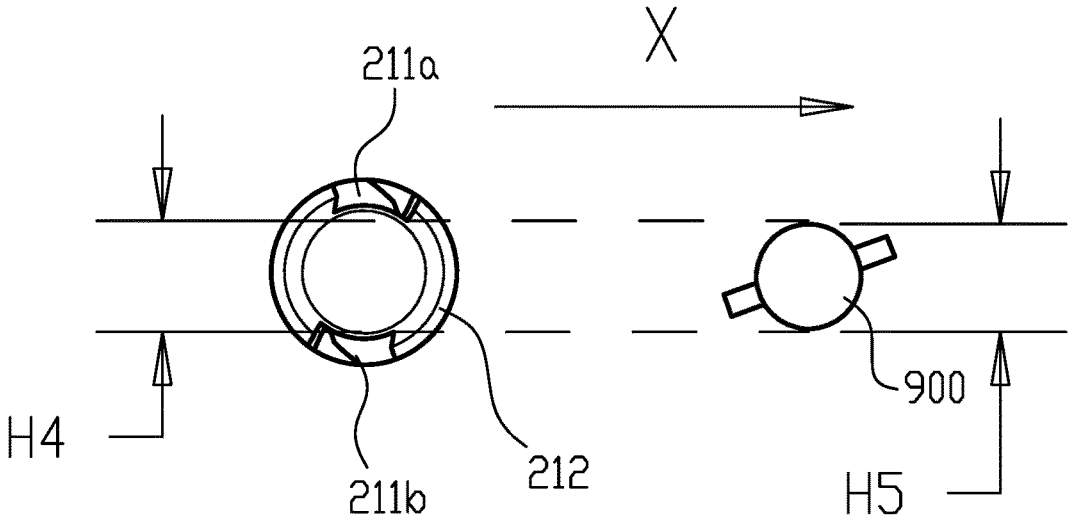
FIG. 55 is a schematic diagram of a driving-force receiving member after being reset position but before being engaged with the drive unit according to a forth exemplary embodiment of the present disclosure.
Figure 56:
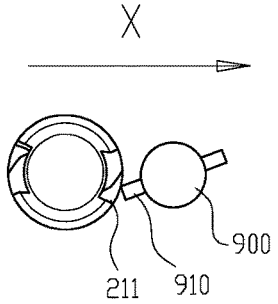
FIG. 56 is a schematic diagram of a driving-force receiving member abutting against and interfering with the drive unit according to a forth exemplary embodiment of the present disclosure.

The resetting mechanism composed by the resetting part 291 and the resetting member 216*c* of the driving-force receiving member 210 can reposition the claw 211 of the driving-force receiving member 210. The resetting member 216*c* can be applied with an elastic force by the resetting part 291 to rotate, and the rotating resetting member 216*c* can drive the claw 211 to rotate. As shown in FIG. 55, through the resetting mechanism, the claw 211 of the driving-force receiving member 210 can realize that one claw 211*a* is higher than the other claw 211*b* relative to the mounting direction X. If viewed in the mounting direction X, the distance H4 between the two claws (211*a* and 211*b*) may be greater than the outer cylindrical width H5 of the drive unit 900. Even if the claw 211 according to Exemplary Embodiment IV cannot be swung or tilted relative to the driving-force receiving member 210, because the distance between the claw 211*a* and the claw 211*b* can accommodate the outer cylindrical width of the drive unit 900, when the driving-force receiving member 210 is engaging with the drive unit 900, the outward inclined surface 212 of the driving-force receiving member 210 can be abutted against and pressed by bottom 912 with the semicircular structure of the drive unit 900 to contract inward relative to the flange 270, so that the interference with the drive unit 900 can be avoided (referring to FIG. 50). During the process of the claw 211 moving along the direction X, the claw 211 may not abut against the drive column 910 of the drive unit 900, therefore the contacting engagement is not affected, as shown in FIG. 56.

The structure according to Exemplary Embodiment IV can be used in combination with the structure of the toner cartridge b according to Exemplary Embodiment I/Exemplary Embodiment II/Exemplary Embodiment III.

Exemplary Embodiment V

According to Exemplary Embodiment I/Exemplary Embodiment II/Exemplary Embodiment III/Exemplary Embodiment IV, the function achieved by the pulling part F300 acting on the control action part 620 and the cartridge action part b4 can also be achieved by directly using the cartridge action part b4. That is, the driving-force receiving member 210 can be controlled by the control mechanism 600 so that the driving-force receiving member 210 can be extended and contracted relative to the flange 270. The toner cartridge b in the electronic imaging device P can be rotated relative to the photosensitive assembly a, so that the developing unit 30 can be separated from the photosensitive unit 10.

Figure 57:
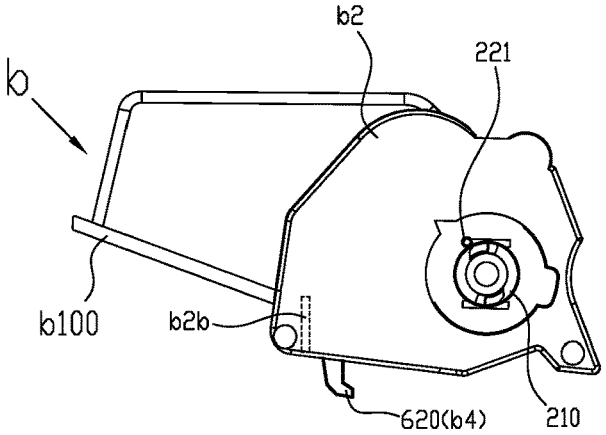
FIG. 57 is a schematic structural diagram of a toner cartridge and a cartridge action part according to a fifth exemplary embodiment of the present disclosure.

As shown in FIG. 57, different from Exemplary Embodiment I to Exemplary Embodiment IV, a barrier wall b2*b* rather than the cartridge action part b4 disposed on the side panel according to the present exemplary embodiment. The barrier wall b2*b* may be disposed on the movement track of the control action part 620 and can abut against the control action part 620. Therefore, the control action part 620 can achieve all functions of the cartridge action part b4 according to Exemplary Embodiment I to Exemplary Embodiment V.

Figure 58:
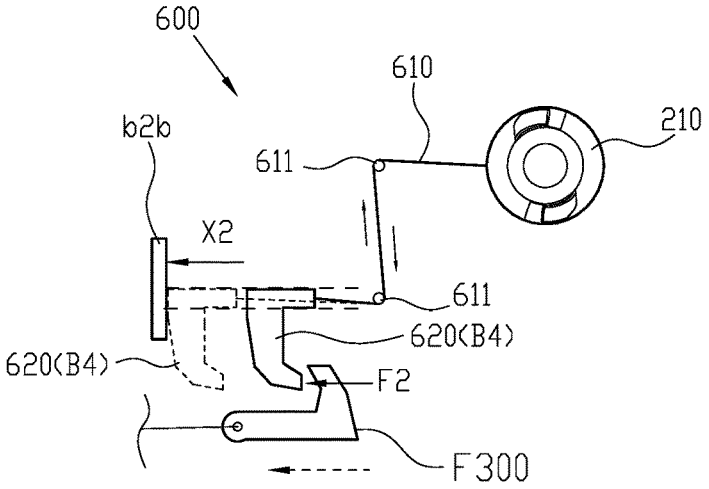
FIG. 58 is a schematic structural diagram of a driving-force receiving member and a control mechanism according to a fifth exemplary embodiment of the present disclosure.

As shown in FIG. 58, referring to Control Mode 1 of the control mechanism according to Exemplary Embodiment I, when the pulling part F300 is moved backward, the pulling part F300 may first act on the control mechanism 600. The pulling part F300 may drag the control action part 620 of the control mechanism 600, so that the driving-force receiving member 210 can be extended and contracted relative to the flange 270 to be separated from the drive unit 900. As the pulling part F300 is further moved backward, the control action part 620 can be dragged by the pulling part F300 to move along a designated path and be contact with the barrier wall b2*b* of the side panel b2. Because the barrier wall b2*b* may be fixed to the side panel b2, the control action part 620 can abut against the barrier wall b2*b*, so that the pulling force of pulling part F300 can be converted to a pushing force on the barrier wall b2*b*, and the pushing force can push the side panel b2, causing the toner cartridge b to rotate relative to the photosensitive assembly a and being separated from the photosensitive assembly a, as shown in FIG. 41.

Similar to Exemplary Embodiment I to Exemplary Embodiment IV (the process of the photosensitive unit 10 contacting the developing unit 30), when the pulling part F300 is returned the position before displacement, the control action part 620 may first retract the pushing force on the barrier wall b2*b*, as the pulling direction F300 is moved in the opposite direction. As the toner cartridge b is rotated, the developing unit 30 can contact the photosensitive unit 10 again. Then the pulling part F300 may further move backward, so that the pulling part F300 cannot act (hook) on the control action part 620 of the control mechanism 600. Because of the elastic force released by the elastic element 250, the driving-force receiving member 210 can protrude out and reengage with the drive unit 900.

Therefore, according to Exemplary Embodiment V, the function of the above embodiments can also be achieved by the control action part 620 in contact with the barrier wall b2*b*. That is, when the pulling part F300 is triggered to act on the control action part 620, the driving-force receiving member 210 can be first inward contracted. Then the toner cartridge b may be rotated relative to the photosensitive assembly a, so that the photosensitive unit 10 can be separated from the developing unit 30. When the pulling part F300 retracts action, the above action of the above parts can be repeated reversely.

In addition, a buffer layer, such as a sponge, a felt or a short spring, may be disposed on a contacting surface between the control action part 620 and the barrier wall b2*b*, so that there can be a buffer when the control action part 620 is in contact with the barrier wall b2*b*.

Exemplary Embodiment VI

According to Exemplary Embodiment VI, the main difference from the above Exemplary Embodiment I to Exemplary Embodiment V, is the configuration of the cartridge action part b4. The structure of the drive assembly 200 may refer to the structure of the drive assembly described in Exemplary Embodiment I to Exemplary Embodiment V and is not be elaborated here.

Figure 59:
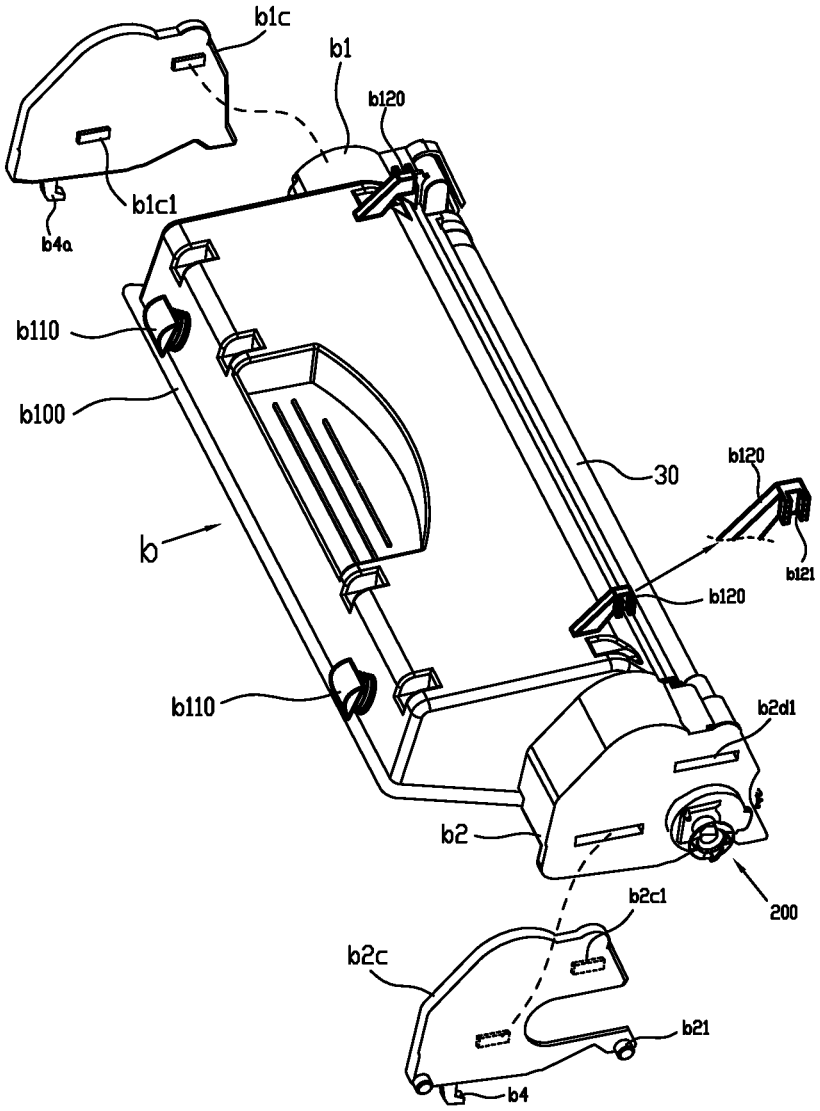
FIG. 59 is a schematic structural diagram of a toner cartridge according to a sixth exemplary embodiment of the present disclosure.

As shown in FIG. 59, sliders b1*c* and b2*c* may be disposed at the outer side of the side panels b1 and b2, respectively. The side panels b1 and b2 may disposed at sides of the developing chamber b100 of the toner cartridge b. A protrusion b2*c*1 may be disposed at the inner side of the slider b2*c*, and a chute b2*d*1 may be disposed on the surface of the side panel b2. Because of the protrusion b2*c*1 cooperating with the chute b2*d*1, the slider b2*c* can be slid on the side panel b2 along a direction that is perpendicular to the axial direction of the developing unit 30. A cartridge action part b4 may be disposed at the bottom of the slider b2*c*, and a locating column b21 may be disposed on the side surface of the slider b2*c*. (The slider b1*c* on the other side panel b1 may also have basically the same structure and the function of the b2*c*.) In addition, a positioning element b120 may be disposed on the surface (upper) of the developing chamber b100. The positioning element b120 may be outward convex cantilever, and a locating column b121 may be disposed at the front end of the positioning element b120. The rear end of the developing chamber b100 may include a pushing element b110 that protrudes toward the chamber back of the developing chamber b100. The pushing element b110 may be an elastic protrusion, e.g. a material with certain elastic amount, including elastic sponges, springs, plastic blocks, and magnets, etc. Through the positioning element b120 and the pushing element b110, during the mounting process of the toner cartridge b into the electronic imaging device P, the toner cartridge b can be relatively positioned to or abutted against the relatively fixed internal structure of the electronic imaging device P. Therefor the toner cartridge b can be prevented from being shaken by an external force during the developing operation.

Figure 60:
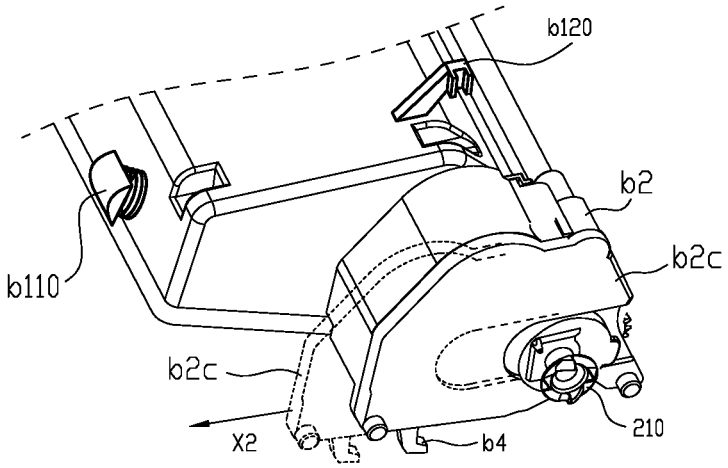
FIG. 60 and FIG. 61 are schematic structural diagrams of a side panel and a slider of a toner cartridge according to a sixth exemplary embodiment of the present disclosure.
Figure 61:
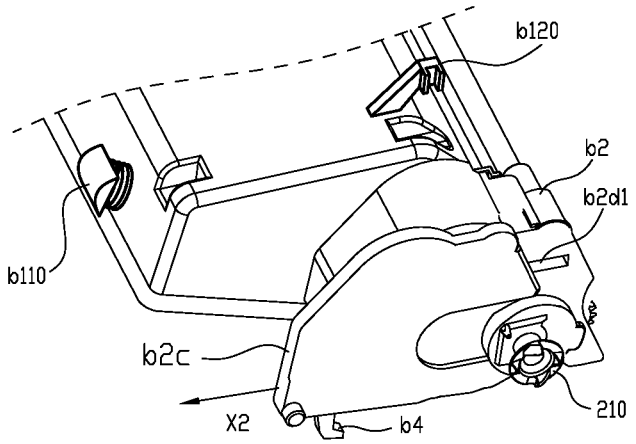

As shown in FIG. 60 and FIG. 61, the slider b2*c* can be slid in the X2 direction relative to the side panel b2 and the developing chamber b100 (i.e., can be moved toward the rear end of the developing chamber b100), and simultaneously, drive the cartridge action part b4 and the locating column b21 of the slider b2*c* to move.

Figure 62:
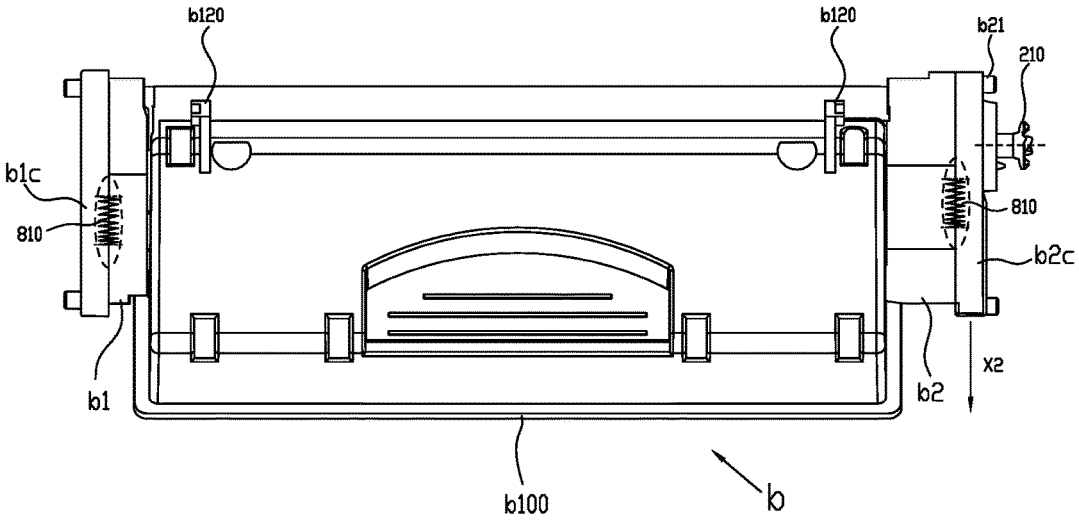
FIG. 62 and FIG. 63 are schematic diagrams of a displacement operation of a slider according to a sixth exemplary embodiment of the present disclosure.
Figure 63:
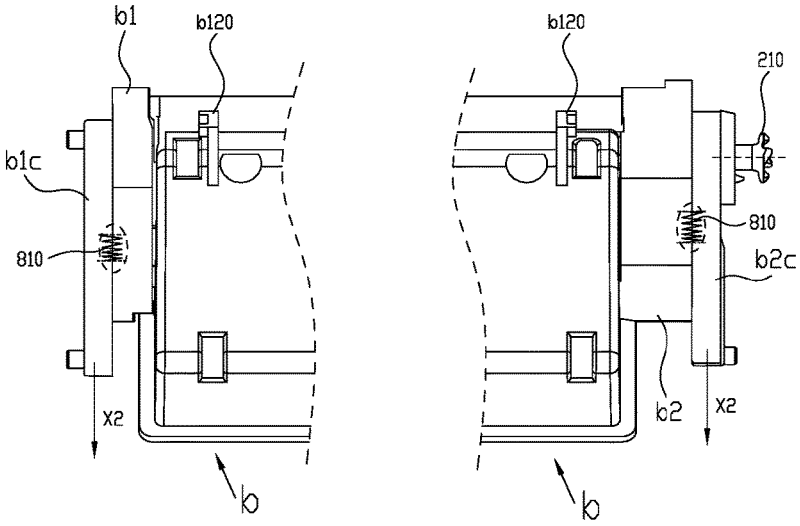

As shown in FIG. 62 and FIG. 63, a resetting part 810 (spring or tension spring) may also be disposed between the slider b1*c* and the side panels b1, and between the slider b2*c* and the side panel b2, so that when no external force is exerting on the sliders b1*c*, b2*c*, the slider b1*c* and b2*c* can be located at the front end of the toner cartridge b. That is, compared to the sliders b1*c* and b2*c* that are slid by an external force, when the sliders b1*c* and b2*c* can be located closer to the developing unit 30 before the external force is applied.

When the sliders b1*c* and b2*c* are slid by a force, the side panels b1 and b2 may be stationary relative to the developing chamber b100 and the driving-force receiving member 210.

Figure 64:
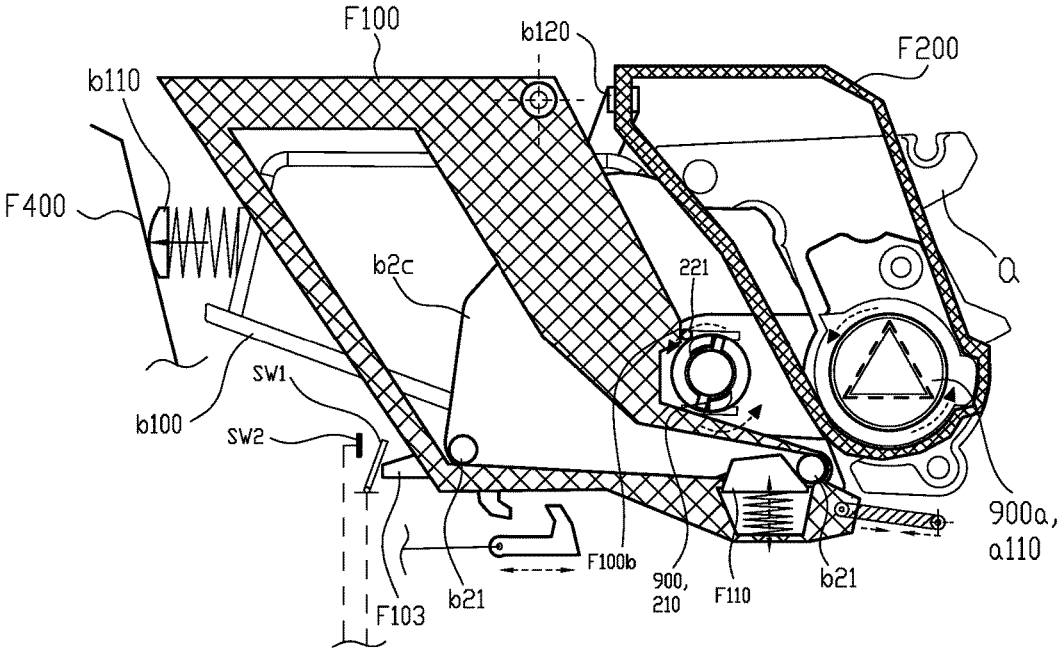
FIG. 64 and FIG. 65 are schematic diagrams of a toner cartridge being mounted in an electronic imaging device according to a sixth exemplary embodiment of the present disclosure.
Figure 65:
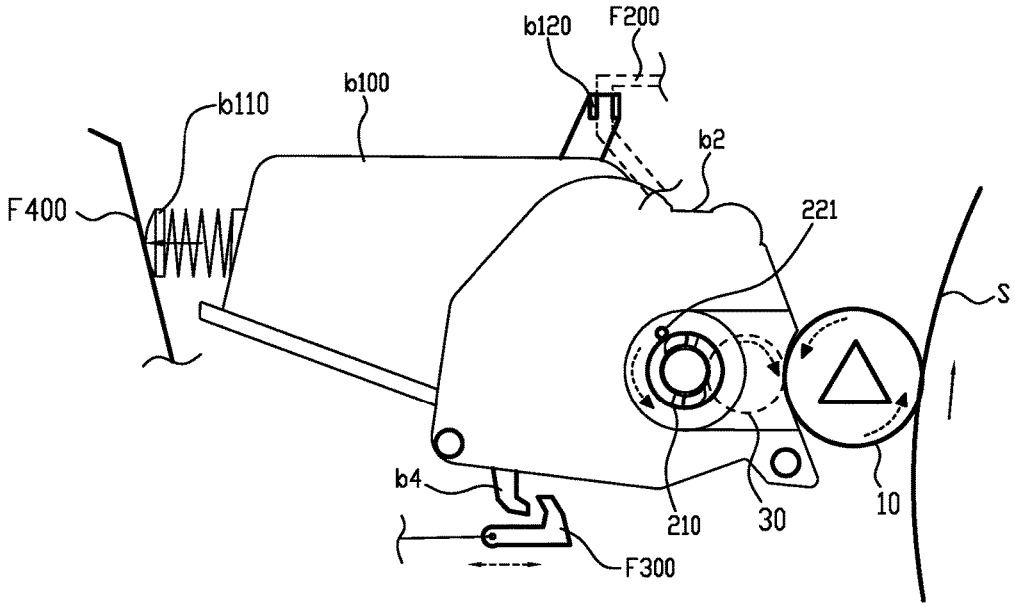

As shown in FIG. 64, after the toner cartridge b is mounted in the electronic imaging device P and supported by the toner cartridge guide rail F100, (referring to the mounting process in Exemplary Embodiment I) the positioning element b120 of the toner cartridge b may be relatively positioned on the photosensitive assembly guide rail F200. The two locating columns b121 of the positioning element b120 can sandwich the upper frame structure of the photosensitive assembly guide rail F200, so that the developing chamber b100 and the side panels b1 and b2 at both sides can be relatively fixed by positioning and fixing the positioning element b120. The pushing element b110 at the rear end of the toner cartridge b may abut against the front frame structure F400 of the electronic imaging device P. Through the elastic pushing force generated after the abutment, the developing chamber b100 and the side panels b1 and b2 can be moved in the direction toward the photosensitive assembly a, and the developing unit 30 of the developing chamber b100 can be kept in contact with the photosensitive unit 10. The slider b2*c* of the side panel b2 can be supported at the toner cartridge guide rail F100 by the locating column b21. Because of the above positioning, the toner cartridge b can perform developing operation in a relatively stationary status, as shown in FIG. 65.

Figure 66:
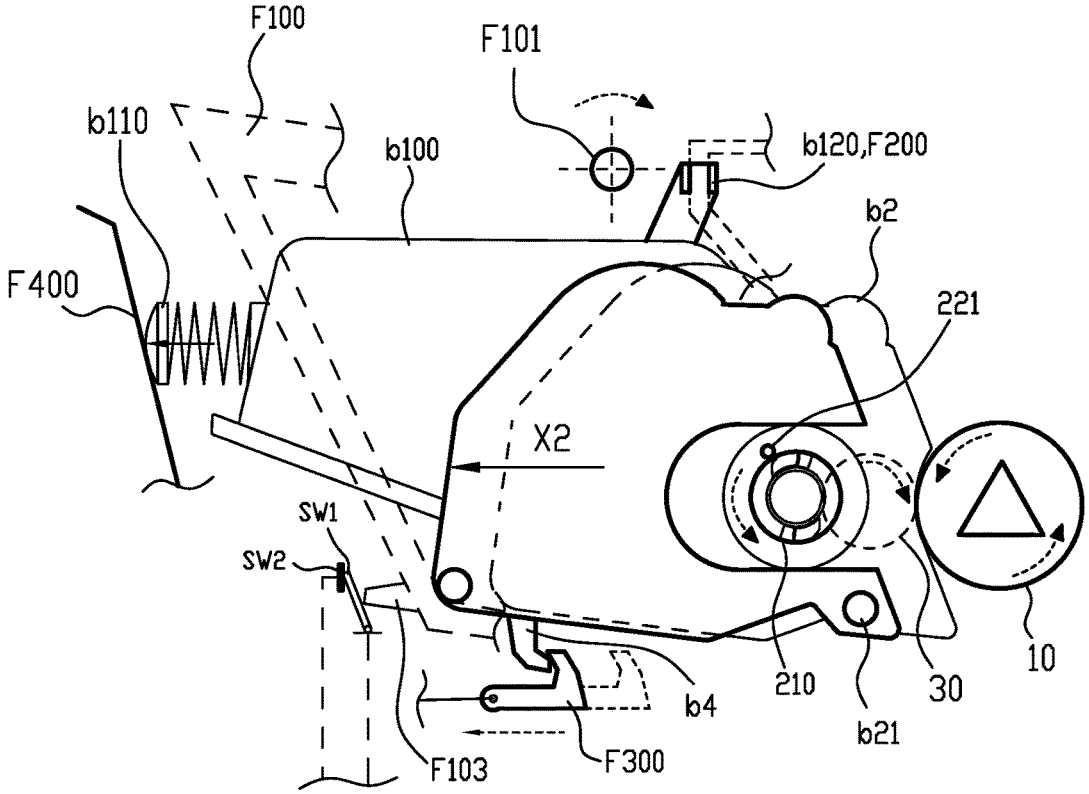
FIG. 66 is a schematic diagram of a slider being dragged by a pulling part according to a sixth exemplary embodiment of the present disclosure.

As shown in FIG. 64 and FIG. 66, through the sliding structure of the slider b2*c* and the side panel b2, the inspection operation can be performed by the inspection device PD1 of the electronic imaging device P. When the pulling part F200 is triggered to move, the pulling part F300 can drag (hook on) the cartridge action part b4 of the slider b2*c*. The slider b2*c* can be moved backward in the X2 direction along with the movement of the pulling part F300. The backward displacement of the slider b2*c* can also drive the toner cartridge guide rail F100 to rotate. Finally, the pushing block F103 of toner cartridge guide rail F100 can touch the trigger switch SW1, so that the trigger switch can be turned on. When the force of the pulling part F300 is retracted, the toner cartridge guide rail F100 can be returned to the initial position before the rotation, and the trigger switch SW1 can be turned off.

Different from the Exemplary Embodiment I to Exemplary Embodiment V, the slider b2*c* according to Exemplary Embodiment VI can be slidably moved on the side panel b2, and the developing cartridge b100 and the side panels b1, b2 can be relatively positioned or abutted against by the positioning element b120 and/or the pushing element b110. Therefore, the during the process that the toner cartridge is rotated by pulling part F300 acting on or retracting action from the toner cartridge guide rail b4, the developing chamber b100 can be kept in contact with the photosensitive unit 10, and the driving-force receiving member 210 of the side panel b2 may not be separated from but may be kept engaged with the drive unit 900, and can drive the developing unit 30 to rotate constantly.

Figure 67:
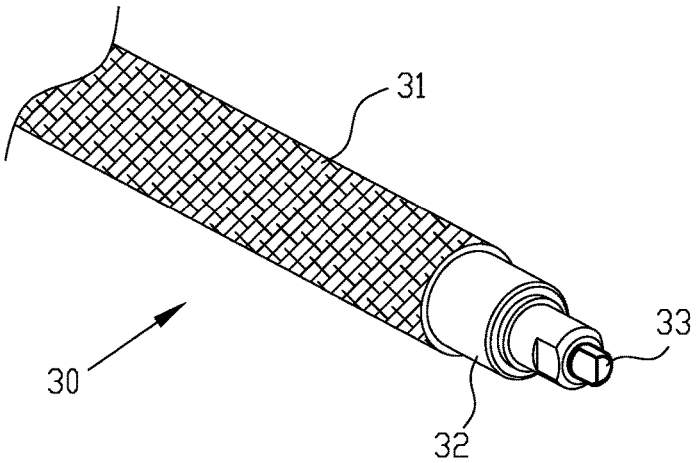
FIG. 67 is a schematic structural diagram of a developing unit according to a sixth exemplary embodiment of the present disclosure.

In addition, due to the constant contact of the developing unit 30 with the photosensitive unit 10, the structure of the developing unit 30 may be configured as shown in FIG. 67. The developing unit 30 may include a cylinder 32, and the cylinder 32 may include a magnetic core 22. An elastic layer 31 having certain amount of elastic compression may be disposed at the outer layer of the cylinder 32 where the cylinder 32 is in contact with the photosensitive unit 10. The elastic layer 31 may be coated with a developing coating. The presence of the elastic layer 31 can prevent the rigid contact between the developing unit 30 and the photosensitive unit 10 during continuous contact rotation, reducing the long-term contact abrasion therebetween, and extending the service lifetime of the development unit 30 and the photosensitive unit 10.

The developing unit 30 with an elastic layer 31 according to Exemplary Embodiment VI can also be applied to the toner cartridge b described in Exemplary Embodiment I to Exemplary Embodiment V to increase the service lifetime of the developing unit 30.

Figure 68:
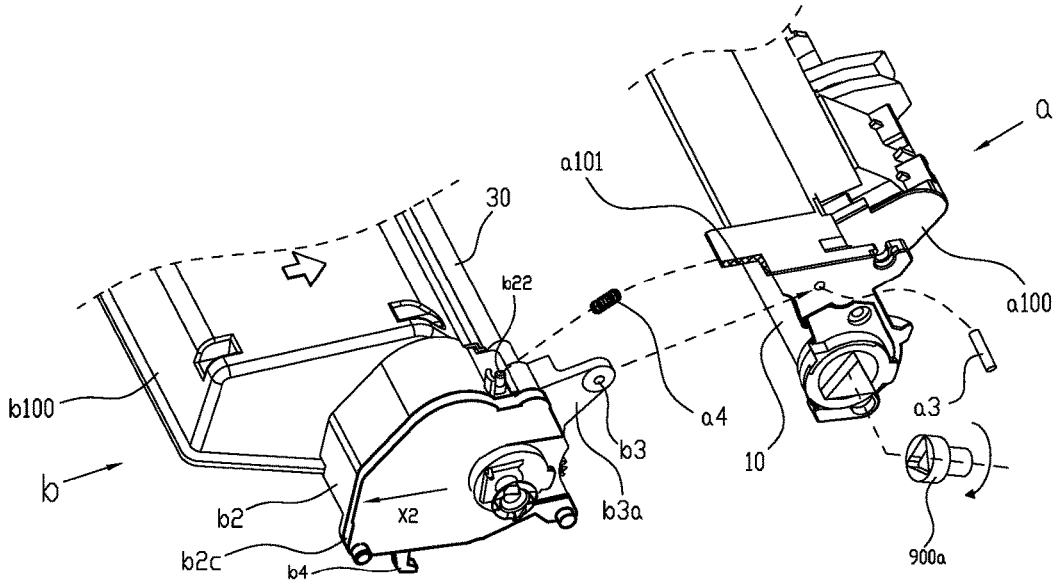
FIG. 68 is a schematic structural diagram of a toner cartridge being integrally configured with a photosensitive assembly according to a sixth exemplary embodiment of the present disclosure.

In addition, referring to Exemplary Embodiment II, the toner cartridge b and the photosensitive assembly a according to Exemplary Embodiment VI may also be configured as a mutually connected structure, so that the developing chamber b100 of the toner cartridge b and the side panels b1 and b2 on both sides can be relatively positioned in the electronic imaging device P, i.e., these parts can be positioned by interconnecting with the photosensitive assembly a, and the auxiliary positioning of the positioning element b120 or the pushing element b110 may not be required. As shown in FIG. 68, the toner cartridge b may be coupled with the photosensitive assembly a via the connecting arm b3*a* of the side panels b1 and b2, and the connecting part a3 can pass through the positioning hole on both sides of the photosensitive chamber a100 and the hole b3 of the developing chamber b100 to connect the toner cartridge b with the photosensitive assembly a as an integral structure. An elastic element a4 may be disposed between the toner cartridge b and the photosensitive assembly a.

Figure 69:
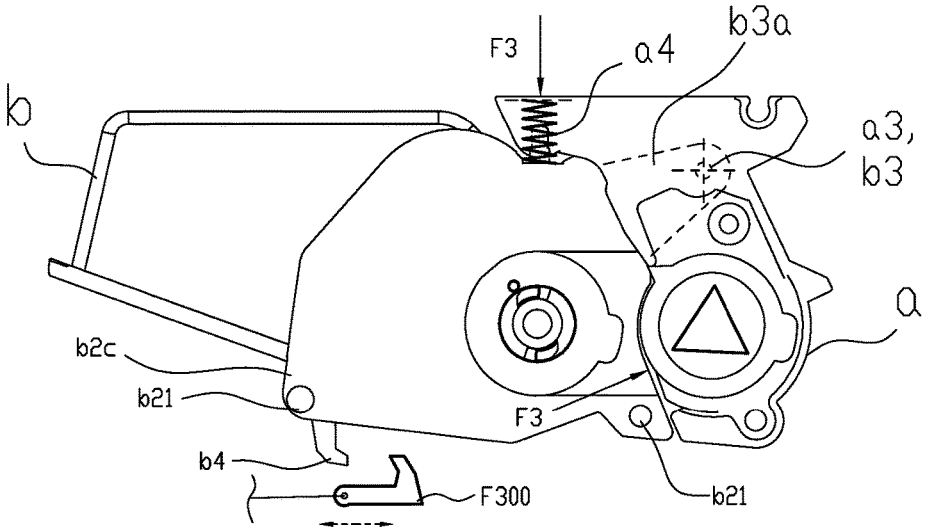

As shown in FIG. 69 and FIG. 70, the toner cartridge b can be relatively fixed and positioned in the electronic imaging device P by interconnecting with the photosensitive assembly a. The slider b2*c* can be slidably moved relative to the toner cartridge b and the photosensitive assembly a. The slider b2*c* can also abut against the elastic element a4 between the toner cartridge b and the photosensitive assembly a to generate a downward compression force F3, which can act on the toner cartridge b. Through the rotation point (b3/a3), the toner cartridge b can apply the downward compression force F3 on the developing unit 30, so that the developing unit 30 can be in contact with the photosensitive unit 10. Therefore, through the connection between the developing unit 30 and the photosensitive unit 10, the toner cartridge b can perform the developing operation after being relatively positioned by connecting to the photosensitive assembly a.

Exemplary Embodiment VII

According to Exemplary Embodiment VII, the main difference from the Exemplary Embodiment I to Exemplary Embodiment VI is about the structure and function of the cartridge action part b4. The cartridge action part b4 can not only move the locating column b21 relative to the side panel b2 or the developing chamber b100, but also control the axial extension and contraction of the driving-force receiving member 210.

As shown in FIG. 70*a*1 to FIG. 70*a*3, one side of the developing chamber b100 of the toner cartridge b may include a side panel b2, a base plate b2*e* matching with the side panel b2, a side panel cover b24, a control mechanism 600, a slider b2*c*, and a cartridge action part b4, a driving-force receiving member 210, a slider 230, a flange 270, a driving force transmission element 274, and a pressing element b2*f*. The side panel b2 may include a first chute b2*d*1, a second chute b2*d*2 and a through hole b25. The base plate b2*e* may include a chute b2*e*1, a limiting element b2*e*2 and a positioning hole. The control mechanism 600 may have a rod-shaped structure, the front end may have a fork-shaped structure with an inclined surface 631 at the inner side, and the rear end may include a protrusion 632, as shown in FIG. 70C. The slider 230 may include an inclined surface 231. The slider b2*c* may include a protrusion b2*c*1 facing inward, a sliding block b2*c*4 facing outward, and a chute b2*c*2. The front end of the slider b2*c* may include a connecting hole b2*c*3, and the side surface of the slider b2*c* may include a locating column b21, as shown in FIG. 70*b*. The lower part (facing downward) of the cartridge action part b4 may include a hook-shaped structure, and the upper part may include a sliding block b42 and a protrusion b41. The shapes of the protrusion b41, the chute b2*e*1, the sliding block b42, the sliding block b2*c*4, the chute b2*c*2, the first chute b2*d*1, and the second chute b2*d*2 may have a certain degree of curvature.

Figure 2:
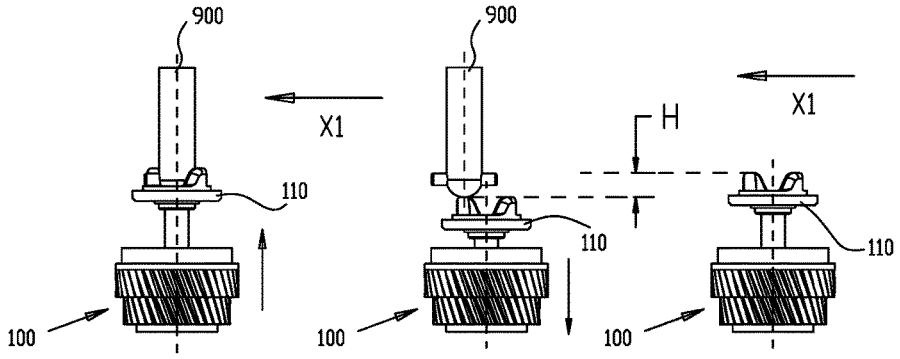
FIG. 2 is a schematic diagram of a drive assembly of a toner cartridge being engaged with a drive unit of an electronic imaging device.

As shown in FIG. 70*a*2 and FIG. 70*a*3, the assembly relationship between the parts described above may be as following. The connecting member of the driving-force receiving member 210 may pass through the slider 230 and is placed in the through hole b25. Through the connecting part 260, the connecting member may be relatively fixed and connected to the driving force transmission element 274 disposed behind the side panel b2. The entire driving force transmission element 274 may be disposed in the flange 270. The flange 270 may include an elastic element, which may be disposed between the driving force transmission element 274 and the base plate b2*e*. The protrusion b2*c*1 of the slider b2*c* may be slidably disposed at in first chute of the side panel b2. The sliding block may be also slidably disposed at the second chute b2*d*2 of the side panel b2. One end of a resetting part 810 may be connected to the connecting hole b2*c*3 at the front end of the slider b2*c*, and the other end of the resetting part 810 may be sleeved with a protrusion (not shown) at the inner side of the side panel b2. The sliding block b42 of the cartridge action part b4 can be slidably disposed in the chute b2*e*1 of the base plate b2*e*. The protrusion b41 can be slidably disposed in the chute b2*c*2 of the slider b2*c*. A width L4 of the protrusion b41 may be smaller than a width L5 of the chute b2*c*2. The pressing element b2*f* can be slidably disposed at the limiting element b2*e*2 of the base plate b2*e*. An elastic element 250 may be disposed between the pressing element b2*f* and a barrier wall of the base plate b2*e*. The control mechanism 600 may be disposed on the recess at the outside of the side panel b2, and the elastic element 250 may be disposed between the control mechanism 600 and the barrier wall of the side panel b2. The fork-shaped structure at the front of the control mechanism 600 may include the connecting member of the driving-force receiving member 210. The inclined surface 231 may abut against the inclined surface 631. The side panel b2 can be fixedly cover the base plate b2*e*, and the side panel cover b24 can be fixed to the side panel b2 and covers the control mechanism 600.

After the above assembly is completed, during the interaction of the cartridge action part b4 and the pulling part F300, through the cartridge action part b4, the locating column b21 and the driving-force receiving member 210 can achieve the following movement process, i.e., the following displacements can be achieved.

(1) The initial position/the first position. When the cartridge action part b4 is not subjected to an external force, that is, the pulling part F300 exerts no force on the cartridge action part b4, as shown in FIG. 70*d*1 to FIG. 70*d*3, the control mechanism 600 can be moved backward by the elastic force of the elastic element 250. At this time, the elastic force of the elastic element 250 of the control mechanism 600 may be greater than the elastic force of the elastic element that provides the axial elastic force to the driving-force receiving member 210. Therefore, the inclined surface 631 at the inner side of the frond end of the control mechanism 600 can press the inclined surface 231 of the slider 230 downward, so that the driving-force receiving member 210 can be kept contracted inward relative to the flange 270 and may not be engaged with the drive unit 900. The resetting part 810 may also drag the cartridge action part b4 in the initial position. Because the protrusion b41 is in the chute b2*c*2, the slider b2*c* may also be in the initial state/position under the traction force of the resetting part 810. The protrusion 632 at the rear end of the control mechanism 600 can abut against the protrusion 641 at the front end of the cartridge action part b4 to limit the position of the protrusion 641, and as a result, the protrusion b41 can be placed at the rear end of the chute b2*c*2.

(2) The backward displaced position/the second position. When the pulling part F300 is moved backward to drag (hook on) the cartridge action part b4, as shown in FIG. 70*e*1 and FIG. 70*e*2, the sliding block b42 of the cartridge action part b4 can be slid along the second chute b2*d*2. The entire cartridge action part b4 can be slidably moved relative to the side panel b2, and the protrusion b41 in the chute b2*c*2 can simultaneously drive the slider b2*c* to slide. The protrusion b2*c*1 of the slider b2*c* can be slid in the first chute b2*d*1 of the side panel b2, i.e., driven by the cartridge action part b4, the entire slider b2*c* can be slidably displaced relative to the side panel b2. It is possible to achieve a similar function to the function according to Exemplary Embodiment VI by the following movements. The cartridge action part b4 can be dragged by the pulling part F300, so that the slider b2*c* can be slid backward relative to the side panel b2. The locating column b21 can be slid together with the slider b2*c* to drive the toner cartridge guide rail F100 to rotate. Finally, the trigger switch SW1 can be touched by the pushing block F103 of the toner cartridge guide rail F100, and the trigger switch SW1 can be turned on, referring to FIG. 66. At this time, the driving-force receiving member 210 may be kept inward contracted relative to the flange 270, and not engaged with the drive unit 900. When the pulling part F300 no longer acts on the cartridge action part b4, the cartridge action part b4 can be driven by the traction force of the resetting part 810 to bring the slider b2*c* together to return to the initial position/first position.

(3) The pushing position/third position. The protrusion b41 can be slid in the chute b2*c*2, and in the initial/first position, the protrusion b41 can be positioned at the rear end of the chute b2*c*2. When the cartridge action part b4 is displaced (pushed) by the pulling part F300, as shown in FIG. 70*f*1 and FIG. 70 *f*2, the protrusion at the rear end of the pulling part F300 can abut against the rear end of the hook-shaped structure of the cartridge action part b4. As the pulling part moves forward, the cartridge action part b4 may be pushed by the pulling part to move forward. The pushing force can exert on the protrusion b41 to push the protrusion 632 at the rear end of the control mechanism 600, so that the entire control mechanism 600 can be moved forward. As shown in FIG. 70*f*3, as the control mechanism is pushed to move forward, the inclined surface 631 at the front end of the control mechanism 600 may not press the inclined surface 231 downward, and the driving-force receiving member 210 can be pushed by the elastic force released by the elastic element of the flange 270 to protrude outward and engage with the drive unit 900. After the cartridge action part b4 is pushed forward for a certain distance, the cartridge action part b4 can abut against the pressing element b2*f* and transmit the pushing force to the toner cartridge b through the elastic element 250 of the pushing element b2*f*. Therefore, under the action of the pushing force of the pulling part F300, the developing unit 30 of the toner cartridge b can be more closely in contact with the developing unit 10, i.e., the developing unit 10 can be pushed by the pulling part F300 to be in contact with the developing unit 10.

The above operation process is as following. Compared to the cartridge action part b4, the slider b2*c*, and the locating column b21*at* the initial position/first position, the cartridge action part b4, the slider b2*c*, and the locating column b21 at the backward displaced position/second position may be further away from the driving-force receiving member 210 or the photosensitive unit 10. That is the cartridge action part b4, the slider b2*c*, and the locating column b21 may be moved away from the driving-force receiving member 210 or the photosensitive unit 10 by the backward movement of the pulling part F300. In the pushing position/third position, the driving-force receiving member 210 may protrude outward relative to the flange 270; while in the backward displaced position/second position or the initial position/first position, the driving-force receiving member 210 can be kept retracted inward relative to the flange 270.

In addition, as shown in FIG. 70*f*4 and FIG. 70*f*2, in the pushing position/third position, the rear end (i.e., the part that is abutted against by the protrusion of the rear end of the pulling part F300) of the hook-shaped body of the cartridge action part b4 may also include an elastic buffer element b43 (obtained by pasting or second injection molding). The buffer element b43 can be an elastic sponge or an elastic rubber and have certain buffering and over-limiting function. By the buffer element b43, when the rear end of cartridge action part b4 is pushed by the pulling part F300, the cartridge action part b4 can be prevented from damage or inaccurate positioning that may be caused by that the pulling part F300 and the cartridge action part b4 are compressed by each other or the pushing range of the pulling part F300 exceeds the limit.

In addition, in the present embodiment, the claw 211 of the driving-force receiving member 210 may also be capable of tilting or swinging relative to the driving-force receiving member 210 as shown in FIG. 48 to FIG. 52.

Exemplary Embodiment VIII

In the structure in which the toner cartridge b and the photosensitive assembly a are integrally connected with each other according to Exemplary Embodiment VI, it may be possible to simplify the internal structure.

Figure 71:
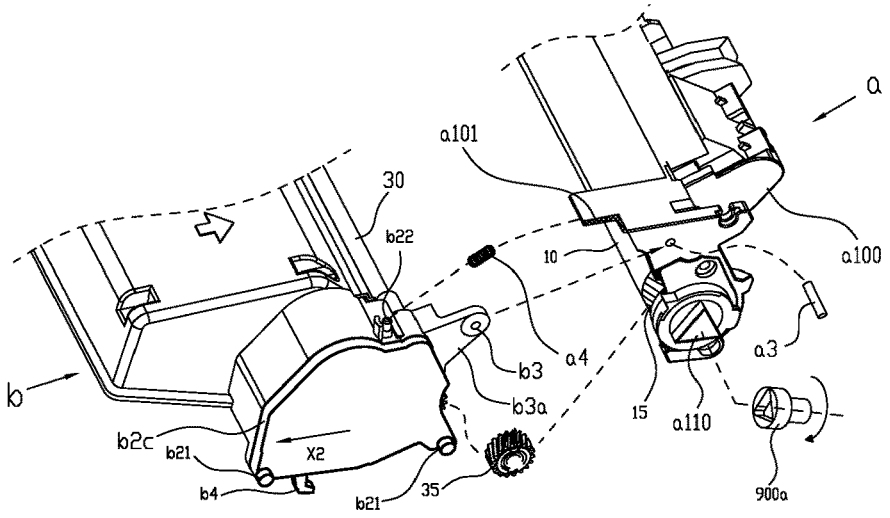
FIG. 71 is a schematic structural diagram of a toner cartridge being integrally configured with a photosensitive assembly according to an eighth exemplary embodiment of the present disclosure.

As shown in FIG. 71, referring to the Exemplary Embodiment VI and Exemplary Embodiment II, a gear 15 may be disposed at one side of the photosensitive unit 10, and the gear 15 of the photosensitive unit 10 can be matched and engage with the gear 35 of the developing unit 30. Thus, the configuration of the drive assembly 200 can be omitted. After the toner cartridge b together with the photosensitive assembly a is mounted into the electronic imaging device P, the driving element a100 of the photosensitive assembly a can be driven by the drive unit 900*a*, the driving element a110 may transmit the driving force for rotation to the gear 35 through the gear 15, and the developing unit 30 can be moved by the gear 35. Therefore, the photosensitive unit 10 and the developing unit 30 can be driven together to perform developing operation.

The toner cartridge b according to Exemplary Embodiment VIII may also include the slider b2*c* described in Exemplary Embodiment VI. When there is no drive assembly 200, the pulling potion F300 can act on the slider b2*c* to rotate the toner cartridge guide rail F100, so that the inspection process of the inspection device PD1 in the electronic imaging device P can still be implemented. The implementation process can refer to the above embodiments and is not elaborated here.

Figure 72:
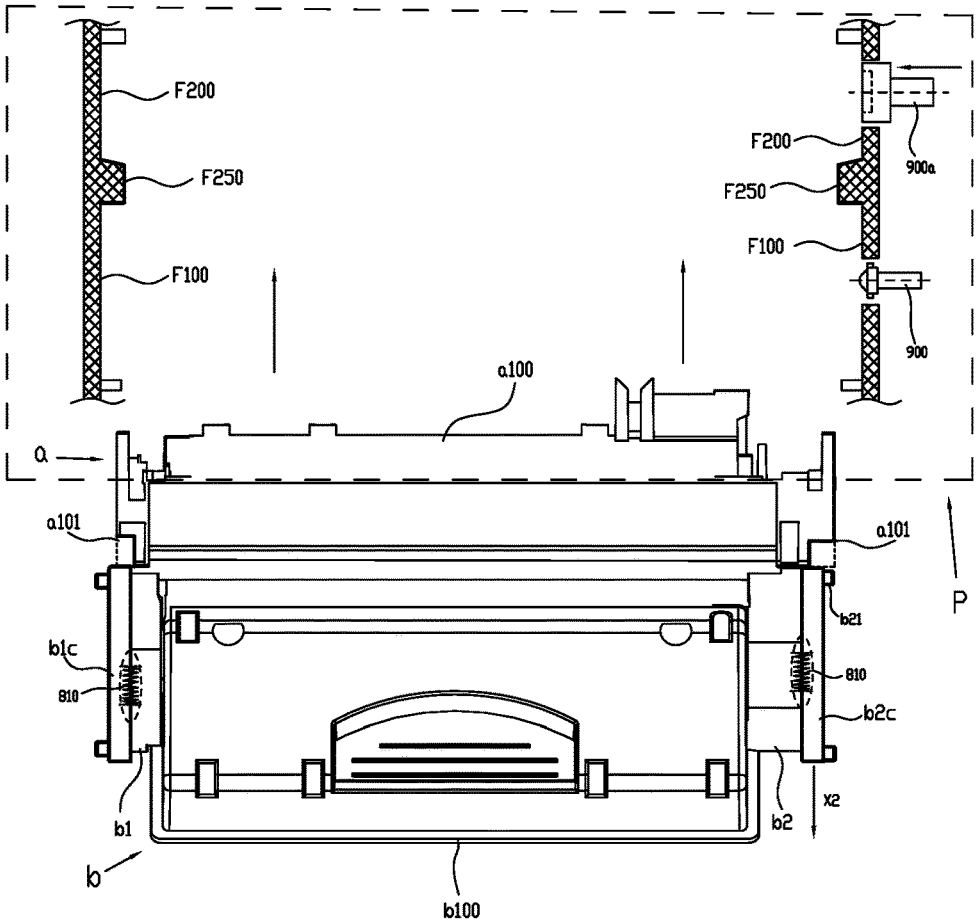
FIG. 72 is a schematic mounting diagram of a toner cartridge being integrally configured with a photosensitive assembly according to second, sixth and eighth exemplary embodiments of the present disclosure.

In addition, according to above embodiments, as shown in FIG. 72 and FIG. 45, viewed from the axial direction of the drive unit 900/900*a* of the electronic imaging device P (i.e., from the side of the electronic imaging device P), in the electronic imaging device P, a guide rail identification block F250 may be disposed between the top of the toner cartridge guide F100 and the top of the photosensitive module guideway F200. The guide rail identification block F250 may be configured to block the erroneous mounting of the toner cartridge b and the photosensitive assembly a and prevent a user from mistakenly mounting the toner cartridge b into the photosensitive assembly guide rail F200 or mounting the photosensitive assembly a into the toner cartridge guide rail F100, thereby preventing both guide rails from structural damage. The guide rail identification block F250 may be integrally fixed with the photosensitive assembly guide rail F200, and can be disposed at both sides or one side of the photosensitive assembly guide rail F200. Therefore, as shown in FIG. 72, if the toner cartridge b and the photosensitive assembly b are connected to each other and integrally configured, a notch a101 may be needed to be disposed at the side of the photosensitive assembly a or the toner cartridge. If viewed from the top of the toner cartridge b, the notch a101 may be disposed between the photosensitive chamber a100 and the developing chamber b100 (i.e., between the rotation axis of the photosensitive unit 10 and the rotation axis of the developing unit 30), and on the side surface of the toner cartridge b. Therefore, when the user integrally mounts the toner cartridge b and the photosensitive assembly a into the electronic imaging device P, the notch a101 can pass through the guide rail identification block F250 at the top of the photosensitive assembly guide rail F200 without being blocked, so that the toner cartridge b and the photosensitive assembly a can be mounted into the electronic imaging device P.

According to Exemplary Embodiment I to Exemplary Embodiment VIII, through the presence of the cartridge action part b4, the inspection of the toner cartridge b by the inspection device PD1 in the electronic imaging device P can also be achieved, and the required inspection procedures can be completed.

Figure 73:
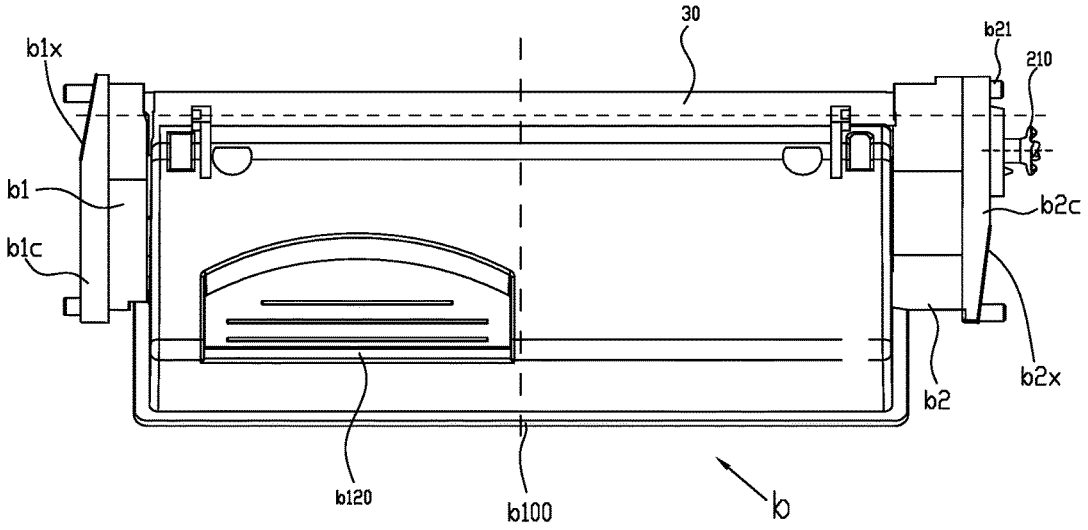
FIG. 73 and FIG. 74 are schematic structural diagrams of a guide surface of a toner cartridge according to first to eighth exemplary embodiments of the present disclosure.

According to Exemplary Embodiments I to Exemplary Embodiment VIII, as shown in FIG. 73, which is viewed from the top of the toner cartridge b, to enable the toner cartridge b to be easily unmounted (removed) from the electronic imaging device P, guide surfaces b1*x* and b2*x* can be disposed on the side panels b1 and b2 of the two sides of the toner cartridge b or disposed at the outer side of the slider b1*c* and b2*c* of the side panels b1 and b2, respectively. The guide surfaces b1*x*, b2*x* may be inclined or arcuate surfaces. On the side panel b2 or the slider b2*c* that is at the same end of the toner cartridge b as the driving-force receiving member 210, the guide surface b2*x* may be disposed at the rear end of the side panel b2 or the slider b2*c*, i.e., disposed near the rear end of the toner cartridge. On the side panel b1 and the slider b1*c* at the other end of the toner cartridge, the guide surface b1*x* may be disposed at the front end of the side panel b1 or the slider b1*c*, i.e., disposed near the rotation axis of the developing unit 30. There may be an angle R1 between the guide surfaces b1*x* and b2*x* and the rotation axis of the developing unit 30. In addition, in order to better achieve the function of the guide surfaces b1*x* and b2*x*, at the developing chamber b100, the grabbing element b120 of the toner cartridge b may be disposed on one side of the toner cartridge b that is away from the driving-force receiving member 210.

Figure 74:
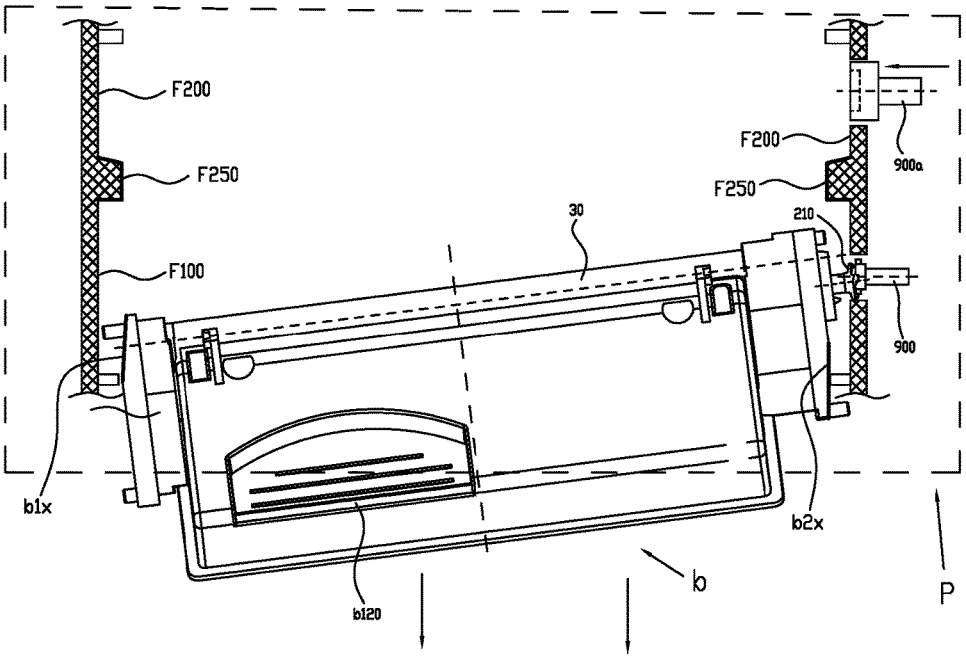

As shown in FIG. 74, the toner cartridge b can be unmounted (removed) from the electronic imaging device P through the configuration of the guide surfaces b1*x* and b2*x* and the auxiliary configuration of the grabbing element b120. Even if there is some structural interference between the drive unit 900 and the driving-force receiving member 210, the toner cartridge b can still be removed by tilting the toner cartridge b, and the drive unit 900 can be completely disengaged from the driving-force receiving member 210. During the disengagement process of the drive unit 900 from the driving-force receiving member 210, the rotation axis of the driving-force receiving member 210 or the developing unit 30 can be tilted relative to the rotation axis of the drive unit 900/900*a*.

Figure 75:
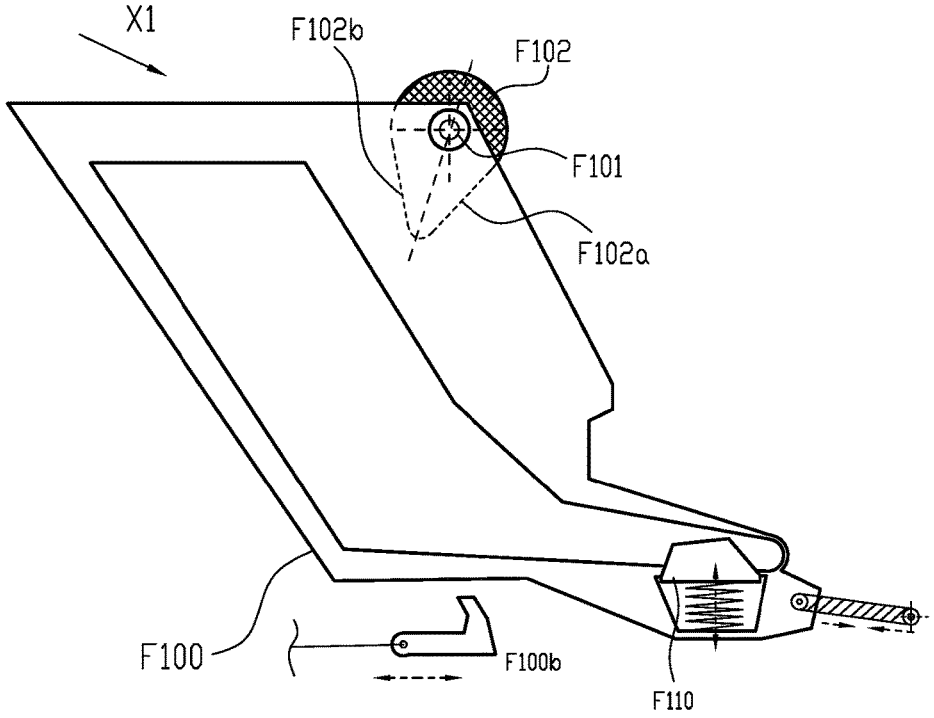
FIG. 75 is a schematic diagram of a toner cartridge guide rail of an electronic imaging device according to first to eighth exemplary embodiments of the present disclosure.

In the above embodiment, according to the structure of the toner cartridge guide rail F100 inside the electronic imaging device P, the pressing element 221 of the drive assembly 100 may be pressed downward and the extension and the contraction of the driving-force receiving member 210 can be controlled by cooperation with a force transmission element 280. As shown in FIG. 75, which is viewed in the direction from the side of the electronic imaging device P, the inner side of the toner cartridge guide rail F100 may include a protrusion F102. The protrusion F102 may include a rotation point F101 of the toner cartridge guide rail F100. Referring to the mounting direction of the toner cartridge b, i.e. the X1 direction, a rear inclined surface F102*b* may be disposed at the back side below the protrusion F102, while a front inclined surface F102*a* may also be disposed at the front side. The front inclined surface F102*a* and the rear inclined surface F102*b* may be mirror-image configured relative to the center line of the protrusion F102.

Figure 76:
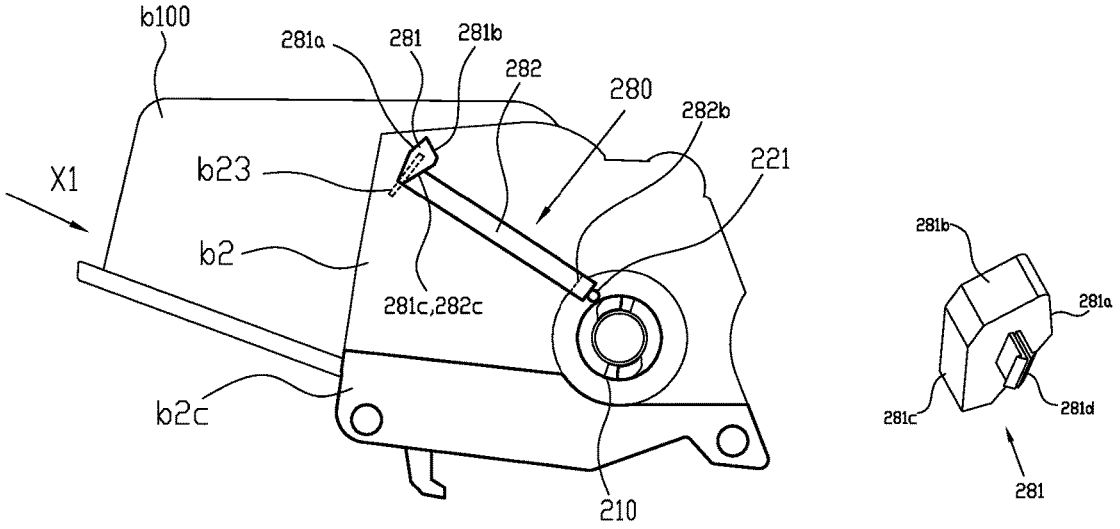
FIG. 76 is a schematic structural diagram of a force transmission element of a toner cartridge according to first to eighth exemplary embodiments of the present disclosure.
Figure 77A:
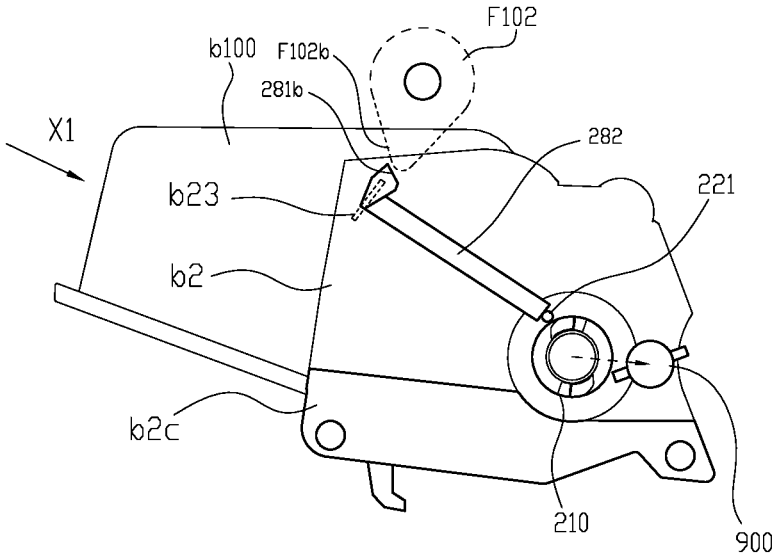
FIG. 77*a*, FIG. 77*b*, FIG. 77*c*, and FIG. 77*d* are schematic diagrams of the operation of a force transmission element of a toner cartridge according to first to eighth exemplary embodiments of the present disclosure.
Figure 77B:
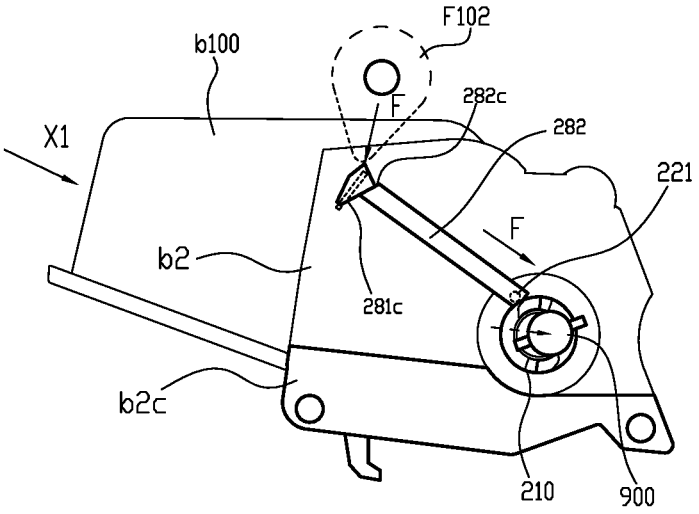
Figure 77C:
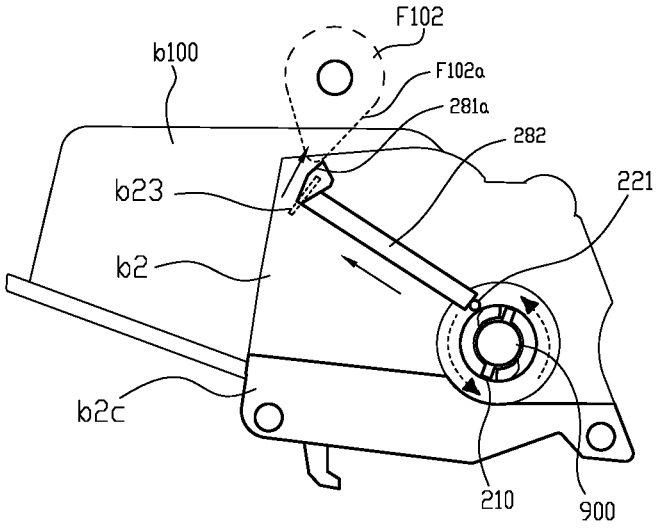
Figure 77D:
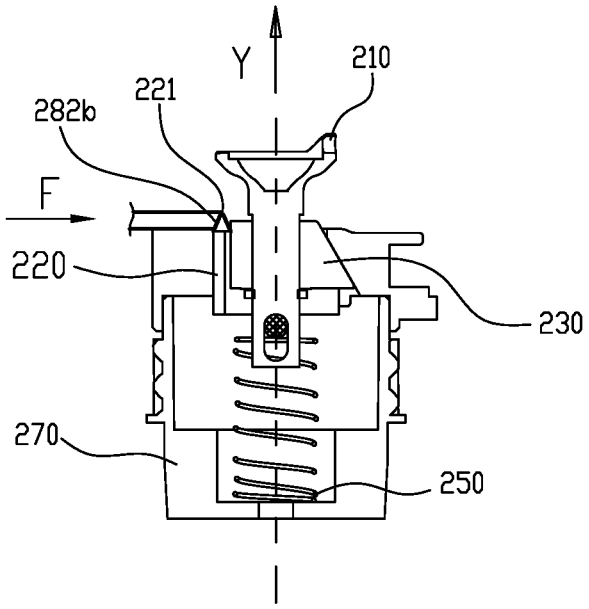

As shown in FIG. 76, the force transmission element 280 may be disposed on the side panel b2 and include a pressure receiving part 281 and a pushing element 282 (pushing rod). The bottom of the pressure receiving part 281 may include an buckle 281*d*, and the pressure member 281 may pass through the buckle 281*d* and can be inserted into the chute b23 at the surface of the side panel b2 so that the pressure receiving part 281 can slide along the chute b23. Referring to the mounting direction of the toner cartridge b, i.e., the X1 direction, the front inclined surface 281*b* and the rear inclined surface 281*a* may be disposed above the pressure receiving part 281 and a down inclined surface 281*c* may be disposed below the pressure receiving part 281. One end (the rear end) of the pushing element 282 may include a rear inclined surface 282*c* that abuts against the down inclined surface 281*c*, and the other end (the front end) may include a front inclined surface 282*b* that abuts against the pressing element 221. In addition, the bottom of the pushing element 282 may also include an undercut that is matched with the chute of the side panel b2 (not shown, referring to the chute b23 and the buckle 281*d*).

Figure 78:
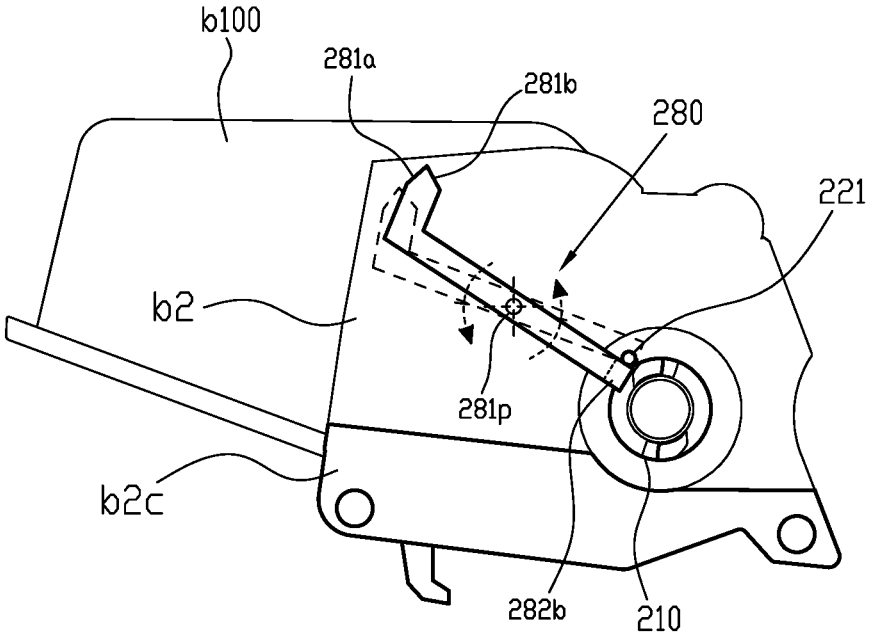
FIG. 78 is a schematic diagram of another structure of a force transmission element of a toner cartridge according to first to eighth exemplary embodiments of the present disclosure.

As shown in FIG. 77*a* to FIG. 77*d*, when the toner cartridge b is mounted in the mounting direction, i.e., the X1 direction, the front inclined surface 281*b* of the pressure receiving part 281 may first abut against the rear inclined surface F102*b* of the protrusion F102 to generate a downward pressing force F, which can press the pressure receiving part 281 to move downward. The down inclined surface 281*c* of the pressure receiving part 281 may also cooperate with and abut against the rear inclined surface 282*c* of the pushing element 282, so that the pushing element 282 can be moved forward. The front inclined surface may press the pressing element 221, so that the driving-force receiving member 210 can be contracted inward and prevented from structurally interfering with the drive unit 900 (referring to FIG. 34). After the toner cartridge b is correctly mounted, the pressure receiving part 281 can pass over the protrusion F102 as the toner cartridge b is mounted, and the front inclined surface 282*b* may not be pressed. Through an elastic force, the driving-force receiving member 210 can protrude outward and engage with the drive unit 900, and the pressure receiving part 281 and the pushing element 282 can also be pushed by the elastic force to return to the position before being pressed. When the toner cartridge b is removed, the rear inclined surface 281*a* of the pressure receiving part 281 can abut against with the front inclined surface F102*a* of the protrusion F102, and the driving-force receiving member 210 can be contracted inward and disengaged form the drive unit 900. In addition, as shown in FIG. 78, the pressure receiving part 281 and the pushing element 282 of the force transmission element 280 can be substituted by a rotatable swinging rod. The swinging rod can be pressed to rotate around the rotation point 281*p* thereof. The front inclined surface 281*b* and the rear inclined surface 281*a* of one end (rear end) of the swinging rod, and front inclined surface 282*b* of the pressing element 221 at the other end (front end) of the swinging rod can refer to the above configuration and are not elaborated here. That is, when the force transmission element 280 is pressed to transmit the downward pressing force F, the action of the force transmission element can be a rotation movement or a translational movement.

Exemplary Embodiment IX

According to previous embodiments, the trigger switch SW1 can be touched by the pushing block F103 of the toner cartridge guide rail F100 (of the inspection mechanism of the electronic imaging device), so that the inspection device PD1 can perform inspection operation and generate the signal that the trigger switch SW1 is turned on. Different from the inspection mode of previous embodiments, inspection mechanism according to Exemplary Embodiment IX is to inspect the toner cartridge b that is mounted in the electronic imaging device P through emitting and detecting of a detection light.

Figure 79:
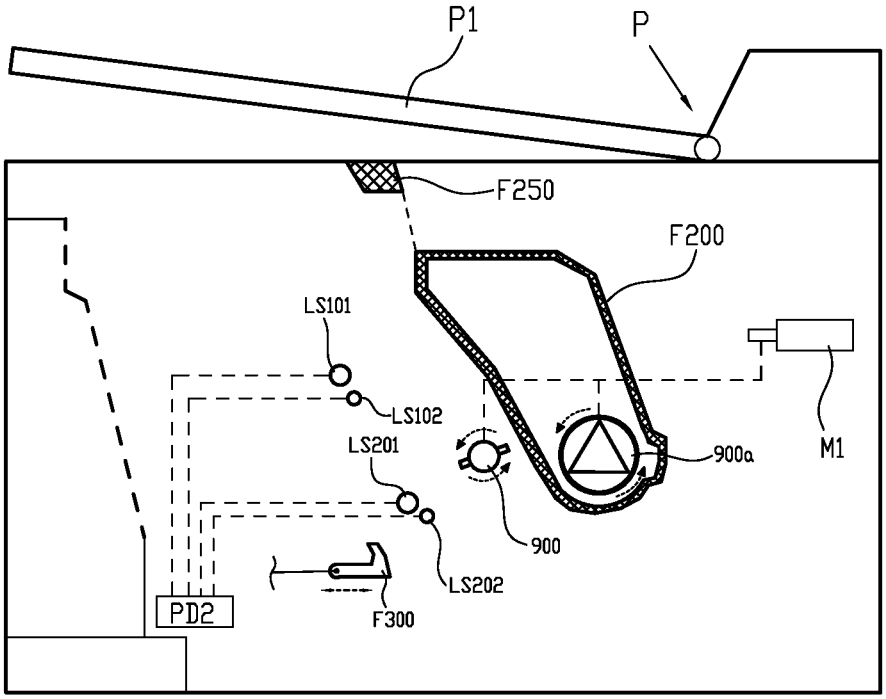
FIG. 79 is a schematic diagram of an internal structure of an electronic imaging device according to a ninth exemplary embodiment of the present disclosure.

As shown in FIG. 79, the inner surface of the electronic imaging device P may include a light-emitting element LS101 (e.g. a light emitting part of a light emitting diode (LED)), a light-receiving element LS102 and an inspection device PD2. The inspection device may be configured to determine the detection light emitted from the light emitting element LS101 is received by the light receiving element LS102 and then generate a signal about the inspection is completed.

With reference to Exemplary Embodiment I to Exemplary Embodiment VIII, the toner cartridge b and the photosensitive assembly a according to the present embodiment may be integrally configured or independent form each other. Optionally, the toner cartridge b and the photosensitive assembly a may be integrally disposed according to Exemplary Embodiment IX.

The structure and function of the drive assembly 200 and the contact engagement and disengagement process of the drive assembly 200 and the drive unit 900 in Exemplary Embodiment IX can refer to the above embodiments and are not elaborated here.

Control Mode 1 of Translucent Element

Figure 80A:
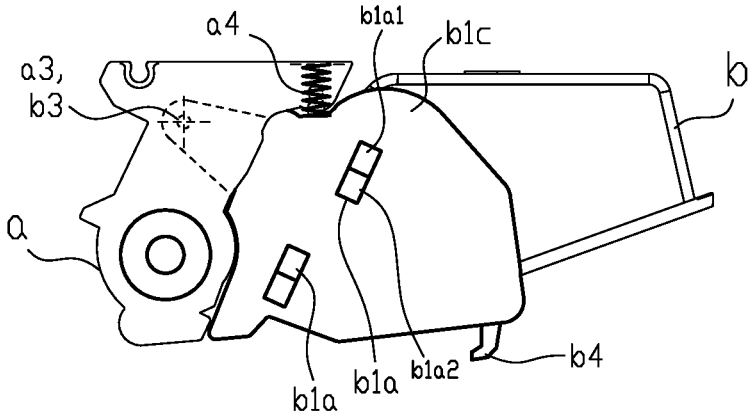
FIG. 80*a*, FIG. 80*b* and FIG. 81 are schematic structural diagrams of a slider of a toner cartridge according to a ninth exemplary embodiment of the present disclosure.
Figure 80B:
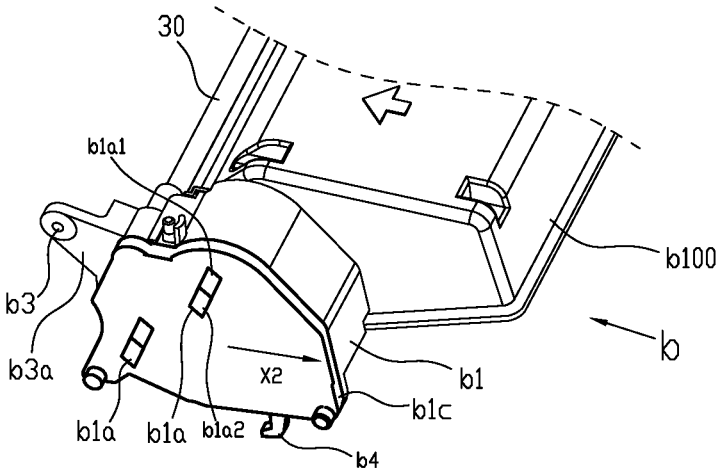
Figure 81:
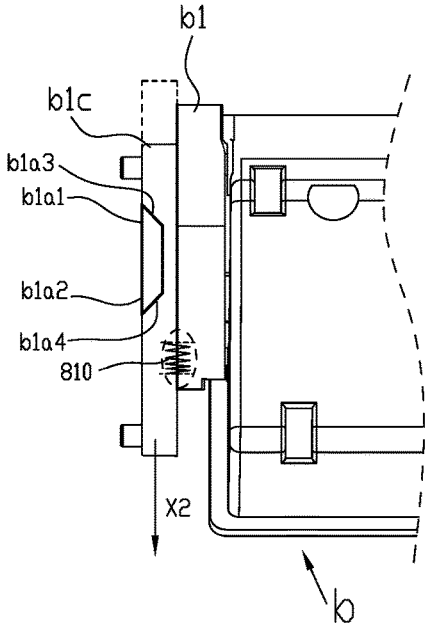

As shown in FIG. 80*a* and FIG. 80*b*, the slider b1*c* of the side panel b1 may include a translucent element b1*a*. When the slider b1*c* is slid relative to the side panel b1 because of the pulling part F300 acting on the cartridge action part b4, the translucent element b1*a* can be moved along with the sliding of the slider b1*c*. One end (an upper end) of the translucent element b1*a* may include a light-incident surface b1*a*1, and the other end (a lower end) may include a light-emitting surface b1*a*2. The translucent element may also include two inclined and opposite light-reflecting surfaces b1*a*3 and b1*a*4, as shown in FIG. 81.

Figure 82A:
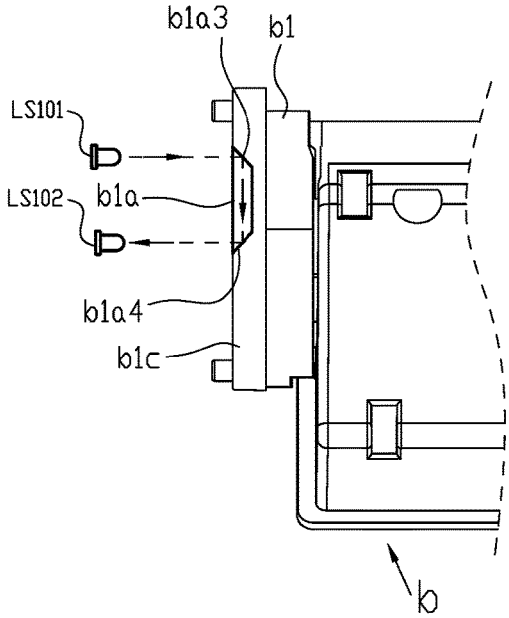
FIG. 82*a*, FIG. 82*b* and FIG. 82*c* are schematic diagrams of the operation of a slider of a toner cartridge according to a ninth exemplary embodiment of the present disclosure.
Figure 82B:
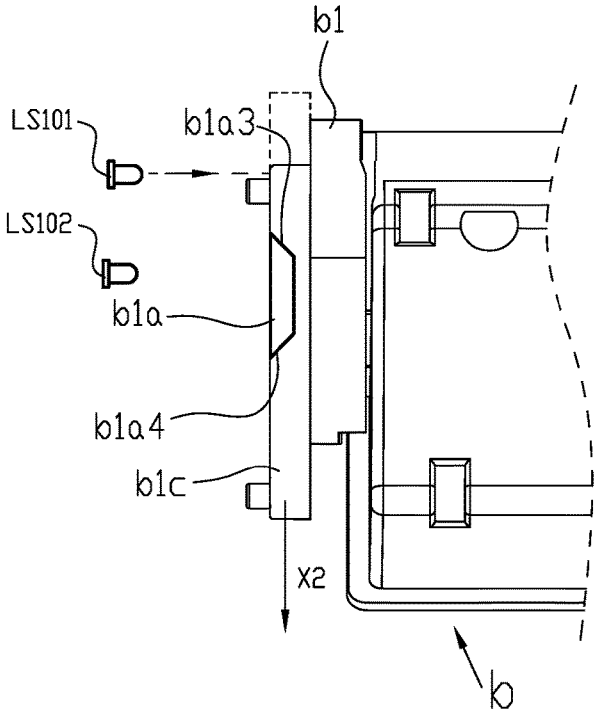
Figure 82C:
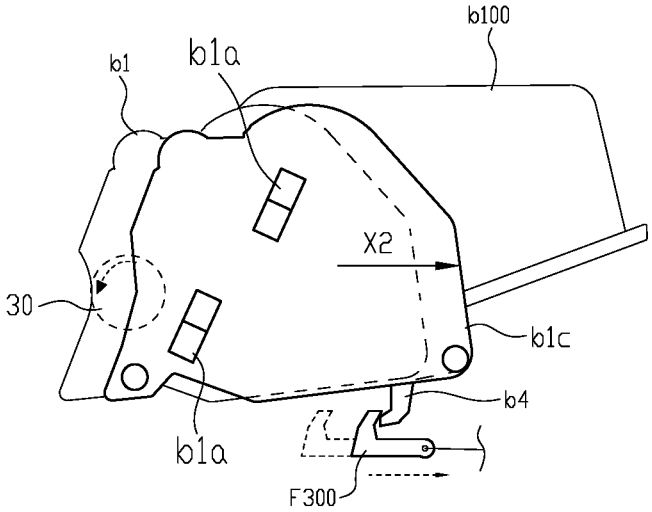

As shown in FIG. 82*a*, after the toner cartridge b is mounted in the electronic imaging device P, the inspection device PD2 can start the inspection of mounted toner cartridge b. When the pulling part F300 does not drag the cartridge action part b4 to cause the slider b1*c* to undergo a sliding displacement, the light-emitting element LS101 of the electronic imaging device P can correspond to the light incident surface b1*a*1 of the translucent element b1*a*, and the light-receiving element LS102 can correspond to the light-emitting surface b1*a*2. After emitted by the light-emitting element LS101 to the light-incident surface b1*a*1, the detection light may be reflected by the light-reflecting surface b1*a*3 and guided to the opposite light-reflecting surface b1*a*4. The detection light may be guided by the light-reflecting surface b1*a*4 to transmit out through a light-emitting surface b1*a*2. Finally, the detection light can be detected by the light-receiving element LS102. The guiding path of the detection light in the translucent element b1*a* may be a "U" type, and a received-signal can be generated by the inspection device PD2. When the pulling part F300 drags the cartridge action part b4 to cause the slider b1*c* to undergo a sliding displacement, as shown in FIG. 82*b* and FIG. 82*c*, after the slider b1*c* is displaced, the light-emitting element LS101 cannot correspond to the light-incident surface b1*a*1 of the translucent element b1*a*. Therefore, the detection light emitted by the light-emitting element LS101 cannot illuminate on the light-incident surface b1*a*1, so that the light-receiving element LS102 cannot receive the detection light and the inspection device PD2 may generate an unreceived-signal. Thus, through the signal generated by the inspection device PD2, the electronic imaging device P can inspect whether the toner cartridge mounted by the user matches the electronic imaging device P. For example, if a signal generated is "received-unreceived" or "received-unreceived-received-unreceived", the electronic imaging device P can automatically determine a matching toner cartridge is mounted by the user, the electronic imaging device P may display that the inspection procedure is completed, and the user can perform normal developing operation (printing).

Control Mode 2 of Translucent Element

Figure 83:
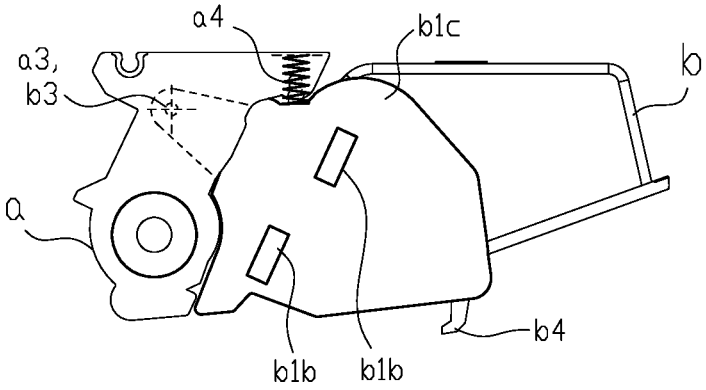
FIG. 83, FIG. 84*a* and FIG. 84*b* are schematic diagrams of the structure and operation of slider of a toner cartridge according to a ninth exemplary embodiment of the present disclosure.
Figure 84A:
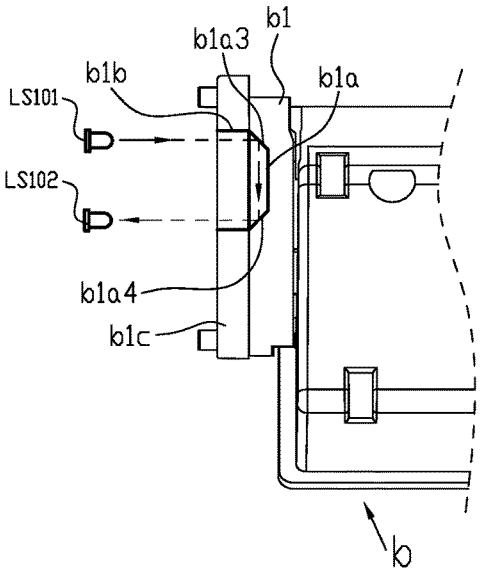
Figure 84B:
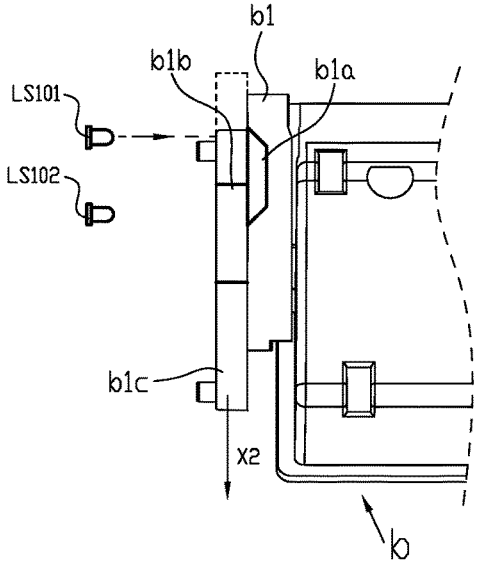

In addition, as shown in FIG. 83 to FIG. 84*b*, the translucent element b1*a* may also be disposed on the side panel b1, and the slider b1*c* that can be slid relative to side panel b1 may include a through hole b1*b* that can correspond to the translucent element b1*a*. When the pulling part F300 does not drag the cartridge action part b4 to cause the slider b1*c* to undergo a sliding displacement, the light-incident surface b1*a*1 and the light-emitting surface b1*a*2 of the translucent element b1*a* can be exposed through the through hole b1*b*. Thus, the detection light emitted by the light-emitting element LS101 can be reflected and guided by the translucent element b1*a* to the light-receiving element LS102 and the inspection can be completed. When the slider b1*c* is moved by a force, at lease a part of the light-incident surface b1*a*1 and/or the light-emitting surface b1*a*2 can be covered and blocked by the base plate of the sider b1*c*. Thus, the detection light emitted from the light-emitting element LS101 cannot illuminate on the light-incident surface b1*a*1, and the light-receiving element LS102 cannot receive the detection light. Therefore, the Control Mode 2 of the translucent element can also achieve the same inspection function and the same defection effect as the Control Mode 1 of the translucent element.

In addition, to increase the inspection accuracy, the quantity of translucent element b1*a* may also be two (the quantity of the through hole b1*b* is two), and correspondingly, the electronic imaging device P may also include two sets of the light-emitting elements LS101 and the light-receiving elements LS102.

Figure 85:
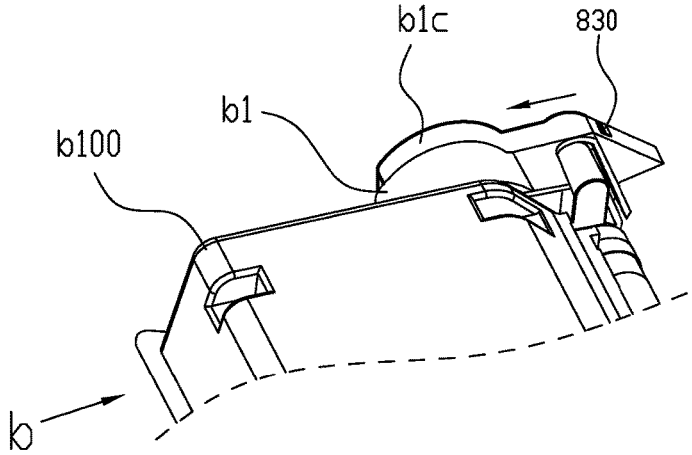
FIG. 85 is a schematic structural diagram of a slider of a toner cartridge according to a ninth exemplary embodiment of the present disclosure.

In addition, as shown in FIG. 85, the inspection method according to Exemplary Embodiment IX may also be the following. A chip 830 may be disposed on the slider b1*c*, and correspondingly a contact unit (not shown) configured to be in contact with the chap 830 and obtain the chip information may be disposed at the electronic imaging device P. Through the pulling part F300 acting on the slider b1*c*, the slider b1*c* can be slid back and forth, so that connection between the chip 830 and the contact unit can be turned on and off, and the above similar inspection process can be completed.

The present disclosure has been described with reference to specific embodiments. The present disclosure is not limited to herein, and also covers various modifications made within the scope of the technical solution of the present disclosure based on the strategy of the present disclosure.

What is claimed is:

1. A toner cartridge, being removably mounted in an electronic imaging device via a rotatable toner cartridge guide rail, the toner cartridge comprising:

a locating column, disposed and movable at one side of the toner cartridge, wherein the locating column is supported by the toner cartridge guide rail and rotates the toner cartridge guide rail when the locating column is moved by an external force;

wherein the electronic imaging device further comprises an inspection device having a trigger switch; when the toner cartridge guide rail is rotated in response to the external force on the locating column, the toner cartridge guide rail touches the trigger switch and turns on the trigger switch.

2. The toner cartridge according to claim 1, wherein a side panel is disposed at one side of the toner cartridge, and the locating column is slidable relative to the side panel.

3. The toner cartridge according to claim 2, wherein a slider is disposed on the side panel, the locating column is disposed on the slider, and under the external force, the slider drives the locating column to slide relative to the side panel.

4. The toner cartridge according to claim 3, wherein the slider includes a protrusion, a chute is disposed on the side panel, and through the protrusion, the slider slides on the chute of the side panel.

5. The toner cartridge according to claim 3, wherein the toner cartridge further includes a developing unit, and, compared to a location of a slider slid by the external force, the slider is located closer to the developing unit before the external force is applied for sliding the slider.

6. The toner cartridge according to claim 3, wherein an elastic resetting part is further disposed between the slider and the side panel, and the resetting part is configured to reset the slider when no external force is applied.

7. The toner cartridge according to claim 6, wherein the slider further includes a cartridge action part; the cartridge action part is movable by the external force to cause the slider to move the locating column; and the cartridge action part is disposed on the slider and protrudes downward.

8. The toner cartridge according to claim 7, wherein the cartridge action part has a protruding rod-shaped or hook-shaped structure.

9. The toner cartridge according to claim 8, wherein the cartridge action part and the slider are integrally configured.

10. The toner cartridge according to claim 7, wherein the electronic imaging device includes a pulling part, configured to drag the cartridge action part to move.

11. The toner cartridge according to claim 1, wherein a driving-force receiving member is disposed at the side of the toner cartridge and configured to receive a rotation driving force from a drive unit of the electronic imaging device, and the driving-force receiving unit and the locating column are disposed at the same side of the toner cartridge.

12. The toner cartridge according to claim 11, wherein the toner cartridge further includes a flange, configured to receive the rotation driving force from the driving-force receiving member, and the driving-force receiving member is capable of extending and contracting relative to the flange.

13. The toner cartridge according to claim 11, wherein a claw is disposed at an upper end of the driving-force receiving member, and the claw is capable of tilting or swinging relative to a bulk body of the driving-force receiving member.

14. The toner cartridge according to claim 12, wherein the toner cartridge further includes a control mechanism, configured to control the driving-force receiving member to extend and contract.

15. The toner cartridge according to claim 14, wherein the cartridge action part, when subjected to a force, is configured to push the control mechanism to control the driving-force receiving member to extend and contract.

16. The toner cartridge according to claim 2, wherein the toner cartridge includes a developing chamber, the side panel is fixed to one side of the developing chamber, and the developing chamber and the side panel are nonrotatable along with a rotation of the toner cartridge guide rail.

* * * * *